US007592957B2

(12) United States Patent
Achour et al.

(10) Patent No.: US 7,592,957 B2
(45) Date of Patent: Sep. 22, 2009

(54) ANTENNAS BASED ON METAMATERIAL STRUCTURES

(75) Inventors: Maha Achour, San Diego, CA (US); Ajay Gummalla, San Diego, CA (US); Marin Stoytchev, San Diego, CA (US)

(73) Assignee: Rayspan Corporation, San Diego, CA (US)

( * ) Notice: Subject to any disclaimer, the term of this patent is extended or adjusted under 35 U.S.C. 154(b) by 81 days.

(21) Appl. No.: 11/844,982

(22) Filed: Aug. 24, 2007

(65) Prior Publication Data

US 2008/0048917 A1 Feb. 28, 2008

Related U.S. Application Data

(60) Provisional application No. 60/840,181, filed on Aug. 25, 2006, provisional application No. 60/826,670, filed on Sep. 22, 2006.

(51) Int. Cl.
*H01Q 1/38* (2006.01)

(52) U.S. Cl. ..... 343/700 MS

(58) Field of Classification Search ..... 343/700 MS, 343/702, 767, 770, 729, 90
See application file for complete search history.

(56) References Cited

U.S. PATENT DOCUMENTS

| | | | | |
|---|---|---|---|---|
| 5,511,238 | A | 4/1996 | Bayraktaroglu | |
| 6,366,254 | B1 * | 4/2002 | Sievenpiper et al. | 343/770 |
| 6,512,494 | B1 * | 1/2003 | Diaz et al. | 343/909 |
| 6,525,695 | B2 | 2/2003 | McKinzie, III | |
| 6,545,647 | B1 * | 4/2003 | Sievenpiper et al. | 343/795 |
| 6,859,114 | B2 | 2/2005 | Eleftheriades et al. | |
| 7,215,007 | B2 * | 5/2007 | McKinzie et al. | 257/664 |
| 7,256,753 | B2 * | 8/2007 | Werner et al. | 343/909 |
| 7,330,090 | B2 | 2/2008 | Itoh et al. | |
| 7,358,915 | B2 * | 4/2008 | Legay et al. | 343/768 |
| 7,391,288 | B1 | 6/2008 | Itoh et al. | |
| 7,429,961 | B2 * | 9/2008 | Sievenpiper et al. | 343/909 |
| 7,446,712 | B2 | 11/2008 | Itoh et al. | |
| 7,463,213 | B2 * | 12/2008 | Nakano et al. | 343/909 |
| 2003/0011522 | A1 | 1/2003 | McKinzie, III et al. | |
| 2004/0075617 | A1 * | 4/2004 | Lynch et al. | 343/909 |
| 2004/0227668 | A1 | 11/2004 | Sievenpiper | |
| 2005/0253667 | A1 | 11/2005 | Itoh et al. | |
| 2008/0001684 | A1 | 1/2008 | Itoh et al. | |
| 2008/0204327 | A1 | 8/2008 | Lee et al. | |
| 2008/0258981 | A1 | 10/2008 | Achour et al. | |

OTHER PUBLICATIONS

Caloz and Itoh, *Electromagnetic Metamaterials: Transmission Line Theory and Microwave Applications*, John Wiley & Sons (2006).

Itoh, T., "Invited paper: Prospects for Metamaterials," *Electronics Letters*, 40(16):972-973, Aug. 2004.

Lai, A., et al., "Infinite Wavelength Resonant Antennas with Monopolar Radiation Pattern Based on Periodic Structures," *IEEE Transactions on Antennas and Propagation*, 55(3):868-876, Mar. 2007.

Pozar, D.M., *Microwave Engineering*, 3rd Ed., John Wiley & Sons, pp. 318-323 & 370, 2005.

Sievenpiper, "High-Impedance Electromagnetic Surfaces," Ph.D. Dissertation, University of California, Los Angeles, 1999.

* cited by examiner

*Primary Examiner*—Huedung Mancuso
(74) *Attorney, Agent, or Firm*—Fish & Richardson P.C.

(57) ABSTRACT

Techniques, apparatus and systems that use one or more composite left and right handed (CRLH) metamaterial structures in processing and handling electromagnetic wave signals. Antennas and antenna arrays based on enhanced CRLH metamaterial structures are configured to provide broadband resonances for various multi-band wireless communications.

26 Claims, 49 Drawing Sheets

Composite ($\beta=\beta_L+\beta_R$) Left and Right Handed Metamaterial Dispersion Diagram

Composite 1D ($\beta=\beta_L+\beta_R$) Left and Right Handed Metamaterial Dispersion diagram in the balanced case. (a) Balanced case $\omega_{SE}=\omega_{SH}=\omega_0$, (b) unbalanced case $\omega_{SE}\neq\omega_{SH}$.

(Top)
Gap
1650
Top Cell
Metal Patch
1641
1632
Via
Top Feed Line
1620
1644
Inter-Cell
Gap
1642
Cell
Via (Middle)
Cell
Via
1642
Capacitive
Coupling
Element
1631
1632
Via
1643
Capacitive
Coupling
Metal Patch (Side)
Via
1642
Via
1642
1601
Dielectric
Substrate
1642
Cell
Via
1612
Ground
Stripe
1642
Via
1632
Via (Bottom)
1610
Bottom
Ground
Electrode Layer
Ground
Stripe
1612
1642
Cell
Via
1632
Via Signal Frequency = 3.38 GHz Signal Frequency = 5.31 GHz FIG. 21A (Top)
Gap
1650
Top Cell
Metal Patch
1641
Top Feed Line
2020
1632
Via
2060
Launch
Pad
1644
Inter-Cell
Gap
1642
Via
Capacitive
Coupling
Element
2030
Via
1642

(Middle)
1632
Via
1643
Capacitive
Coupling
Metal Patch (Side)
Via
1642
Via
1642
1601
Dielectric
Substrate
1642
Via
1632
Via
1612
Ground
Stripe (Bottom)
Ground
Stripe
1612
1610
Bottom
Ground
Electrode Layer
1642
Via
1632
Via Signal Frequency = 2.65 GHz Signal Frequency = 5.30 GHz Signal Frequency = 2.5 GHz

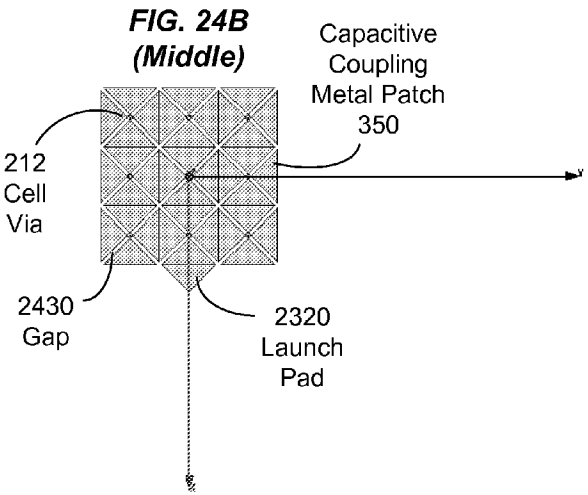
FIG. 24B (Middle)
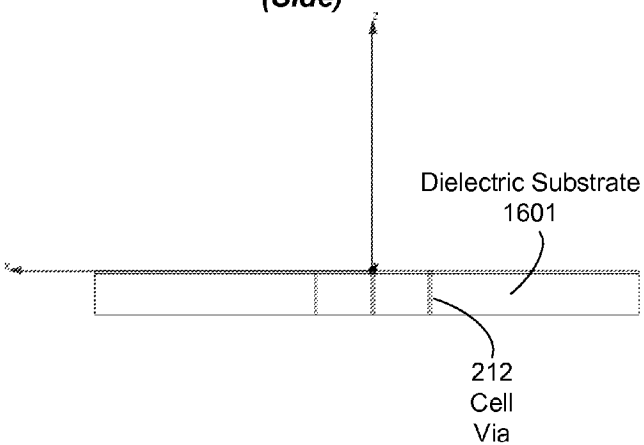
FIG. 24D (Side)
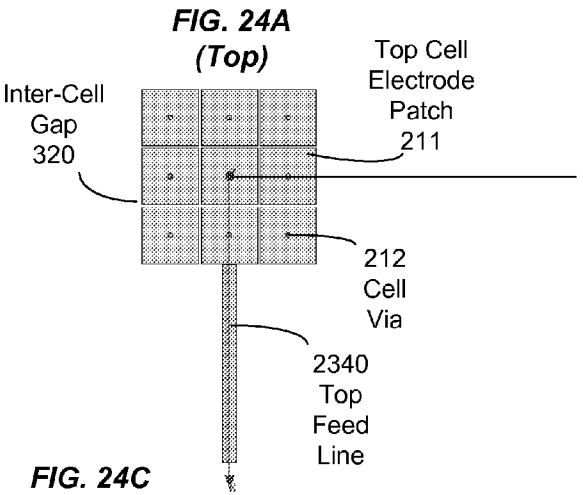
FIG. 24A (Top)
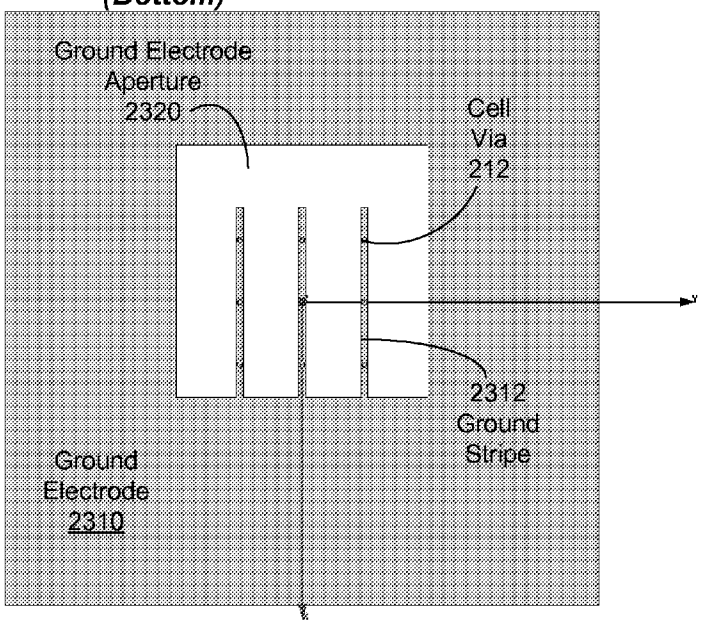
FIG. 24C (Bottom)

Signal Frequency = 2.62 GHz

*(Top)*

*(Bottom)*

*(Top)*

*(Bottom)*

Top CPW 3030
RX Cell Patch 3321
(1)
TX Cell Patch 3323
(2)
(3)
3322 RX Cell Patch
Top
Top Ground Electrode 3331

RX Cell Patch 3321
3D
3332
3331
Z
3351
3360
3323 TX Cell Patch
3322 RX Cell Patch
3301 Dielectric Substrate
X
3340 Via
Cell-GND 3350

GND Line 3351
3350
3351
Bottom
3332

3321 Cell Patch
3323
Y
Launch Pad
X
3322
Top
Top CPW 3030

*FIG. 36A (Top)*

*FIG. 36B (Middle)*

*FIG. 36C (Bottom)*

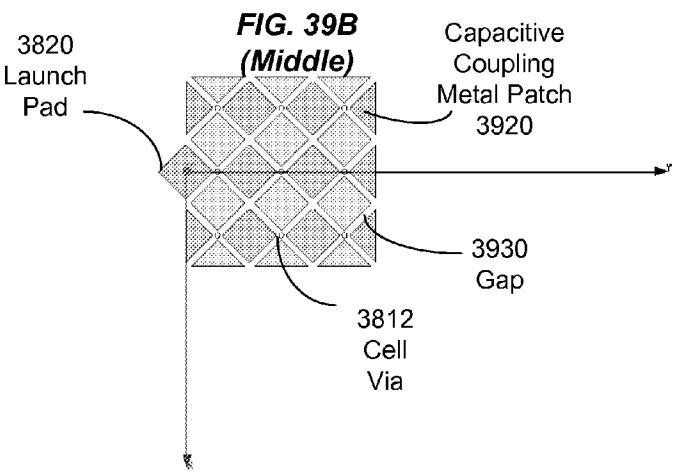
FIG. 39B (Middle)
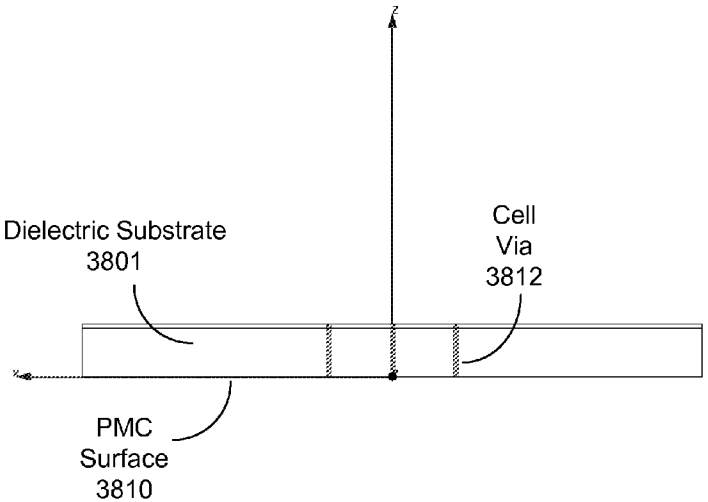
FIG. 39D (Side)
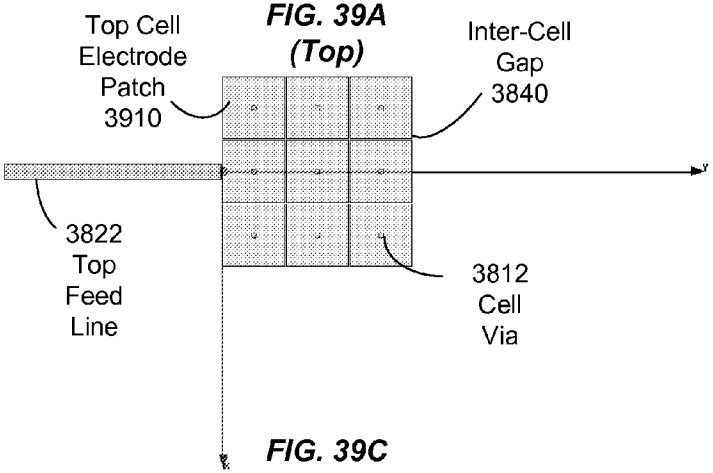
FIG. 39A (Top)
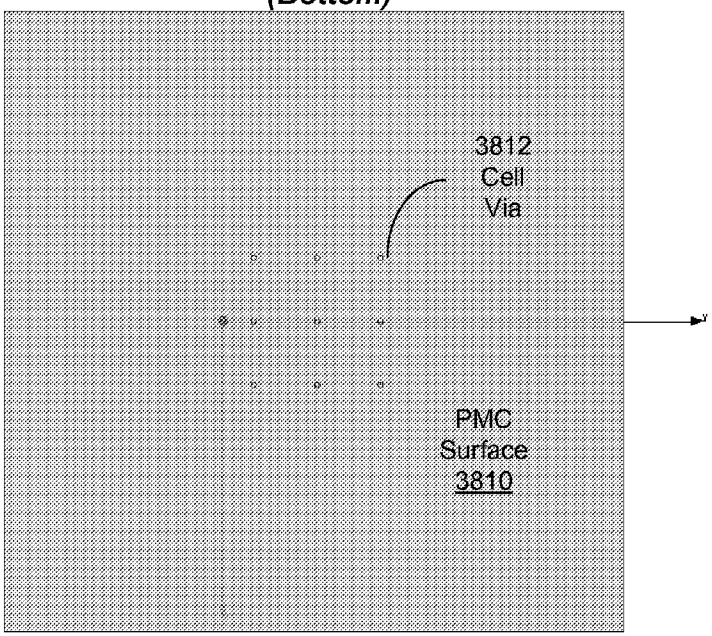
FIG. 39C (Bottom)

ANTENNAS BASED ON METAMATERIAL STRUCTURES

PRIORITY CLAIMS AND RELATED APPLICATIONS

This application claims the benefits of U.S. Provisional Patent Application Nos. 60/840,181 entitled "Broadband and Compact Multiband Metamaterial Structures and Antennas" and filed on Aug. 25, 2006, and 60/826,670 entitled "Advanced Metamaterial Antenna Sub-Systems" and filed on Sep. 22, 2006.

The disclosures of the above applications are incorporated by reference as part of the specification of this application.

BACKGROUND

This application relates to metamaterial (MTM) structures and their applications.

The propagation of electromagnetic waves in most materials obeys the right handed rule for the (E,H,β) vector fields, where E is the electrical field, H is the magnetic field, and β is the wave vector. The phase velocity direction is the same as the direction of the signal energy propagation (group velocity) and the refractive index is a positive number. Such materials are "right handed" (RH). Most natural materials are RH materials. Artificial materials can also be RH materials.

A metamaterial is an artificial structure. When designed with a structural average unit cell size p much smaller than the wavelength of the electromagnetic energy guided by the metamaterial, the metamaterial can behave like a homogeneous medium to the guided electromagnetic energy. Different from RH materials, a metamaterial can exhibit a negative refractive index where the phase velocity direction is opposite to the direction of the signal energy propagation where the relative directions of the (E,H,β) vector fields follow the left handed rule. Metamaterials that support only a negative index of refraction are "left handed" (LH) metamaterials.

Many metamaterials are mixtures of LH metamaterials and RH materials and thus are Composite Left and Right Handed (CRLH) metamaterials. A CRLH metamaterial can behave like a LH metamaterials at low frequencies and a RH material at high frequencies. Designs and properties of various CRLH metamaterials are described in, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

This application describes, among others, Techniques, apparatus and systems that use one or more composite left and right handed (CRLH) metamaterial structures in processing and handling electromagnetic wave signals. Antenna, antenna arrays and other RF devices can be formed based on CRLH metamaterial structures. For example, the described CRLH metamaterial structures can be used in wireless communication RF front-end and antenna sub-systems.

In one implementation, an antenna device includes a dielectric substrate having a first surface on a first side and a second surface on a second side opposing the first side; a cell conductive patch formed on the first surface; a cell ground conductive electrode formed on the second surface and in a footprint projected by the cell conductive patch onto the second surface; a main ground electrode formed on the second surface and separated from the cell ground conductive electrode; a cell conductive via connector formed in the substrate to connect the cell conductive patch to the cell ground conductive electrode; a conductive feed line formed on the first surface and having a distal end located close to and electromagnetically coupled to the cell conductive patch to direct an antenna signal to or from the cell conductive patch; and a conductive stripe line formed on the second surface and connecting cell ground conductive electrode to the main ground electrode. The cell conductive patch, the substrate, the cell conductive via connector and the cell ground conductive electrode, and the electromagnetically coupled conductive feed line are structured to form a composite left and right handed (CRLH) metamaterial structure. The cell ground electrode may have an area greater than a cross section of the cell conductive via connector and less than an area of the cell conductive patch. The cell ground electrode may also be greater than an area of the cell conductive patch.

In another implementation, an antenna device includes a dielectric substrate having a first surface on a first side and a second surface on a second side opposing the first side; cell conductive patches formed over the first surface to be separated from and adjacent to one another to allow capacitive coupling between two adjacent cell conductive patches; a main ground electrode formed on the second surface outside a footprint projected collectively by the cell conductive patches onto the second surface; and cell ground electrodes formed on the second surface to spatially correspond to the cell conductive patches, one cell ground electrode to one cell conductive patch, respectively. Each cell ground electrode is within a footprint projected by a respective cell conductive patch onto the second surface, and wherein the cell ground electrodes are spatially separate from the main ground electrode. This device also includes conductive via connectors formed in the substrate to connect the cell conductive patches to the cell ground electrodes, respectively, to form a plurality of unit cells that construct a composite left and right handed (CRLH) metamaterial structure; and at least one conductive stripe line formed on the second surface to connect the plurality of cell ground electrodes to the main ground electrode.

In another implementation, an antenna device includes a first dielectric substrate having a first top surface on a first side and a first bottom surface on a second side opposing the first side, and a second dielectric substrate having a second top surface on a first side and a second bottom surface on a second side opposing the first side. The first and second dielectric substrates stack over each other to engage the second top surface to the first bottom surface. This device includes cell conductive patches formed on the first top surface to be separated from and adjacent to one another to allow capacitive coupling between two adjacent cell conductive patches and a first main ground electrode formed on the first surface and spatially separate from the cell conductive patches. The first main ground electrode is patterned to form a co-planar waveguide that is electromagnetically coupled to a selected cell conductive patch of the cell conductive patches to direct an antenna signal to or from the selected cell conductive patch. A second main ground electrode is formed between the first and second substrates and on the second top surface and the first bottom surface. Cell ground electrodes are formed on the second bottom surface to spatially correspond to the cell conductive patches, one cell ground electrode to one cell conductive patch, respectively and each cell ground electrode is within a footprint projected by a respective cell conductive patch onto the second bottom surface. This device further includes bottom ground electrodes formed on the second bottom surface below the second main ground electrode; ground conductive via connectors formed in the second substrate to connect the bottom ground electrodes to the second main electrode, respectively; and bottom surface conductive stripe lines formed on the second bottom surface to connect the plurality of cell ground electrodes to the bottom ground electrodes, respectively.

In yet another implementation, an antenna device includes a dielectric substrate having a first surface on a first side and a second surface on a second side opposing the first side; a cell conductive patch formed over the first surface; a perfect magnetic conductor (PMC) structure comprising a perfect magnetic conductor (PMC) surface and engaged to the second surface of the substrate to press the PMC surface against the second surface; a cell conductive via connector formed in the substrate to connect the cell conductive patch to the PMC surface; and a conductive feed line formed on the first surface and having a distal end located close to and electromagnetically coupled to the cell conductive patch to direct an antenna signal to or from the cell conductive patch. In this device, the cell conductive patch, the substrate, the cell conductive via connector, electromagnetically coupled conductive feed line, and the PMC surface are structured to form a composite left and right handed (CRLH) metamaterial structure.

These and other implementations can be used to achieve one or more advantages in various applications. For example, compact antenna devices can be constructed to provide broad bandwidth resonances and multimode antenna operations.

BRIEF DESCRIPTION OF THE DRAWINGS

FIGS. 16 through 37 show examples of CRLH MTM antenna designs based on various truncated ground conductive layer designs and respective performance characteristics based on stimulation and measurements.

FIGS. 38, 39A, 39B, 39C and 39D show one example of a CRLH MTM antenna having a perfect magnetic conductor (PMC) surface.

DETAILED DESCRIPTION

A pure LH material follows the left hand rule for the vector trio (E,H,β) and the phase velocity direction is opposite to the signal energy propagation. Both the permittivity and permeability are negative. A CRLH Metamaterial can exhibit both left hand and right hand electromagnetic modes of propagation depending on the regime or frequency of operation. Under certain circumstances, a CRLH metamaterial can exhibit a non-zero group velocity when the wavevector is zero. This situation occurs when both left hand and right hand modes are balanced. In an unbalanced mode, there is a bandgap in which electromagnetic wave propagation is forbidden. In the balanced case, the dispersion curve does not show any discontinuity at the transition point $\beta(\omega_o)=0$ between Left and Right handed modes, where the guided wavelength is infinite $\lambda_g=2\pi/|\beta|\rightarrow\infty$ while the group velocity is positive:

$$V_g = \frac{d\omega}{d\beta}\Big|_{\beta=0} > 0$$

This state corresponds to Zeroth Order mode m=0 in a Transmission Line (TL) implementation in the LH handed region. The CRHL structure supports a fine spectrum of low frequencies with a dispersion relation that follows the negative β parabolic region which allows a physically small device to be built that is electromagnetically large with unique capabilities in manipulating and controlling near-field radiation patterns. When this TL is used as a Zeroth Order Resonator (ZOR), it allows a constant amplitude and phase resonance across the entire resonator. The ZOR mode can be used to build MTM-based power combiner/splitter, directional couplers, matching networks, and leaky wave antennas.

In RH TL resonators, the resonance frequency corresponds to electrical lengths $\theta_m=\beta_m l=m\pi$, where l is the length of the TL and m=1,2,3, . . . . The TL length should be long to reach low and wider spectrum of resonant frequencies. The operating frequencies of a pure LH material are the low frequencies. A CRLH metamaterial structure is very different from RH and LH materials and can be used to reach both high and low spectral regions of the RF spectral ranges of RH and LH materials.

Figure 1:
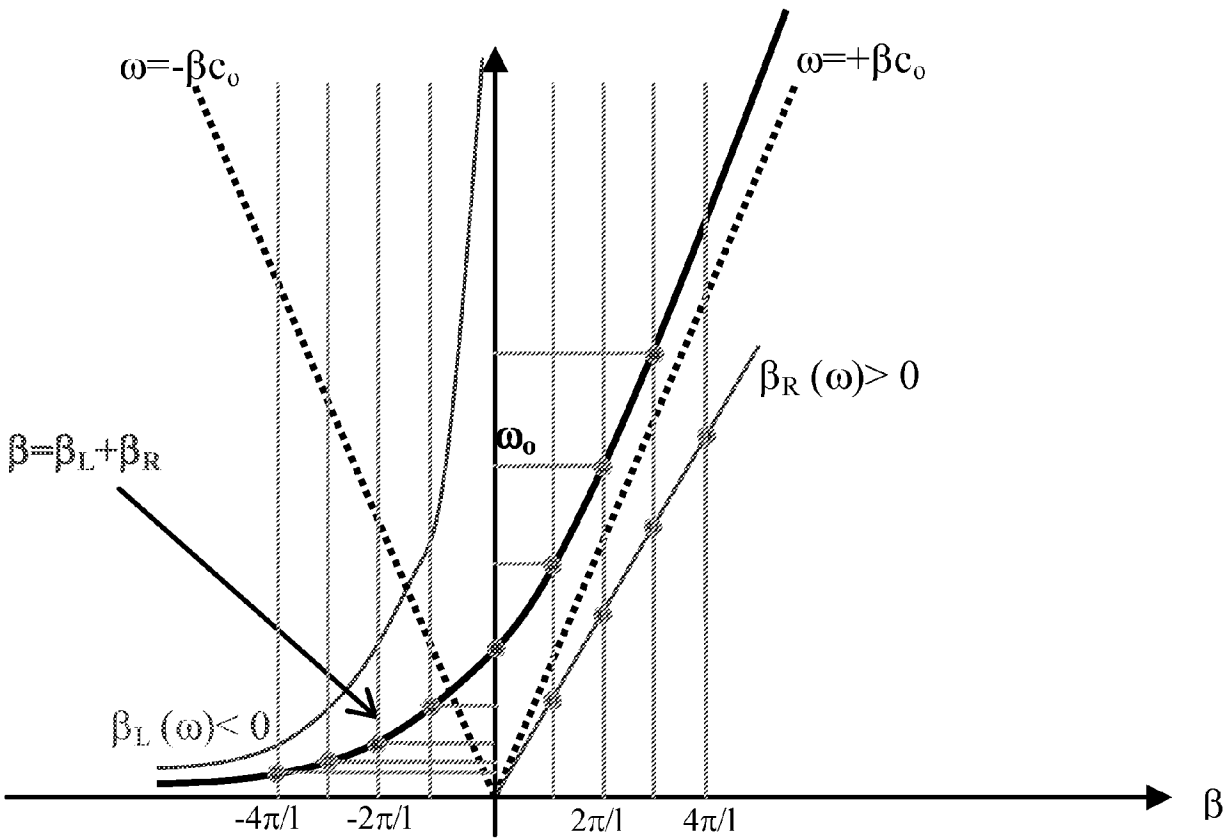
FIG. 1 shows the dispersion diagram of a CRLH metamaterial

FIG. 1 shows the dispersion diagram of a balanced CRLH metamaterial. The CRLH structure can support a fine spectrum of low frequencies and produce higher frequencies including the transition point with m=0 that corresponds to infinite wavelength. This allows seamless integration of CRLH antenna elements with directional couplers, matching networks, amplifiers, filters, and power combiners and splitters. In some implementations, RF or microwave circuits and devices may be made of a CRLH MTM structure, such as directional couplers, matching networks, amplifiers, filters, and power combiners and splitters. CRLH-based Metamaterials can be used to build an electronically controlled Leaky Wave antenna as a single large antenna element in which leaky waves propagate. This single large antenna element includes multiple cells spaced apart in order to generate a narrow beam that can be steered.

Figure 2:
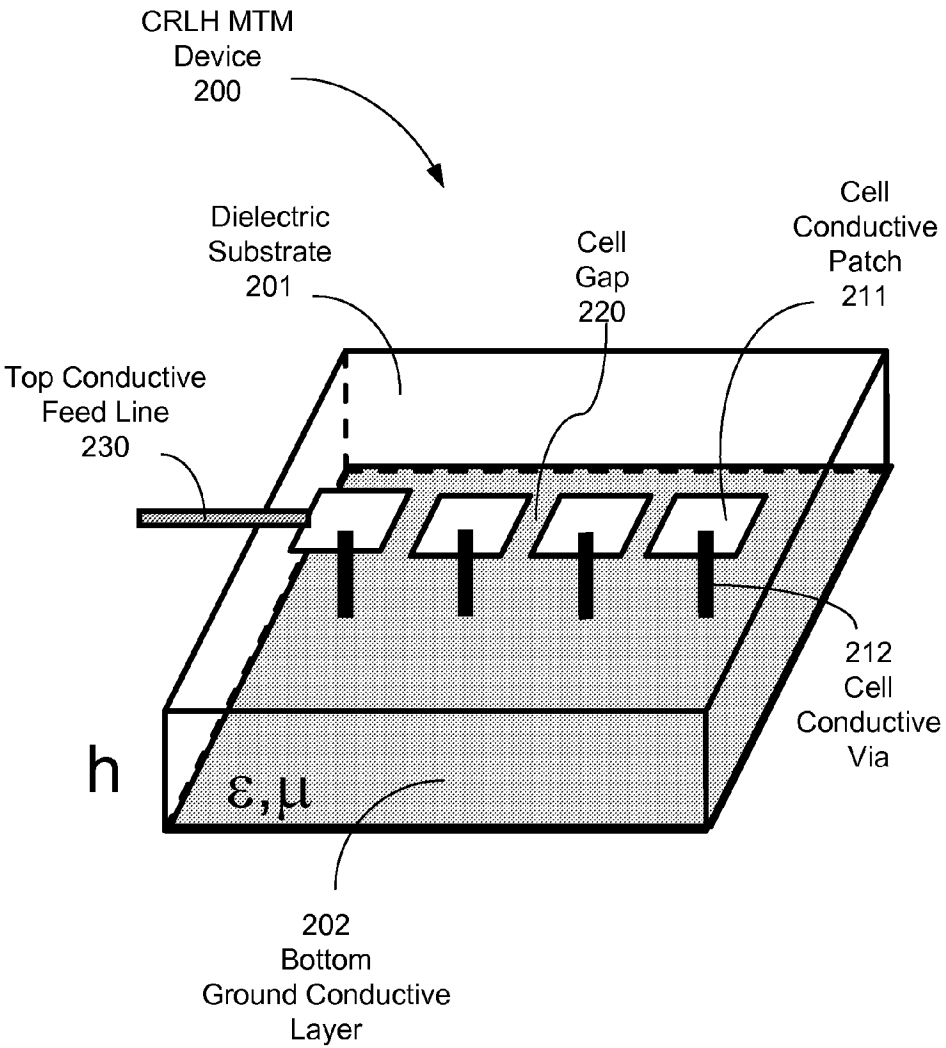
FIG. 2 shows an example of a CRLH MTM device with a 1-dimensional array of four MTM unit cells.

FIG. 2 shows an example of a CRLH MTM device 200 with a 1-dimensional array of four MTM unit cells. A dielectric substrate 201 is used to support the MTM unit cells. Four conductive patches 211 are formed on the top surface of the substrate 201 and separated from one another without direct contact. The gap 220 between two adjacent patches 211 is set to allow capacitive coupling between them. The adjacent patches 211 may interface with each other in various geometries. For example, the edge of each patch 211 may have an interdigitated shape to interleave with a respective interdigitated edge of another patch 211 to achieve enhanced patch to patch coupling. On the bottom surface of the substrate 201, a ground conductive layer 202 is formed and provides a common electrical contact for different unit cells. The ground conductive layer 202 may be patterned to achieve desired properties or performance of the device 200. Conductive via connectors 212 are formed in the substrate 201 to respectively connect the conductive patches 211 to the ground conductive layer 202. In this design, each MTM unit cell includes a volume having a respective conductive patch 211 on the top surface, and a respective via connector 212 connecting the respective conductive patch 211 to the ground conductive layer 202. In this example, a conductive feed line 230 is formed on the top surface and has a distal end located close to but is separated from the conductive patch 211 of a unit cell at one end of the 1-D array of unit cells. A conductive launching pad may be formed near the unit cell and the feed line 230 is connected to the launching pad and is electromagnetically coupled to the unit cell. This device 200 is structured to form a composite left and right handed (CRLH) metamaterial structure from the unit cells. This device 200 can be a CRLH MTM antenna, which transmits or receives a signal via the patches 211. A CRLH MTM transmission line can also be constructed from this structure by coupling a second feed line on the other end of the 1-D array of the MTM cells.

Figure 2A:
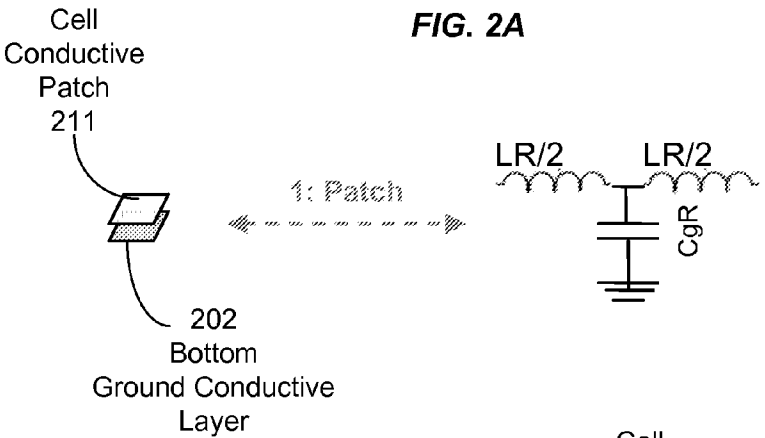
FIGS. 2A, 2B and 2C illustrate electromagnetic properties and functions of parts in each MTM unit cell in FIG. 2 and the respective equivalent circuits.
Figure 2B:
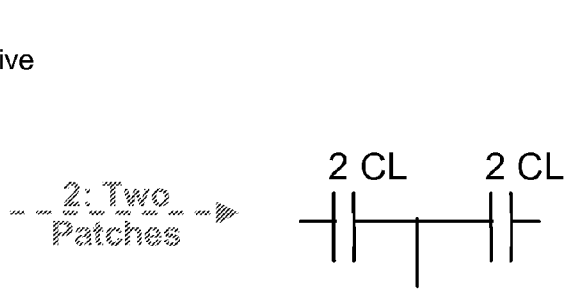
Figure 2C:
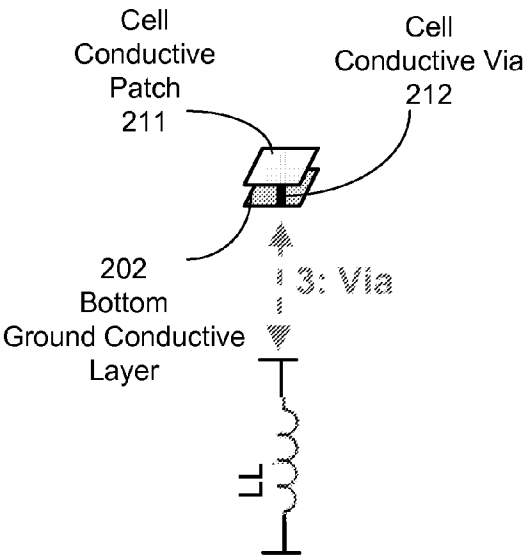

FIGS. 2A, 2B and 2C illustrate the electromagnetic properties and functions of parts in each MTM unit cell in FIG. 2 and the respective equivalent circuits. FIG. 2A shows the capacitive coupling between each patch 211 and the ground conductive layer 202, and induction due to propagation along the top patch 211. FIG. 2B shows capacitive coupling between two adjacent patches 211. FIG. 2C shows the inductive coupling by the via connector 212.

Figure 3:
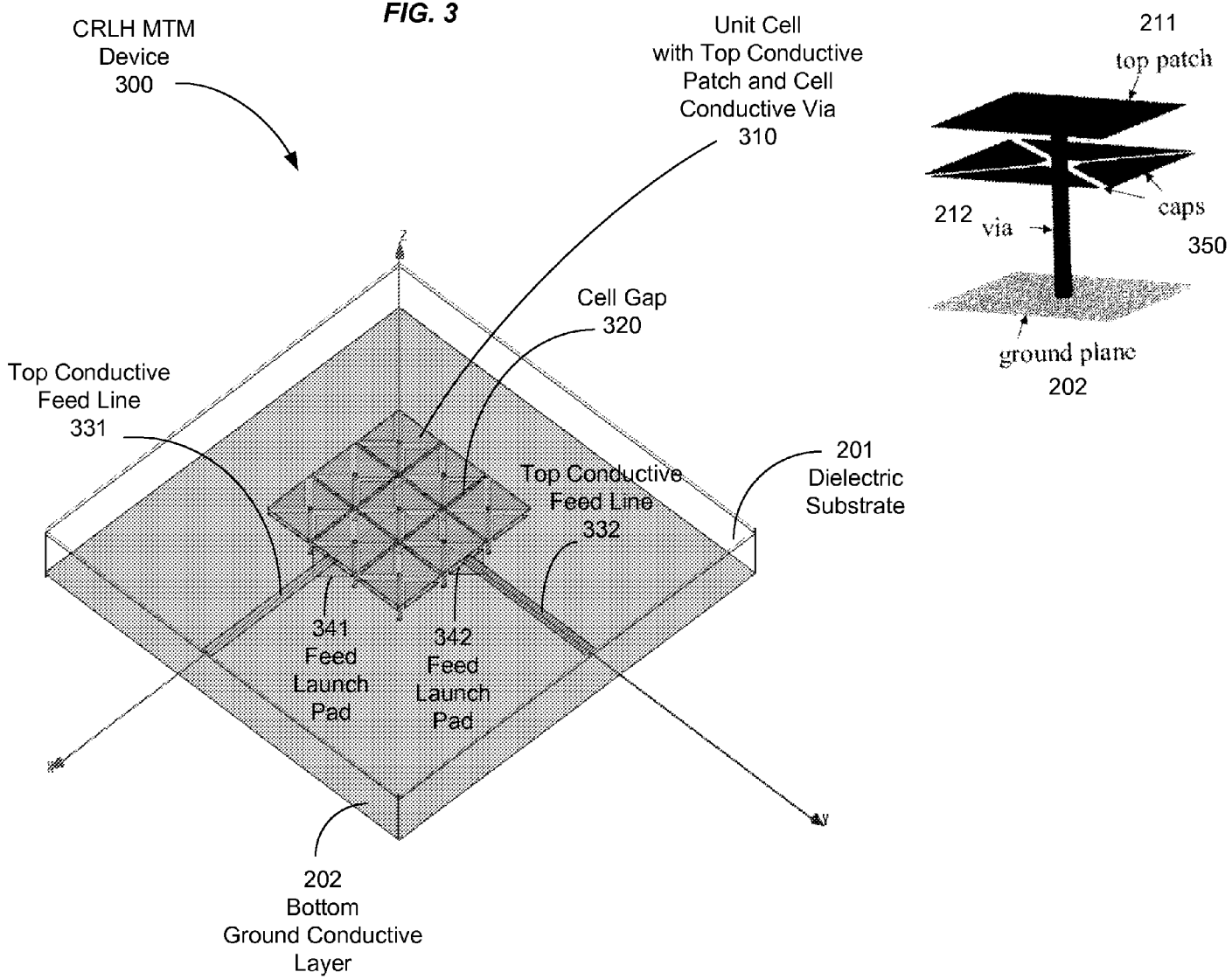
FIG. 3 illustrates another example of a CRLH MTM device based on a 2-dimensional array of MTM unit cells.

FIG. 3 illustrates another example of a CRLH MTM device 300 based on a 2-dimensional array of MTM unit cells 310. Each unit cell 310 may be constructed as the unit cell in FIG. 2. In this example, the unit cell 310 has a different cell structure and includes another conductive layer 350 below the top patch 211 in a metal-insulator-metal (MIM) structure to enhance the capacitive coupling of the left handed capacitance CL between two adjacent unit cells 310. This cell design can be implemented by using two substrates and three metal layers. As illustrated, the conductive layer 350 has conductive caps symmetrically surrounding and separated from the via connector 212. Two feed lines 331 and 332 are formed on the top surface of the substrate 201 to couple to the CRLH array along two orthogonal directions of the array, respectively. Feed launch pads 341 and 342 are formed on the top surface of the substrate 201 and are spaced from their respective patches 211 of the cells to which the feed lines 331 and 332 are respectively coupled. This 2-dimensional array can be used as a CRLH MTM antenna for various applications, including dual-band antennas. In addition to the above MIM structure design, the capacitive coupling between two adjacent cells may also be increased while maintaining the cell small size by using interdigital capacitor designs or other curved shapes to increase the interfacing area between the top patches of two adjacent cells.

Figure 4:
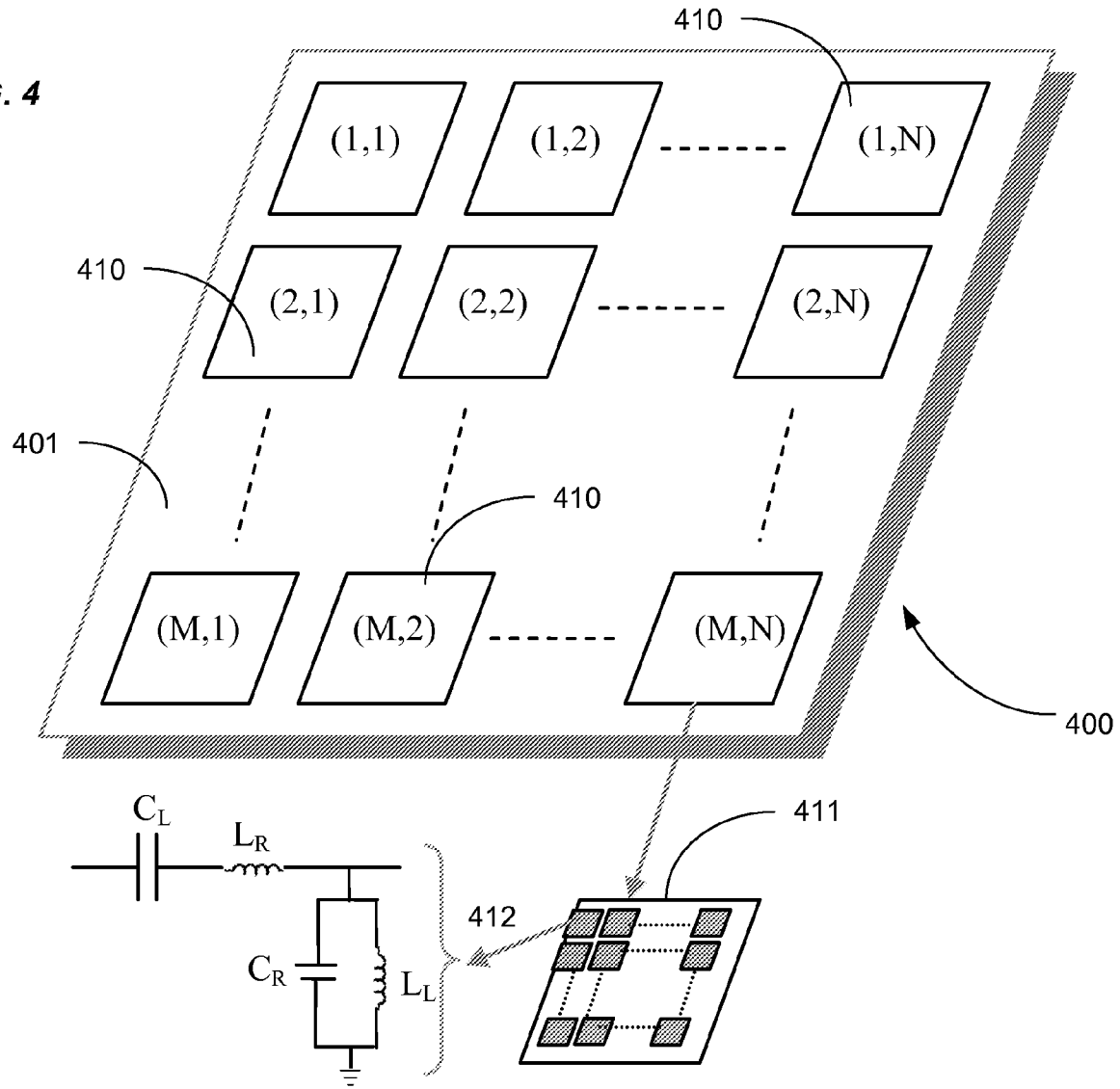
FIG. 4 shows an example of an antenna array that includes antenna elements formed in a 1-D or 2-D array and in a CRLH MTM structure.

FIG. 4 shows an example of an antenna array 400 that includes antenna elements 410 formed in a 1-D and/or 2-D array on a support substrate 401. Each antenna element 410 is a CRLH MTM element and includes one or more CRLH MTM unit cells 412 each in a particular cell structure (e.g., a cell in FIG. 2 or 3). The CRLH MTM unit cells 412 in each antenna element 410 may be directly formed on the substrate 401 for the antenna array 400 or formed on a separate dielectric substrate 411 which is engaged to the substrate 401. The two or more CRLH MTM unit cells 412 in each antenna element may be arranged in various configurations, including a 1-D array or a 2-D array. The equivalent circuit for each cell is also shown in FIG. 4. The CRLH MTM antenna element can be engineered to support desired functions or properties in the antenna array 400, e.g., broadband, multi-band or ultra wideband operations. CRLH MTM antenna elements can also be used to construct Multiple Input Multiple Output (MIMO) antennas where multiple streams are transmitted or received at the same time over the same frequency band by using multiple uncorrelated communication paths enabled by multiple transmitters/receivers.

CRLH MTM antennas can be designed to reduce the size of the antenna elements and to allow for close spacing between two adjacent antenna elements, while minimizing undesired coupling between different antenna elements and their corresponding RF chains. For example, each MTM unit cell can have a dimension smaller than one sixth or one tenth of a wavelength of a signal in resonance with the CRLH metamaterial structure and two adjacent MTM unit cells can be spaced from each other by one quarter of the wavelength or less. Such antennas can be used to achieve one or more of the following: 1) antenna size reduction, 2) optimal matching, 3) means to reduce coupling and restore pattern orthogonality between adjacent antennas by using directional couplers and matching network, and 4) potential integration of filters, diplexer/duplexer, and amplifiers.

Various radio devices for wireless communications include analog/digital converters, oscillators (single for direct conversion or multiples for multi-step RF conversion), matching networks, couplers, filters, diplexer, duplexer, phase shifters and amplifiers. These components tend to be expensive elements, difficult to integrate in close proximity, and often exhibit significant losses in signal power. MTM-based filters and diplexer/duplexer can be also built and integrated with the antennas and power combiner, directional coupler, and matching network when present to form the RF-chain. Only the external port that is directly connected to the RFIC needs to comply with 50Ω regulation. Internal ports between antenna, filter, diplexer, duplexer, power combiner, directional coupler, and matching network can be different from 50Ω in order to optimize matching between these RF elements. Hence, MTM structures can be used to integrate these components in an efficient and cost-effective way.

MTM technologies can be used to design and develop radio frequency (RF) components and subsystems with performance similar to or exceeding conventional RF structures, at a fraction of existing sizes, for examples antenna size reduction as much as $\lambda/40$. One limitation of various MTM antennas and resonators is a narrow bandwidth around a resonating frequency in either single-band or multi-band antennas.

In this regard, this application describes techniques to design MTM-based broadband, multi-band, or ultra-wideband transmission line (TL) structure to be used in RF components and sub-systems such as antennas. The techniques can be used to identify suitable structures that are low-cost and easy to manufacture while maintaining high efficiency, gain, and compact sizes. Examples of such structures using full-wave simulation tools such as HFSS are also provided.

In one implementation, the design algorithm includes (1) Identifying structure resonant frequencies, and (2) Determining the dispersion curve slopes near resonances in order to analyze bandwidth. This approach provides insights and guidance for bandwidth expansion not only for TL and other MTM structures but also for MTM antennas radiating at their resonance frequencies. The algorithm also includes (3): once the BW size is determined to be realizable, finding a suitable matching mechanism for the feed line and edge termination (when present), which presents a constant matching load impedance ZL (or matching network) over a wide frequency band around the resonances. Using this mechanism, the BB, MB, and/or UWB MTM designs are optimized using Transmission Lines (TL) analysis and then adopted in Antenna designs through use of full-wave simulation tools such as HFSS.

MTM structures can be used to enhance and expand the design and capabilities of RF components, circuits, and subsystems. Composite Left Right Hand (CRLH) TL structures, where both RH and LH resonances can occur, exhibit desired symmetries, provide design flexibility, and can address specific application requirements such as frequencies and bandwidths of operation.

Designs of MTM 1D and 2D transmission lines in this application can be used to construct 1D and 2D broadband, multiband (MB), and ultra-wideband (UWB) TL structures for antennas and other applications. In one design implementation, N-cell dispersion relations and input/output impedances are solved in order to set the frequency bands and their corresponding bandwidths. In one example, a 2-D MTM array is designed to include a 2D anisotropic pattern and uses two TL ports along two different directions of the array to excite different resonances while the rest of the cells are terminated.

The 2D anisotropic analysis has been conducted for a transmission line (TL) with one input and one output. The matrix notation is denoted in Eq. II-1-1. Notably, an off-center TL feed analysis is conducted to consolidate multiple resonances along the x and y directions to increase frequency bands.

$$\begin{pmatrix} Vin \\ Iin \end{pmatrix} = \begin{pmatrix} A & B \\ C & D \end{pmatrix} \begin{pmatrix} Vout \\ Iout \end{pmatrix} \quad \text{(II-1-1)}$$

A CRLH MTM array can be designed to exhibit a broadband resonance and to include one or more of the following features: (1) 1D and 2D structure with reduced Ground Plane (GND) under the structure, (2) 2D anisotropic structure with offset feed with full GND under the structure, and (3) improved termination and feed impedance matching. Based on the techniques and examples described in this application, various 1D and 2D CRLH MTM TL structures and antennas can be constructed to provide broadband, multi-band, and ultra-wideband capabilities.

A 1D structure of CRLH MTM elements can include N identical cells in a linear array with shunt (LL, CR) and series (LR, CL) parameters. These five parameters determine the N resonant frequencies, the corresponding bandwidth, and input and output TL impedance variations around these resonances. These five parameters also decide the structure/antenna size. Hence careful consideration is given to target compact designs as small as $\lambda/40$ dimensions, where $\lambda$ is the propagation wavelength in free-space. In both TL and antenna cases, the bandwidth over the resonances are expanded when the slope of dispersion curves near these resonances is steep. In the 1D case, it was proven that the slope equation is independent of the number of cells N leading to various ways to expand bandwidth. CRLH MTM structures with high RH frequency $\omega_R$ (i.e. low shunt capacitance CR and series inductance LR) exhibit lager bandwidths. Low CR values can be achieved by, e.g., truncating the GND area under the patches that are connected to the GND through the vias.

Once the frequency bands, bandwidth, and size are specified, the next step is to consider matching the structure to the feed-line and proper termination of edge cells to reach the targeted frequency bands and bandwidth. Specific examples are given where BW increased with wider feed lines and adding a termination capacitor with values near matching values at the desired frequencies. One challenge in designing CRLH MTM structures is identifying appropriate feed/termination matching impedances that are independent of or change slowly with frequency over a desired band. Full analyses are conducted to select a structure with similar impedance values around the resonances.

Conducted analyses and running FEM simulations show the presence of different modes in the frequency gap. Typical LH ($n \leqq 0$) and RH ($n \geqq 0$) are TEM modes, whereas the modes between LH and RH are TE modes are considered mixed RH and LH modes. These TE modes have higher BW in comparison with pure LH modes, and can be manipulated to reach lower frequencies for the same structure. In this application, we present some examples of structures exhibiting mixed modes.

Analysis and designs of 2D CRLH MTM structures are similar to 1D structures in some aspects and are generally much more complex. The 2D advantage is the additional degrees of freedom it provides over the 1D structure. In designing a 2D structure, the bandwidth can be expanded following similar steps as in the 1D designs and multiple resonances along the x and y directions can be combined to expand the device bandwidth.

A 2D CRLH MTM structure includes Nx and Ny number of columns and rows of cells along x and y directions, respectively, and provides a total of Ny×Nx cells. Each cell is characterized by its series impedance Zx (LRx,CLx) and Zy (LRy,CLy) along the x and y axes respectively and shunt admittance Y (LL,CR). Each cell is represented by a four-branch RF network with two branches along the x-axis and two branches long the y-axis. In a 1D structure, the unit cell is represented by a two-branch RF network which is less complex to analyze than the 2D structure. These cells are interconnected like a Lego structure through its four internal branches. In 1D the cells are interconnected through two branches. In a 2D structure, the external branches, also referred to by edges, are either excited by external source (input port) to serve as an output port, or terminated by "Termination Impedances."There are a total of Ny×Nx edge branches in a 2D structure. In 1D structure, there are only two edge branches that can serve as input, output, input/output, or termination port. For example, a 1D TL structure that is used in an antenna design has one end serving as the input/output port and the other end terminated with Zt impedance, which is infinite in most cases representing the extended antenna substrate. (leave out—mentioned several times above and below)

In a 2D structure, each cell can be characterized by different values of its lump elements Zx(nx,ny), Zy(nx,ny, and Y(nx,ny) and all terminations Ztx(1,ny), Ztx(Nx,ny), Zt(nx, 1), and Zt(nx,Ny) and feeds are inhomogeneous. Although, such a structure may have unique properties suitable for some applications, its analysis is complex and implementations are far less practical than a more symmetric structure. This is of course in addition to exploring bandwidth expansion around resonance frequencies. Examples for 2D structures in this application are for CRLH MTM unit cells with equal Zx, Zy, and Y along x-direction, y-direction, and through shunts respectively. Structures with different values of CR can also be used in various applications.

In a 2D structure, the structure can be terminated by any impedances Ztx and Zty that optimize impedance matching along the input and output ports. For simplicity, infinite impedances Ztx and Zty are used in simulations and correspond to infinite substrate/ground-plane along these terminated edges.

2D structures with non-infinite values of Ztx and Zty can be analyzed using the same analysis approach described in this application and may use alternative matching constraints. An example of such non-infinite termination is manipulating surface currents to contain electromagnetic (EM) waves within the 2D structure to allow for another adjacent 2D structure without causing any interference. Interestingly, when the input feed is placed at an offset location from the center of the one of the edge cell along the x or y direction. This translates in the EM wave propagating asymmetrically in both x and y directions even though the feed is along only one of these directions. In a 2D structure with Nx=1 and Ny=2, the input can be along the (1,1) cell and the output can be along the (2,1) cell. The transmission [A B C D] matrix can be solved to compute the scattering coefficient S11 and S12. Similar calculations are made for truncated GND, mixed RH/LH TE modes, and perfect H instead of E field GND. Both 1D and 2D designs are printed on both sides of the substrate (2 layers) with vias in between, or on multilayer structure with additional metallization layers sandwiched between the top and bottom metallization layer.

Figure 5:
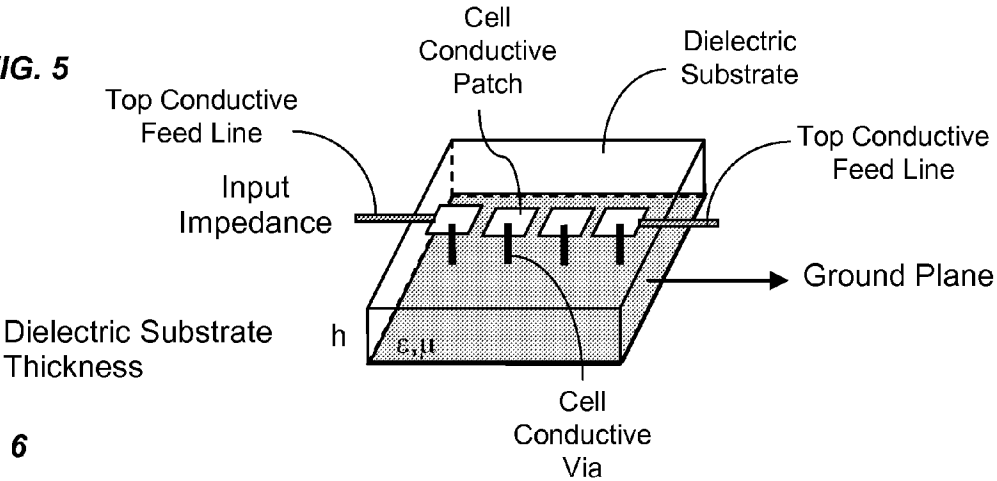
FIG. 5 shows an example of a CRLH MTM transmission line with four unit cells.
Figure 6:
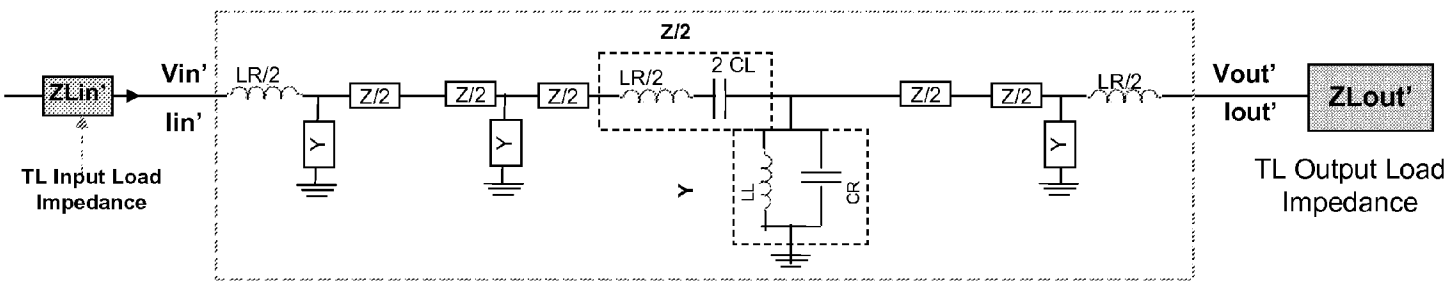
FIGS. 6, 7A, 7B, 8, 9A and 9B show equivalents circuits of the device in FIG. 5 under different conditions in either transmission line mode and antenna mode.

1D CRLH MTM TL and Antenna with Broadband (BB), Multi-Band (MB), and Ultra Wideband (UWB) Resonances FIG. 5 provides an example of a 1D CRLH material TL based on four unit cells. The four patches are placed above a dielectric substrate with centered vias connected to the ground. FIG. 6 shows an equivalent network circuit analogy of the device in FIG. 11. The ZLin' and ZLout' corresponding the input and output load impedances respectively and are due to the TL couplings at each end. This is an example of a printed 2-layer structure. Referring to FIGS. 2A-2C, the correspondences between FIG. 5 and FIG. 6 are illustrated, where in (1) the RH series inductance and shunt capacitor are due to the dielectric being sandwiched between the patch and the ground plane. In (2) the series LH capacitance is due to the presence of two adjacent patches, and the via induces the shunt LH inductance.

The individual internal cell has two resonances $\omega_{SE}$ and $\omega_{SH}$ corresponding to the series impedance Z and shunt admittance Y. Their values are given by the following relation:

$$\omega_{SH} = \frac{1}{\sqrt{LLCR}};\ \omega_{SE} = \frac{1}{\sqrt{LRCL}};\ \omega_R = \frac{1}{\sqrt{LRCR}};\quad \omega_L = \frac{1}{\sqrt{LLCL}} \tag{II-1-2}$$

$$\text{where, } Z = j\omega LR + \frac{1}{j\omega CL} \text{ and } Y = j\omega CR + \frac{1}{j\omega LL}$$

The two input/output edge cells in FIG. 6 do not include part of the CL capacitor since it represents the capacitance between two adjacent MTM cells, which are missing at these input/output ports. The absence of a CL portion at the edge cells prevents $\omega_{SE}$ frequency from resonating. Therefore, only $\omega_{SH}$ appears as an n=0 resonance frequency.

Figure 8:
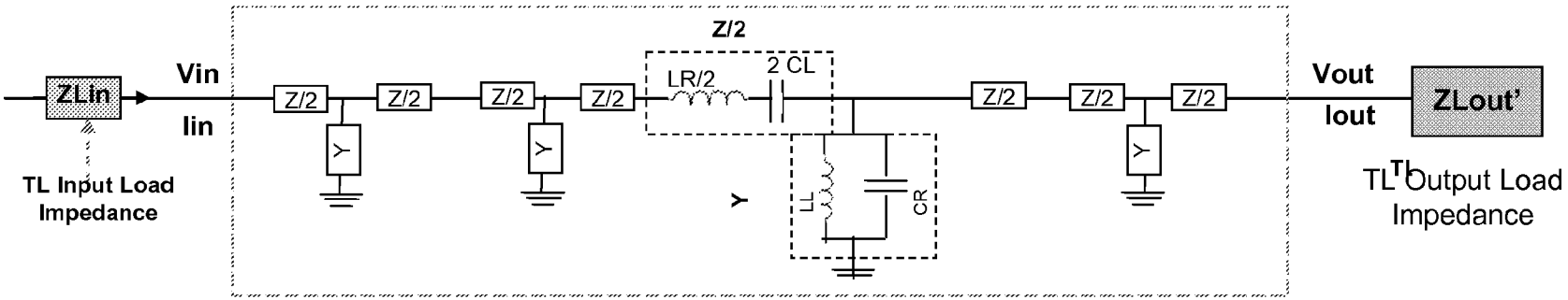

In order to simplify the computational analysis, we include part of the ZLin' and ZLout' series capacitor to compensate for the missing CL portion as seen in FIG. 8 where all N cells have identical parameters.

Figure 7B:
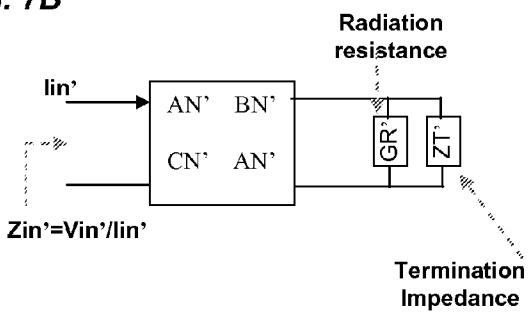
Figure 7A:
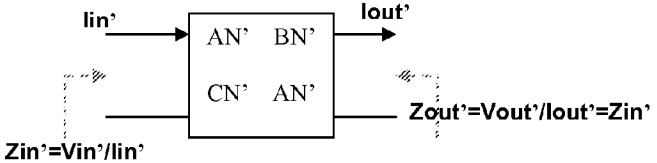
Figure 9A:
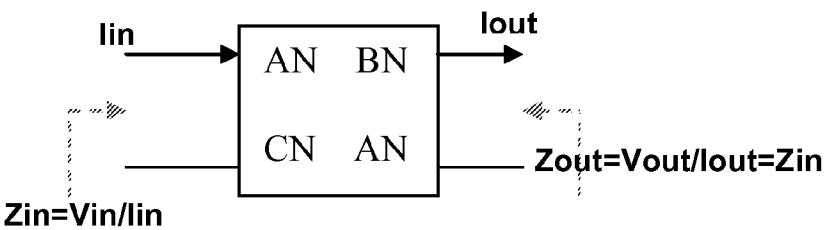
Figure 9B:
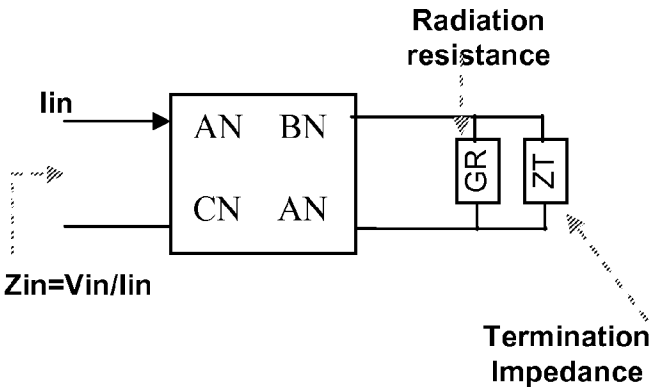

FIG. 7A and FIG. 9A provide the 2-ports network matrix representations for circuits in FIGS. 6 and 8, respectively, without the load impedances. FIGS. 7B and 9B provide the analogous antenna circuits for the circuits in FIGS. 6 and 8 when the TL design is used as an antenna. In matrix notations similar to Eq II-1-1, FIG. 9A represents the following relation:

$$\begin{pmatrix} Vin \\ Iin \end{pmatrix} = \begin{pmatrix} AN & BN \\ CN & AN \end{pmatrix} \begin{pmatrix} Vout \\ Iout \end{pmatrix} \tag{II-1-3}$$

A condition of AN=DN is set because the CRLH circuit in FIG. 8 is symmetric when viewed from Vin and Vout ends. The parameter GR is the structure corresponding radiation resistance and ZT is the termination impedance. The termination impedance ZT is basically the desired termination of the structure in FIG. 7A with an additional 2CL series capacitor. The same goes for ZLin' and ZLout', in other terms:

$$ZLin' = ZLin + \frac{2}{j\omega CL},\ ZLout' = ZLin + \frac{2}{j\omega CL},\quad ZT' = ZT + \frac{2}{j\omega CL} \tag{II-1-4}$$

Because the parameter GR is derived by either building the antenna or simulating it with HFSS, it is difficult to work with the antenna structure to optimize the design. Hence, it is preferable to adopt the TL approach and then simulate its corresponding antennas with various terminations ZT. Eq II-1-2 notation also holds for the circuit in FIG. 6 with the modified values AN', BN', and CN' which reflect the mission CL portion at the two edge cells.

Frequency Bands in 1D CRLH MTM Structures

The frequency bands are determined from the dispersion equation derived by letting the N CRLH cell structure resonates with nπ propagation phase length, where n=0, ±1, ±2, . . . ±N. Each of the N CRLH cells is represented by Z and Y in Eq II-1-2, which is different from the structure shown in FIG. 6, where CL is missing from end cells. Hence, one might expect that the resonances associated with these two structures are different. However, extensive calculations show that all resonances are the same except for n=0, where both $\omega_{SE}$ and $\omega_{SH}$ resonate in the first structure and only $\omega_{SH}$ resonates in the second one (FIG. 6). The positive phase offsets (n>0) corresponds to RH region resonances and the negative values (n<0) are associated with LH region.

The dispersion relation of N identical cells with the Z and Y parameters, which are defined in Eq II-1-2, is given by the following relation:

$$\begin{cases} N\beta p = \cos^{-1}(A_N), \Rightarrow |A_N| \le 1 \Rightarrow 0 \le \chi = -ZY \le 4\forall^5\ N \\ \text{where } A_N = 1 \text{ at even resonances } |n| = 2m \in \left\{0, 2, 4, \ldots 2 \times \mathrm{Int}\left(\frac{N-1}{2}\right)\right\} \\ \text{and } A_N = -1 \text{ at odd resonances } |n| = 2m+1 \in \left\{1, 3, \ldots \left(\mathrm{Int}\left(\frac{N}{2}\right) - 1\right)\right\} \end{cases} \tag{II-1-5}$$

where, Z and Y are given by Eq II-1-2 and AN is derived from either the linear cascade of N identical CRLH circuit or the one shown in FIG. 8 and p is the cell size. The Odd number n=(2m+1) and even number n=2m resonances are associated with AN=−1 and AN=1, respectively. For AN' in FIGS. 6 and 7A and due to the absence of CL at the end cells, the n=0 mode resonates at ($\omega_0=\omega_{SH}$ only and does not resonate at both $\omega_{SE}$ and $\omega_{SH}$ regardless of the number of cells. Higher frequencies are given by the following equation for the different values of $\chi$ specified in Table 1:

$$\text{For } n > \omega_{\pm n}^2 = \frac{\omega_{SH}^2+\omega_{SE}^2+M\omega_R^2}{2} \pm \sqrt{\left(\frac{\omega_{SH}^2+\omega_{SE}^2+M\omega_R^2}{2}\right)^2-\omega_{SH}^2\omega_{SE}^2} \quad \text{(II-1-6)}$$

Table 1 provides $\chi$ values for N=1, 2, 3, and 4. Interestingly, the higher resonances |n|>0 are same regardless if the full CL is present at the edge cells (FIG. 8) or absent (FIG. 6). Furthermore, resonances close to n=0 have small $\chi$ values (near $\chi$ lower bound 0), whereas higher resonances tend to reach $\chi$ upper bound 4 as stated in Eq II-1-5.

TABLE1

Resonances for N = 1, 2, 3 and 4 cells.

| | N | | | |
|---|---|---|---|---|
| Modes | \|n\| = 0 | \|n\| = 1 | \|n\| = 2 | \|n\| = 3 |
| N = 1 | $\chi_{(1,0)}=0;\ \omega_0=\omega_{SH}$ | | | |
| N = 2 | $\chi_{(2,0)}=0;\ \omega_0=\omega_{SH}$ | $\chi_{(2,1)}=2$ | | |
| N = 3 | $\chi_{(3,0)}=0;\ \omega_0=\omega_{SH}$ | $\chi_{(3,1)}=1$ | $\chi_{(3,2)}=3$ | |
| N = 4 | $\chi_{(4,0)}=0;\ \omega_0=\omega_{SH}$ | $\chi_{(4,1)}=2-\sqrt{2}$ | $\chi_{(4,2)}=2$ | |

Figure 12:
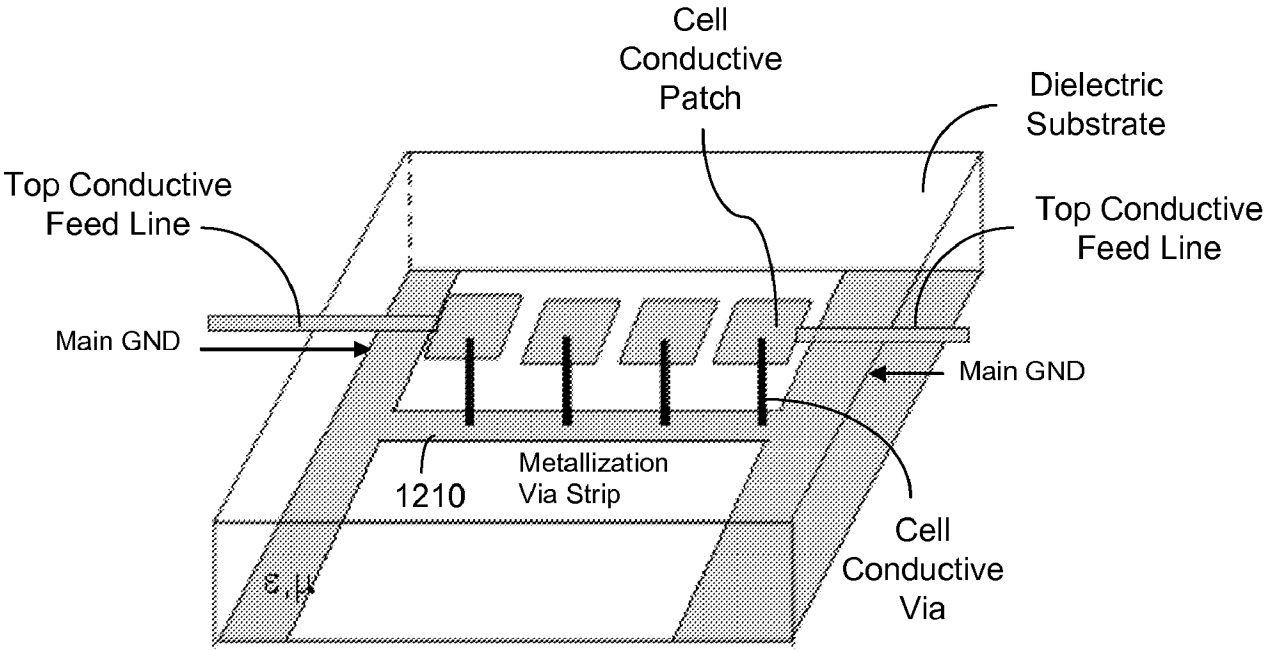
FIGS. 12 and 13 show an example of a CRLH MTM device with a truncated ground conductive layer design and its equivalent circuit, respectively.

An illustration of the dispersion curve β as a function of omega is provided in FIG. 12 for both the $\omega_{SE}=\omega_{SH}$ balanced (FIG. 10) and $\omega_{SE}\neq\omega_{SH}$ unbalanced (FIG. 1) cases. In the latter case, there is a frequency gap between min ($\omega_{SE}$,$\omega_{SH}$) and max ($\omega_{SE}$,$\omega_{SH}$). The limiting frequencies $\omega_{min}$ and $\omega_{max}$ values are given by the same resonance equations in Eq II-1-6 with $\chi$ reaching its upper bound $\chi$=4 as stated in the following equations:

$$\omega_{\min}^2 = \frac{\omega_{SH}^2+\omega_{SE}^2+4\omega_R^2}{2} - \sqrt{\left(\frac{\omega_{SH}^2+\omega_{SE}^2+4\omega_R^2}{2}\right)^2-\omega_{SH}^2\omega_{SE}^2} \quad \text{(II-1-7)}$$

$$\omega_{\max}^2 = \frac{\omega_{SH}^2+\omega_{SE}^2+4\omega_R^2}{2} - \sqrt{\left(\frac{\omega_{SH}^2+\omega_{SE}^2+4\omega_R^2}{2}\right)^2-\omega_{SH}^2\omega_{SE}^2}$$

Figure 11:
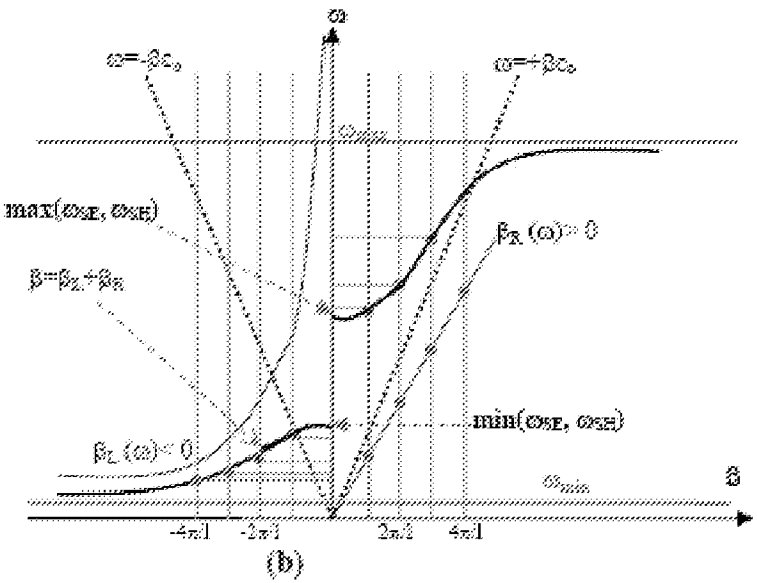
FIGS. 10 and 11 show examples of the resonance position along the beta curves in the device in FIG. 5.
Figure 10:
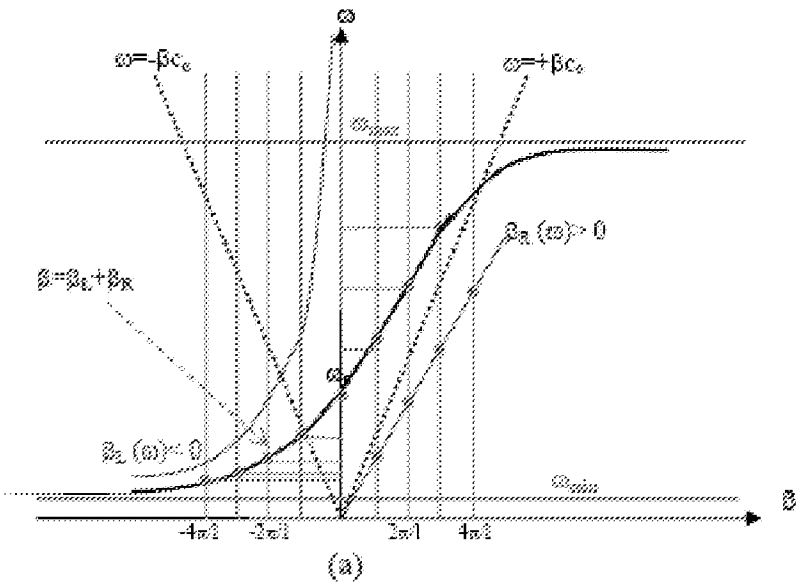

FIGS. 10 and 11 provide examples of the resonance positions along the beta curves. FIG. 10 illustrates the balanced case where LR CL=LL CR, and FIG. 11 shows the unbalanced case with a gap between LH and RH regions. In the RH region (n>0) the structure size 1=Np, where p is the cell size, increases with decreasing frequencies. Compared to the LH region, lower frequencies are reached with smaller values of Np, hence size reduction. The β curves provide some indication of the bandwidth around these resonances. For instance, it is clear that LH resonances suffer from narrow bandwidth because the β curve is almost flat in the LH regime. In the RH region bandwidth should be higher because the β curves are steeper, or in other terms:

$$COND1: 1^{St}BB \text{ condition} \left|\frac{d\beta}{d\omega}\right|_{res} = \left|-\frac{\frac{d(AN)}{d\omega}}{\sqrt{(1-AN^2)}}\right|_{res} << 1 \text{ near } \omega = \omega_{res} = \omega_0, \omega_{\pm 1}, \quad \text{(II-1-8)}$$

$$\omega_{\pm 2}\ldots \Rightarrow \left|\frac{d\beta}{d\omega}\right| = \left|-\frac{\frac{d\chi}{d\omega}}{2p\sqrt{\chi\left(1-\frac{\chi}{4}\right)}}\right|_{res} << 1 \text{ with } p = \text{cell size and } \left.\frac{d\chi}{d\omega}\right|_{res} = \frac{2\omega_{\pm n}}{\omega_R^2}\left(1-\frac{\omega_{SE}^2\omega_{SH}^2}{\omega_{\pm n}^4}\right)$$

where, $\chi$ is given in Eq II-1-5 and $\omega_R$ is defined in Eq II-1-2. From the dispersion relation in Eq II-1-5 resonances occur when |AN|=1, which leads to a zero denominator in the $1^{st}$ BB condition (COND1) of Eq II-1-8. As a reminder, AN is the first transmission matrix entry of the N identical cells (FIGS. 8 and 9A). The calculation shows that COND1 is indeed independent of N and given by the second equation in Eq II-1-8. It is the values of the numerator and $\chi$ at resonances, which are defined in Table 1, that define the slope of the dispersion curves, and hence possible bandwidth. Targeted structures are at most Np=λ/40 in size with BW exceeding 4%. For structures with small cell sizes p, Eq II-1-8 clearly indicates that high $\omega_R$ values satisfy COND1, i.e. low CR and LR values since for n<0 resonances happens at $\chi$ values near 4 Table 1, in other terms ($1-\chi X/4\rightarrow 0$).

Impedance Matching in 1D CRLH MTM Transmission Lines and Antennas

As previously indicated, once the dispersion curve slopes have steep values, then the next step is to identify suitable matching. Ideal matching impedances have fixed values and do not require large matching network footprints. Here, the term "matching impedance" refers to feed lines and termination in case of a single side feed such as antennas. In order to analyze input/output matching network, Zin and Zout need to be computed for the TL circuit in FIG. 9A. Since the network in FIG. 8 is symmetric, the following condition is satisfied: Zin=Zout. In addition, Zin is independent of N as indicated in the equation below:

$$Zin^2 = \frac{BN}{CN} = \frac{B1}{C1} = \frac{Z}{Y}\left(1-\frac{\chi}{4}\right), \quad \text{(II-1-9)}$$

which has only positive real values

The reason that B1/C1 is greater than zero is due to the condition of |AN|≦1 in Eq II-1-5 which leads to the following impedance condition:

$$0 \leqq -ZY = \chi \leqq 4.$$

The $2^{ed}$ BB condition is for Zin to slightly vary with frequency near resonances in order to maintain constant matching. Remember that the real matching Zin' includes a portion of the CL series capacitance as stated in Eq II-1-4.

$$COND2: 2^{ed}\ BB \text{ condition: near resonances,} \quad \text{(II-1-10)}$$

$$\left.\frac{dZin}{d\omega}\right|_{near\ res} << 1$$

Unlike the TL example in FIG. 5 and FIG. 7A, antenna designs have an open-ended side with an infinite impedance which typically poorly matches structure edge impedance. The capacitance termination is given by the equation below:

$$Z_T = \frac{AN}{CN} \text{ which depends on } N \text{ and is purely imaginary} \quad \text{(II-1-11)}$$

Since LH resonances are typically narrower than the RH ones, selected matching values are closer to the ones derived in the n<0 than the n>0.

The examples of 1-D and 2-D CRLH MTM antennas in this application illustrate several techniques for impedance matching. For example, the coupling between the feed line and a unit cell can be controlled to assist impedance matching by properly selecting the size and shape of the terminal end of the feed line, the size and shape of the launch pad formed between the feed line and the unit cell. The dimension of the launch pad and the gap of the launch pad from the unit cell are can be configured to provide a impedance matching so that a target resonant frequency can be excited in the antenna. For another example, a termination capacitor can be formed at the distal end of an MTM antenna can be used to assist the impedance matching. The above two exemplary techniques may also be combined to provide proper impedance matching. In addition, other suitable RF impedance matching techniques may be used to achieve desired impedance matching for one or more target resonant frequencies.

CRLH MTM Antennas with Truncated Ground Electrode

In a CRLH MTM structure, the shunt capacitor CR can be reduced to increase the bandwidth of LH resonances. This reduction leads to higher $\omega_R$ values of steeper beta curves as explained in Eq. II-1-8. There are various ways to decrease CR, including: 1) increasing the substrate thickness, 2) reducing the top cell patch area, or 3) reducing the ground electrode under the top cell patch. In designing CRLH MTM devices, one of these three methods may be used or combined with one or two other methods to produce a MTM structure with desired properties.

Figure 14:
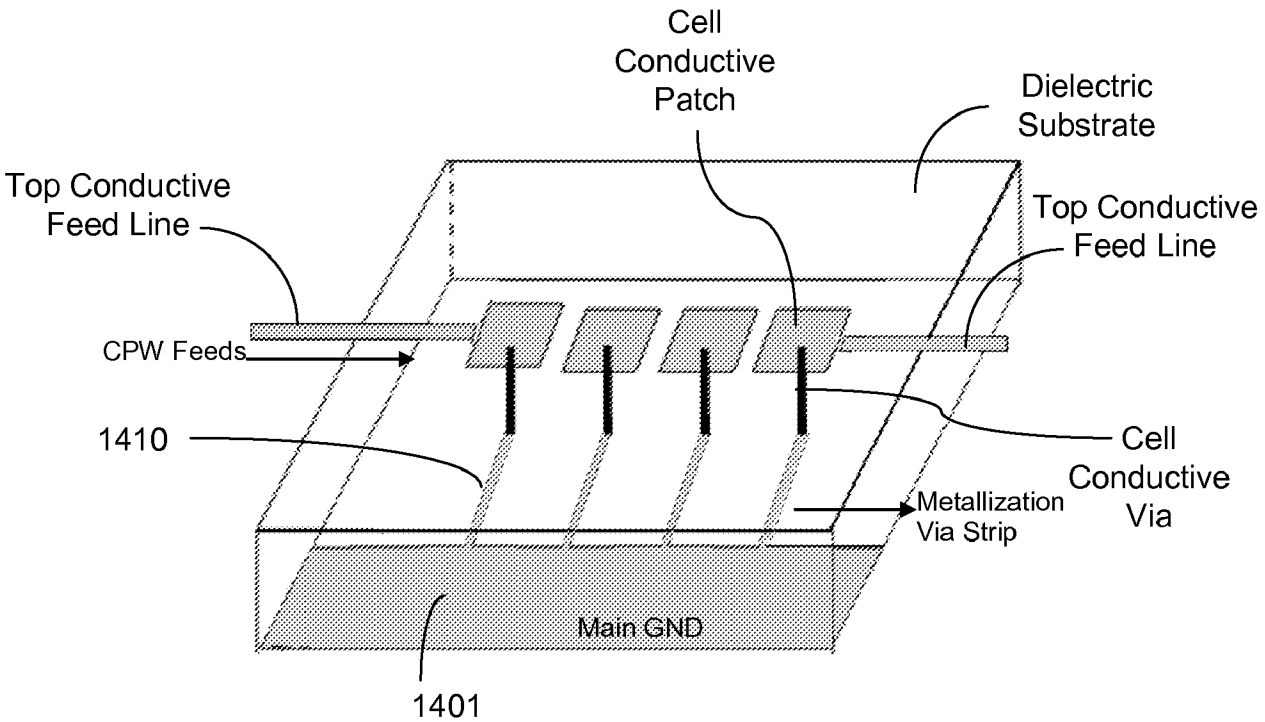
FIGS. 14 and 15 show another example of a CRLH MTM device with a truncated ground conductive layer design and its equivalent circuit, respectively.

The designs in FIGS. 2, 3 and 5 use a conductor layer to cover the entire surface of the substrate for the MTM device as the full ground electrode. A truncated ground electrode that has patterned to expose one or more portions of the substrate surface can be used to reduce the size of the ground electrode to be less than the full substrate surface to increase the resonant bandwidth and to tune the resonance frequency. The truncated ground electrode designs in FIGS. 12 and 14 are two examples where the amount of the ground electrode in the area in the foot print of a MTM cell on the ground electrode side of the substrate has been reduced and a stripe line is used to connect the cell via of the MTM cell to a main ground electrode outside the foot print of the MTM cell. This truncated ground electrode approach may be implemented in various configurations to achieve broadband resonances.

For example, a CRLH MTM resonant apparatus can include a dielectric substrate having a first surface on a first side and a second surface on a second side opposing the first side; cell conductive patches formed on the first surface and separated from one another to capacitively couple two adjacent cell conductive patches; cell ground electrodes formed on the second surface and located below the top patches, respectively; a main ground electrode formed on the second surface; conductive via connectors formed in the substrate to connect the conductive patches to respective cell ground electrodes under the conductive patches, respectively; and at least one ground conductor line that connects between each cell ground electrode and the main ground electrode. This apparatus can include a feed line on the first surface and capacitively coupled to one of the cell conductive patches to provide input and output for the apparatus. The apparatus is structured to form a composite right and left handed (CRLH) metamaterial structure. In one implementation, the cell ground electrode is equal to or bigger than the via cross section area and is located just below the via to connect it to the main GND through the GND line. In another implementation, the cell ground electrode is equal to or bigger than the cell conductive patch.

Figure 13:
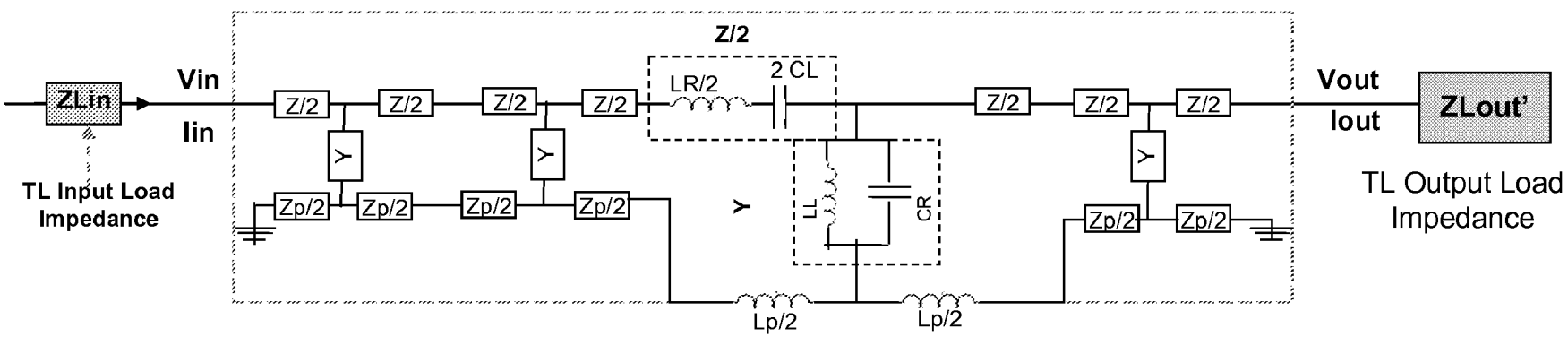

FIG. 12 illustrates one example of a truncated GND where the GND has a dimension less than the top patch along one direction underneath the top cell patch. The ground conductive layer includes a strip line 1210 that is connected to the conductive via connectors of at least a portion of the unit cells and passes through underneath the conductive patches of the portion of the unit cells. The strip line 1210 has a width less than a dimension of the conductive patch of each unit cell. The use of truncated GND can be more practical than other methods to implement in commercial devices where the substrate thickness is small and the top patch area cannot be reduced because of lower antenna efficiency. When the bottom GND is truncated, another inductor Lp (FIG. 13) appears from the metallization strip that connects the vias to the main GND as illustrated in FIG. 14A.

Figure 15:
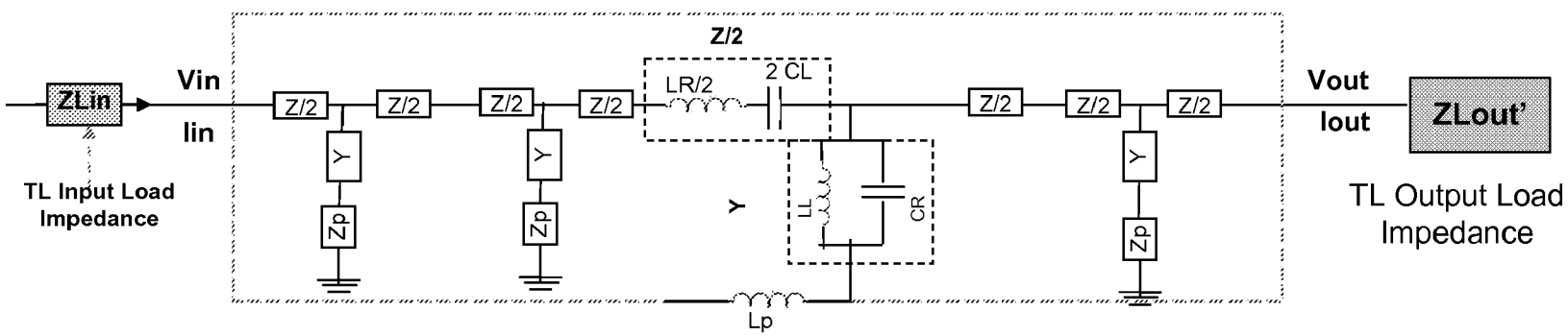

FIGS. 14 and 15 show another example of a truncated GND design. In this example, the ground conductive layer includes a common ground conductive area 1401 and strip lines 1410 that are connected to the common ground conductive area 1401 at first distal ends of the strip lines 1410 and having second distal ends of the strip lines 1410 connected to conductive via connectors of at least a portion of the unit cells underneath the conductive patches of the portion o the unit cells. The strip line has a width less than a dimension of the conductive patch of each unit cell.

The equations for truncated GND can be derived. The resonances follow the same equation as in Eq II-1-6 and Table 1 as explained below:

Approach 1 (FIGS. 12 and 13):
Resonances: same as in Eq II-1-2, 6, 7 and Table one after replacing LR by LR + Lp
CR becomes very small
Furthermore, for $|n| \neq 0$ each mode has two resoances corresponding to
1) $\omega_{\pm n}$ for LR → LR + LP
2) $\omega_{\pm n}'$ for LR → LR + LP/N, where N is the number of cells (II-1-12)
The impedance equation becomes:

$$Zin^2 = \frac{BN}{CN} = \frac{B1}{C1} = \frac{Z}{Y}\left(1 - \frac{\chi + \chi_P}{4}\right)\frac{(1 - \chi - \chi_P)}{(1 - \chi - \chi_P/N)},$$

where $\chi = -YZ$ and $\chi = -YZ_P$,
$Z_P = j\omega L_P$, and Z, Y are defined in Eq II-1-3

The impedance equation in Eq II-1-12 shows that the two resonances ω and ω' have low impedance and high impedance respectively. Hence, it is easier to tune near the ω resonance.

| | |
|---|---|
| Approach 2 (FIGS. 14 and 15): | |
| Resonances: same as in Eq II-1-2, 6, 7 and Table one after replacing LL by LL + Lp | |
| CR becomes very small | (II-1-13) |

In the second approach case, the combined shunt induction (LL+Lp) increases while the shunt capacitor decreases which leads to lower LH frequencies.

In some implementations, antennas based on CRLH MTM structures can include a 50-Ω co-planar waveguide (CPW) feed line on the top layer, a top ground (GND) around the CPW feed line in the top layer, a launch pad in the top layer, and one or more cells. Each cell can include a top metallization cell patch in the top layer, a conductive via connecting top and bottom layers, and a narrow strip connecting the via to the main bottom GND in the bottom layers. Some characteristics of such antennas can be simulated using HFSS EM simulation software.

Various features and designs of CRLH MTM structures are described in U.S. patent application Ser. No. 11/741,674 entitled "ANTENNAS, DEVICES AND SYSTEMS BASED ON METAMATERIAL STRUCTURES" and filed on Apr. 27, 2007. The disclosure of the U.S. patent application Ser. No. 11/741,674 is incorporated by reference as part of the specification of this application.

Figure 16:
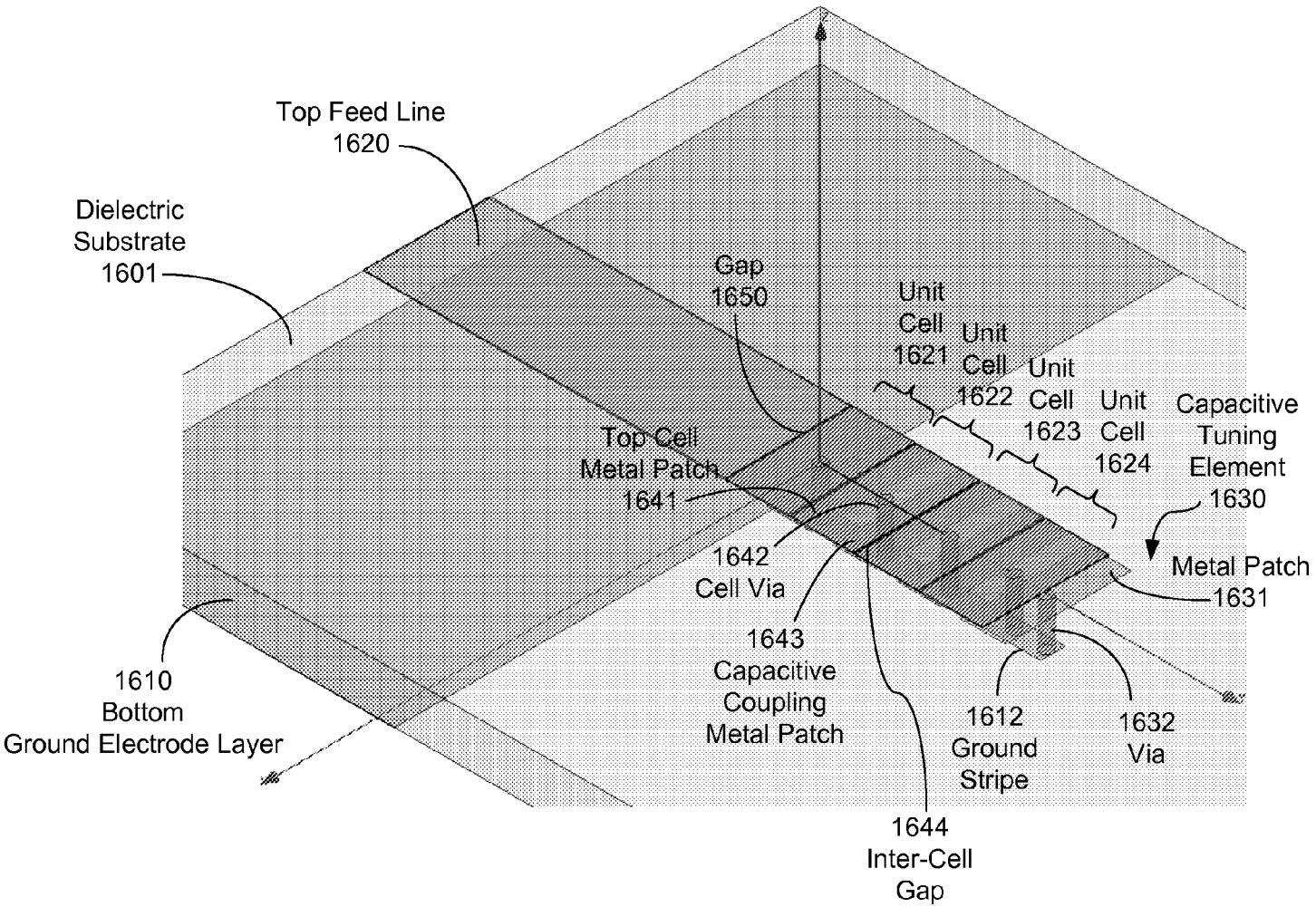

FIG. 16 shows an example of an 1-D array of four CRLH MTM cells having a tunable end capacitor. Four CRLH MTM cells 1621, 1622, 1623 and 1624 are formed on a dielectric substrate 1601 along a linear direction (y direction) and are separated from each other by a gap 1644. The CRLH MTM cells 1621, 1622, 1623 and 1624 are capacitively coupled to form an antenna. At one end of the cell array, a conductive feed line 1620 with a width substantially equal to the width of each cell along the x direction is formed on the top surface of the substrate 1601 and is separated from the first cell 1621 along the y direction by a gap 1650. The feed line 1620 is capacitively coupled to the cell 1621. On the other end of the array, a capacitive tuning element 1630 is formed in the substrate 1601 to include a metal patch 1631 and is capacitively coupled to the cell 1624 to electrically terminate the array. A bottom ground electrode 1610 is formed on the bottom surface of the substrate 1601 and is patterned to include a main ground electrode area that does not overlap with cells 1621-1624 and a ground stripe line 1612 that is elongated along and parallel to the y direction to spatially overlap with the footprint of the linear array of the cells 1621-1624 and the metal patch 1631 of the capacitive tuning element 1631. The width of the ground stripe line 1612 along the x direction is less than the width of the unit cells and thus the ground electrode is a truncated ground electrode and is less than the footprint of each cell. This truncated ground electrode design can increase the bandwidth of LH resonances and to reduce the shunt capacitor CR. As a result, a higher resonant frequency $\omega_R$ can be achieved.

Figures 17A, 17B, 17C, 17D:
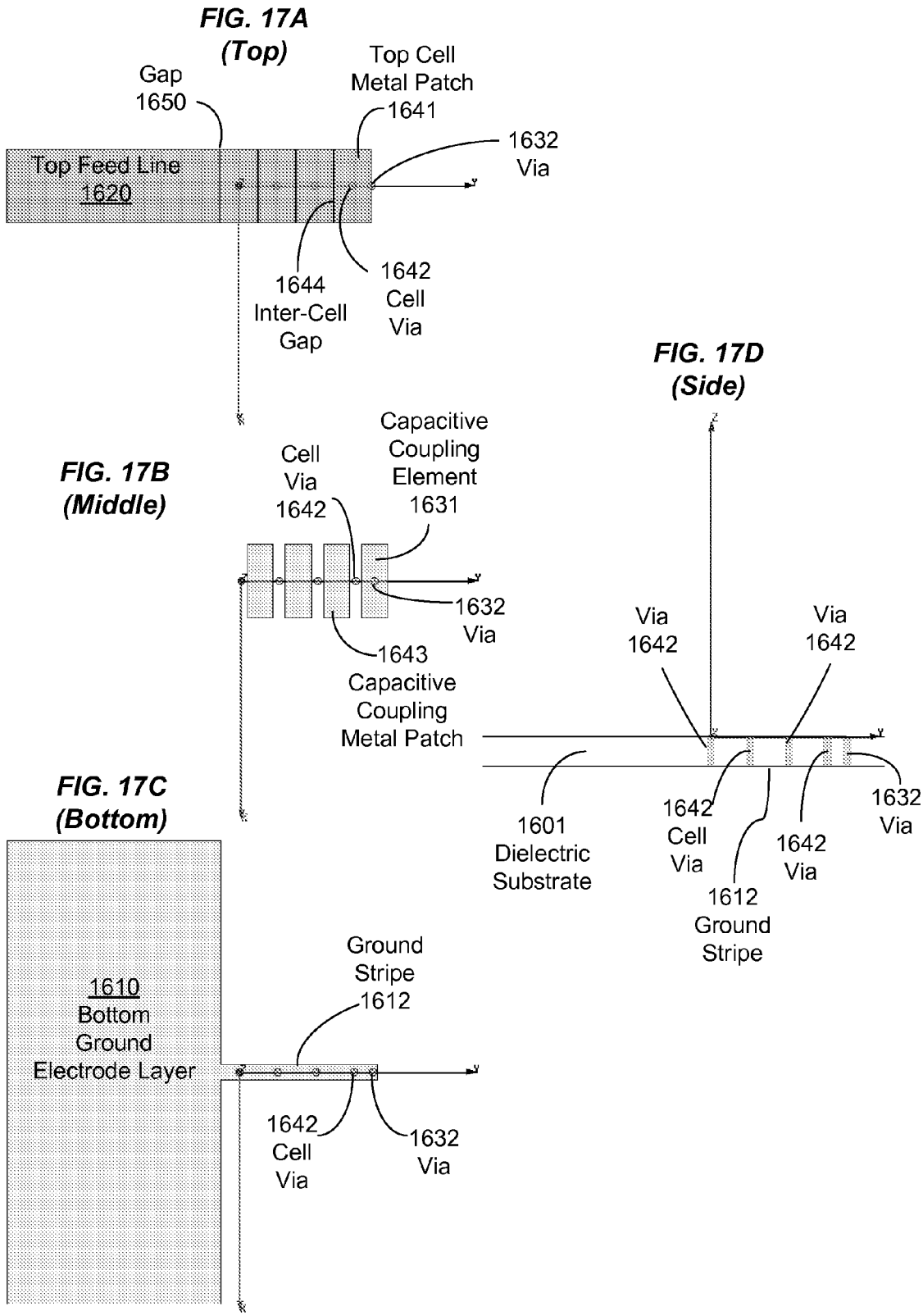

FIGS. 17A, 17B, 17C and 17D illustrate details of the antenna design in FIG. 16. Each unit cell includes three metal layers: the common ground stripe line 1612 on the bottom of the substrate 1601, a top cell metal patch 1641 formed on the top of the substrate 1601, and a capacitive coupling metal patch 1643 formed near the top surface of the substrate 1601 and beneath the top cell metal patch 1641. A cell via 1642 is formed at the center of the top cell metal patch 1641 to connect the top cell metal patch 1641 and the ground stripe line 1612. The cell via 1642 is separated from the capacitive coupling element 1630. Referring to FIG. 17B, three capacitive coupling metal patches 1643 form a linear array of metal patches along the y direction and is located below the top cell metal patches 1641 in a metal-insulator-metal (MIM) structure to enhance the capacitive coupling of the left handed capacitance CL between two adjacent unit cells. Notably, each metal patch 1643 is located between two adjacent cells to overlap with the footprint of the inter-cell gap 1644 and is separated from the top cell metal patches 1641 of the two cells to enhance capacitive coupling between the two cells. Adjacent metal patches 1643 are spaced from each other with a gap that is sufficient to allow the cell via 1642 to pass through without being in contact with the cell via 1642.

The capacitive coupling element 1630 includes the metal patch 1631 and the via 1642. The patch 1631 at least partially overlaps with the footprint of the top cell metal patch 1641 of the cell 1624. Different from metal patches 1643 which are not in direct contact with the cell vias 1642, the via 1632 is in direct contact with the metal patch 1631 and connects the metal patch 1631 to the ground stripe line 1612. Therefore, metal patch 1631 and the top cell metal patch of the last cell 1624 forms a capacitor and the strength of the capacitive coupling with the cell 1624 can be controlled by setting a proper spacing between the metal patch 1631 and the top cell metal patch 1643 of the last cell 1624 as part of the design process.

FIG. 17A shows the top metal layer that is patterned to form the top feed line 1620, the top cell metal patches 1621-1624. Gaps 1650 and 1644 separate these metal elements from being in direct contact with one another and allow for capacitive coupling between two adjacent elements. FIG. 17C shows the bottom ground electrode 1610 that is located outside the footprint of the cells 1621-1624 and the ground stripe line 1612 that is connected to the bottom ground electrode 1610. In FIG. 17B, the capacitive coupling metal patches 1643 are shown to be in the same metal layer as the metal patch 1631 of the capacitive tuning element 1630. Alternatively, the metal patch 1631 may be in a different layer from the coupling metal patches 1643.

Therefore, the 1-D antenna in FIG. 16 uses a "mushroom" cell structure to form a distributed CRLH MTM. MIM capacitors formed by the capacitive coupling metal patches 1643 and the top cell metal patches 1641 are used beneath the gaps between the microstrip patches 1641 to achieve high C_L values. The feed line 1620 couples capacitively to the MTM structure via the gap 1650 and the gap 1650 can be adjusted for optimal matching. The capacitive tuning element 1630 is used to fine-tune the antenna resonances to the desired frequencies of operation and achieve a desired bandwidth (BW). The tuning is accomplished by changing the height of that element relative to the microstrip patches, thus achieving stronger or weaker capacitive coupling to GND, which affects resonant frequency and BW.

The dielectric material for the substrate 1601 can be selected from a range of materials, including the material under the trade name "RT/Duroid 5880" from Rogers Corporation. In one implementations, the substrate can have a thickness of 3.14 mm and the overall size of the MTM antenna element can be 8 mm in width, 18 mm in length and 3.14 mm in height as set by the substrate thickness. The top patch 1641 of the unit CRLH cell can be 8mm wide in the x direction and 4 mm long in the y-direction with an inter-cell gap of 0.1 mm between two adjacent cells. The coupling between adjacent cells is enhanced by using MIM patches which can be 8 mm wide and 2.8 mm long positioned equidistant from the centers of the two patches and at a height of 5 mil below. The feed-line is coupled to the antenna with a 0.1 mm gap from the edge of the first unit cell. The termination cell top patch is as wide as the unit CRLH cell and 4 long. The gap between the fourth CRLH cell and termination cell is 5 mil. The vias connecting all top patching with bottom cell-GND are 0.8 mm in diameter and located in the center of the top patches.

Figure 18:
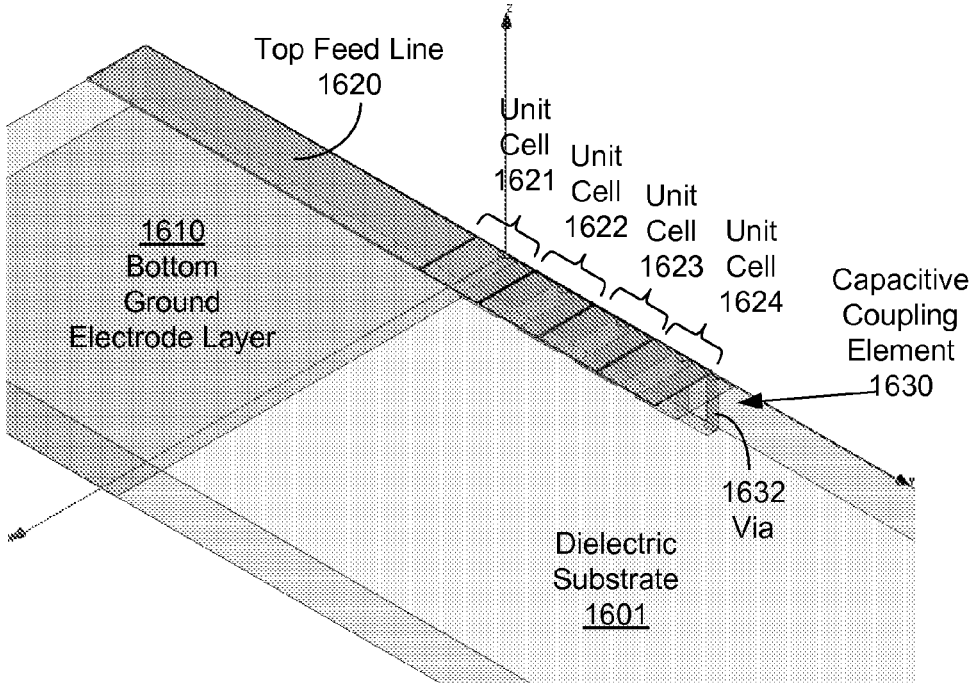

Full-wave HFSS simulations were conducted on the design in FIG. 17 using the above device parameters to characterize the antenna. FIG. 18 illustrates the model of one half of the symmetric device in FIG. 17 for the HFSS simulations and FIGS. 19A-19E show simulation results.

Figure 19A:
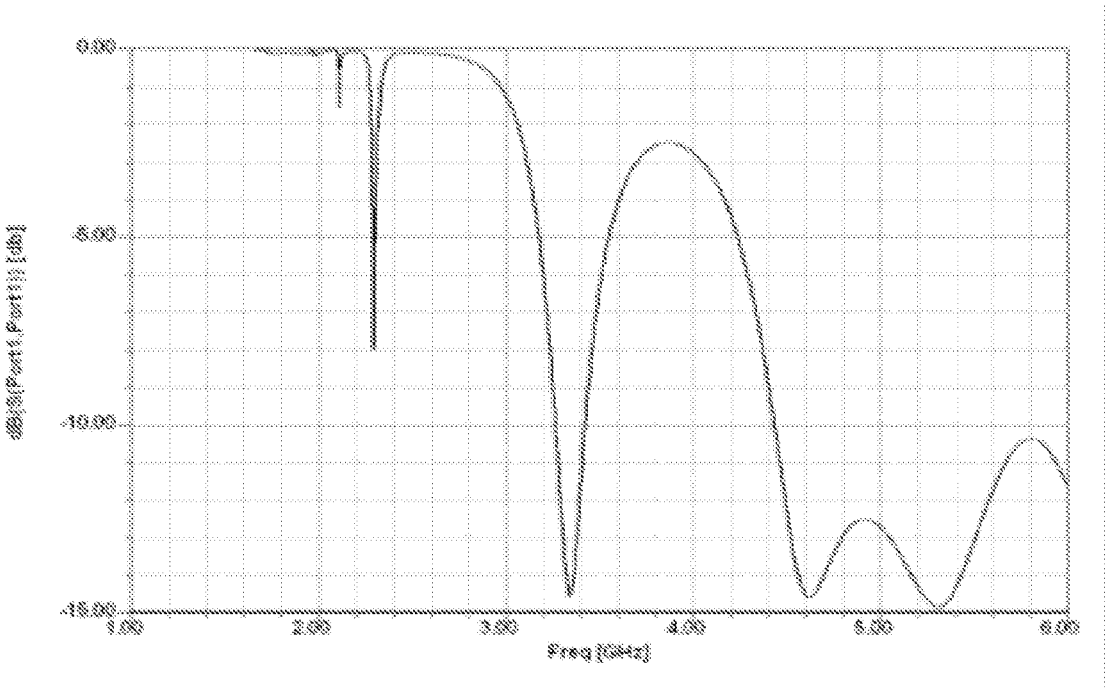

FIG. 19A shows the return loss, S11, of the antenna. The regions with S11 below the −10 dB level are used to measure the BW of the antenna. The S11 spectrum shows two well-defined bands: a first band centered at 3.38 GHz with a BW of 150 MHz (a 4.4% relative BW) and a second band starting at 4.43 GHz and extending beyond 6 GHz with a relative BW greater than 30%.

Figure 19B:
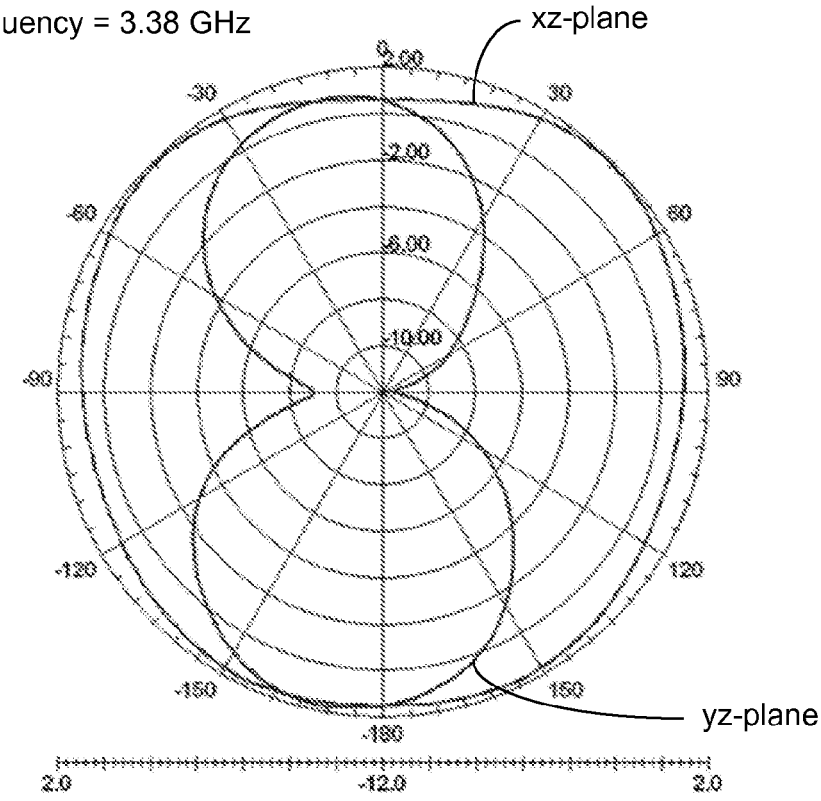
Figure 19C:
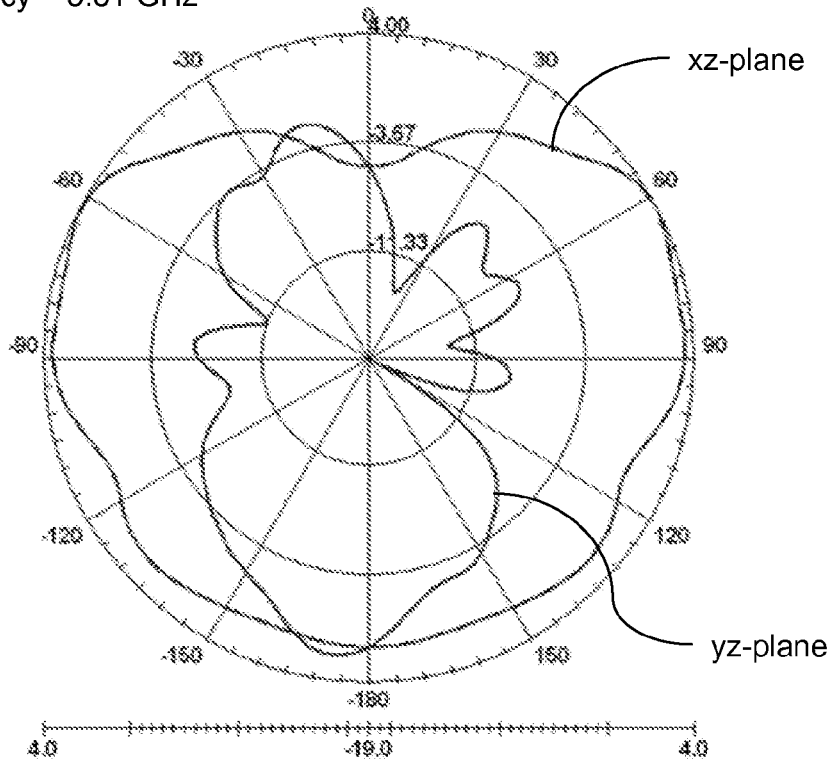

FIGS. 19B and 19C show antenna radiation patterns in the xz plane and the yz plane at 3.38 GHz and 5.31 GHz, respectively. At 3.38 GHz, the antenna exhibits a dipole-like radiation pattern with a maximum gain, G_max, of 2 dBi. At 5.31 GHz, the antenna shows a deformed patch-like pattern with G_max=4 dBi.

Figure 19D:
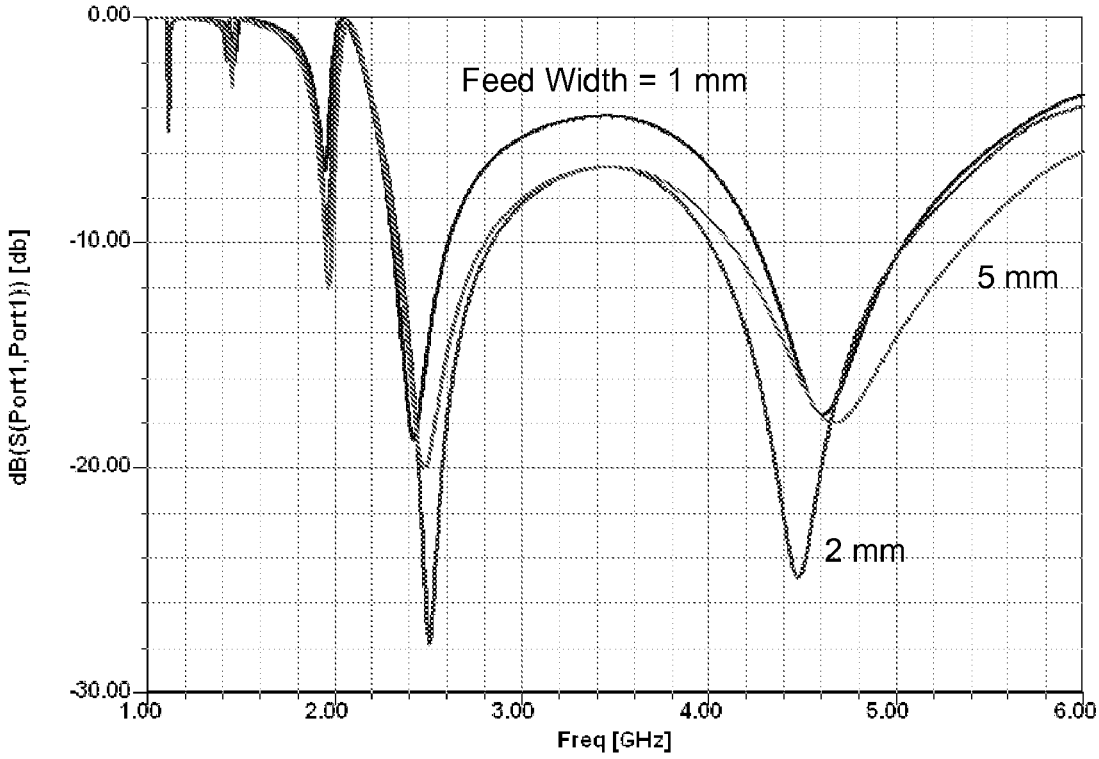
Figure 19E:
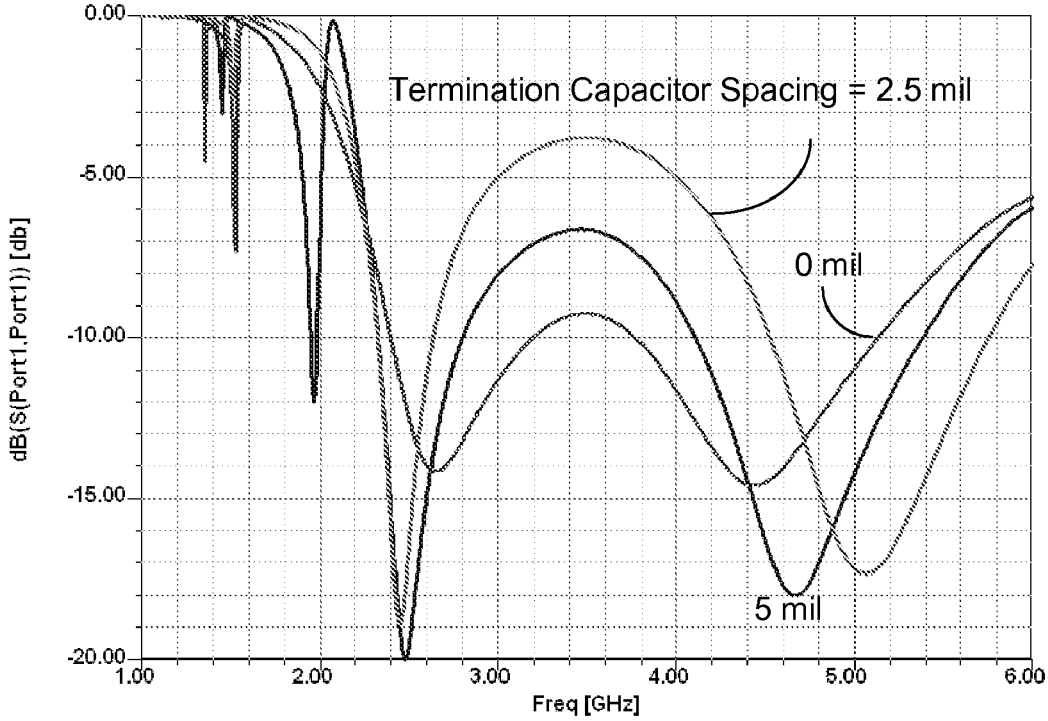

The HFSS simulations were also used to evaluate the effects of matching the feed line to the MTM structure and the effects of the capacitive tuning termination. FIGS. 19D and 19E show plots of the return loss of the antenna as a function of the signal frequency. Such plots can be used to determine the position of the resonances and their bandwidths. FIG. 19D shows the return loss of the antenna obtained by varying the width of the feed line. FIG. 19E shows the return loss of the antenna obtained by varying the height of the termination capacitor (e.g., the spacing between the metal patch 1631 and the top cell metal patch 1641) to tune the antenna. The simulations suggest that tuning either the width or the spacing of the termination capacitor can have a significant effect on the antenna resonances and BW. Therefore, both parameters can be used independently or in combination to tune the resonant frequencies and bandwidths of the antenna during the design phase to achieve desired or optimal performance.

Figure 20:
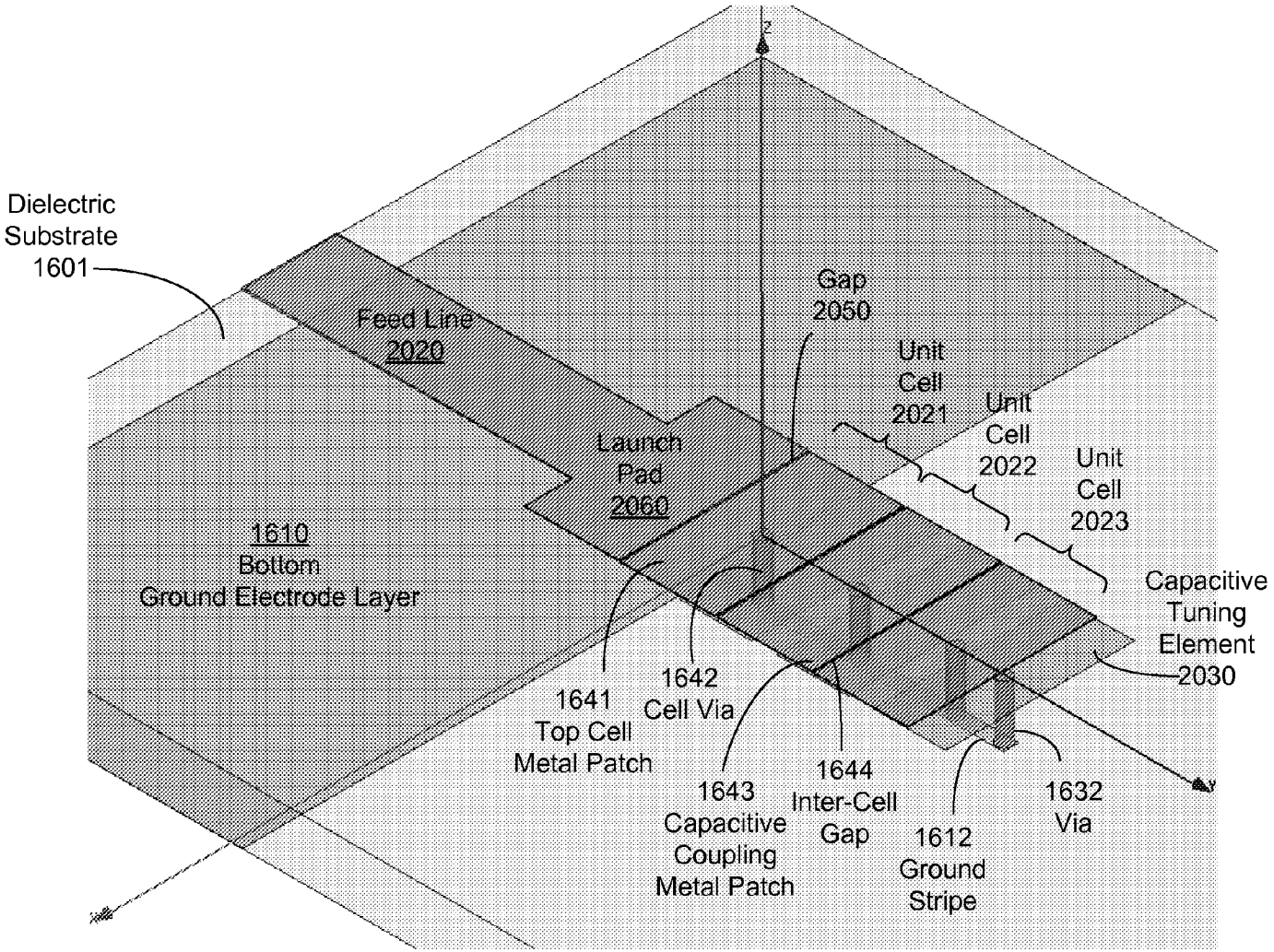
Figures 21B, 21C, 21D:
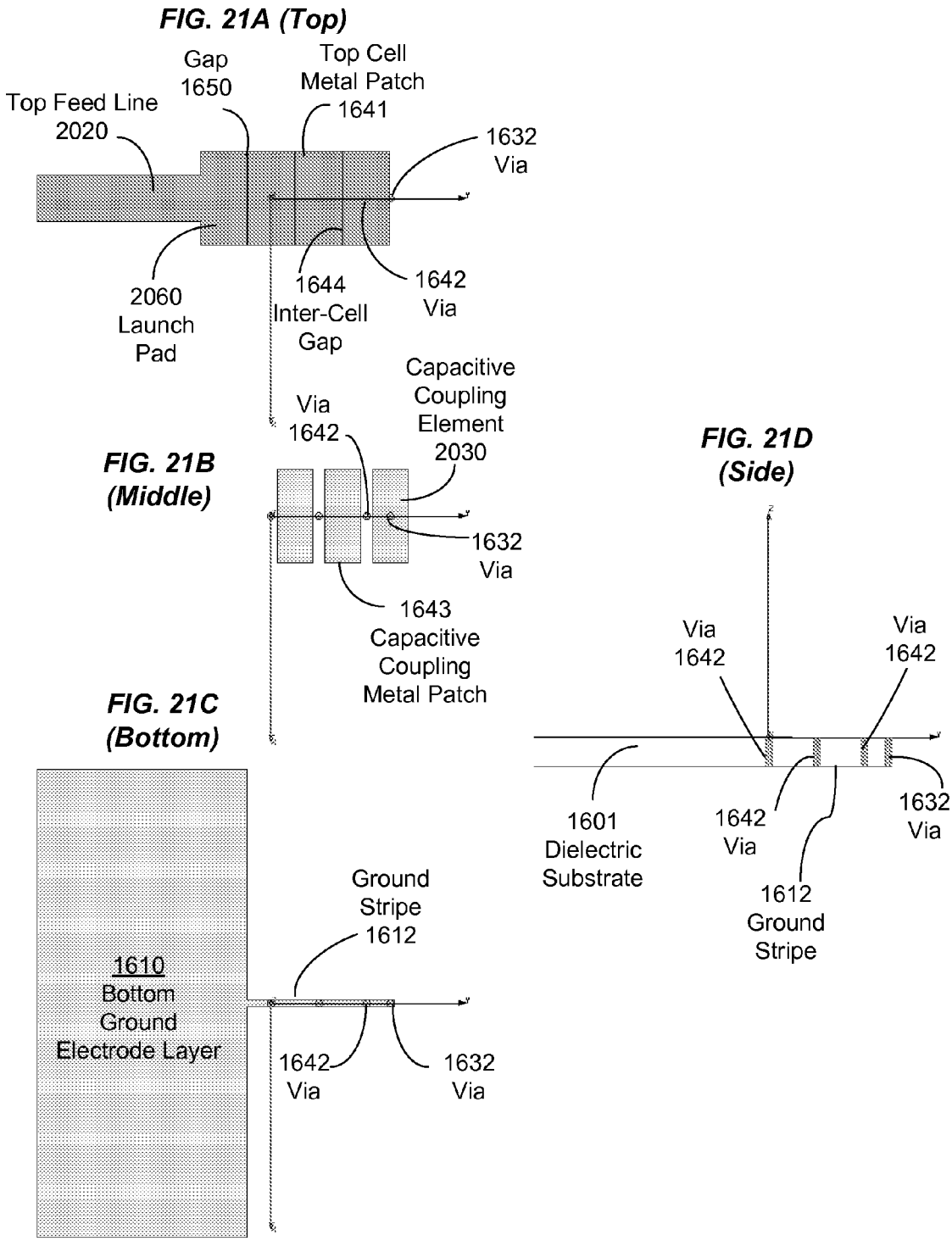

FIGS. 20, and 21A through 21D show an example of a 2-layer, 3-cell antenna with an adjustable feed-line width. Similar to the antenna design in FIG. 16, this antenna also uses a truncated ground electrode design and a termination capacitor design. The 1-D cell array with cells 2021, 2022 and 2023 has a similar design as in FIG. 16 with a different number of cells and different cell dimensions. In FIG. 20, the overall dimensions of the MTM structure is 15 mm×10 mm×3.14 mm. Notably, the feed line design in FIG. 20 uses a feed line 2020 that is narrow in width than that of the cells 2021-2023 and uses a launch pad 2060 that is connected to the feed line 2020 and matches the width of the cells 2021-2023 to optimize the capacitive coupling between the feed line 2020 and the cells 2021-2023. Hence, in addition to adjust the overall width of the cells and the spacing of the termination capacitor 1630, the width of the feed line 2020 can be independent configured to provide flexibility in configuring the antenna resonances and bandwidths.

Figure 22A:
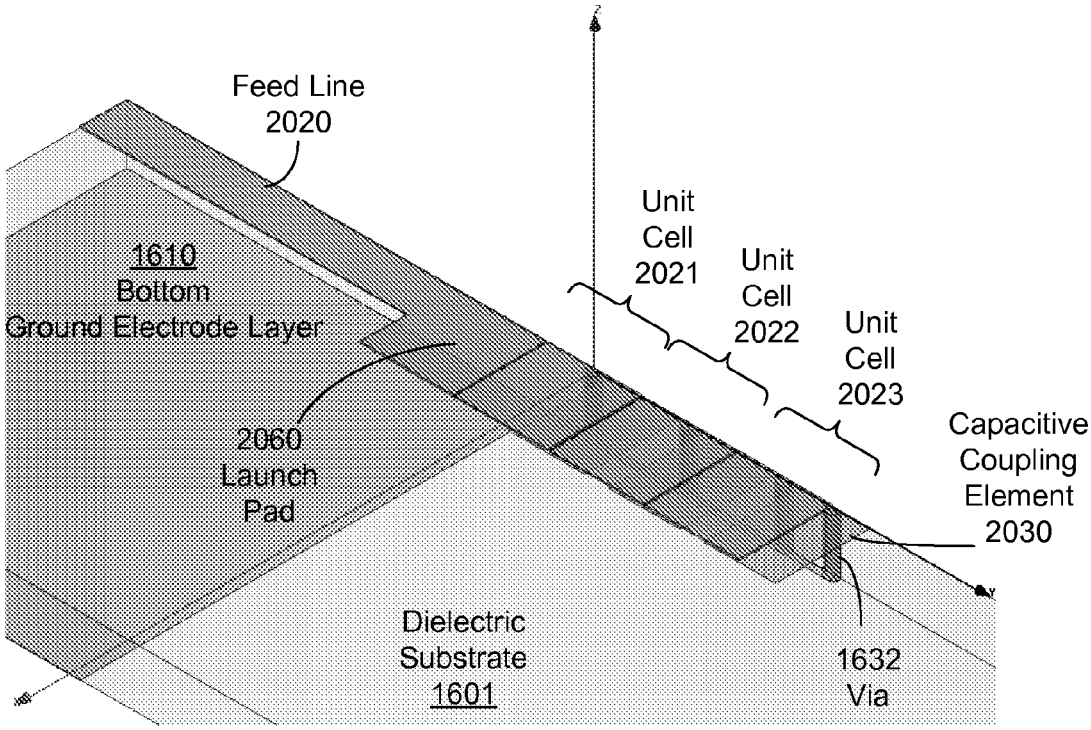

FIG. 22A shows the HFSS simulation model for the reduced ground plane approach for increasing antenna BW in the three-cell 1-D MTM antenna design in FIG. 20. The HFSS model of the design shows only x>0 side of the antenna. The following parameters are used for the model in FIG. 22A in the HFSS simulations. The top patch of the unit CRLH cell is 10 mm wide (x-direction) and 5 mm long (y-direction) with 0.1 mm gap between two adjacent cells. The coupling between adjacent cells is enhanced by using MIM patches which are 10 mm wide and 3.8 mm long positioned equidistant from the centers of the two patches and at a height of 5 mil below. The feed-line is coupled to the antenna with a launch pad that consists of a top 10 mm×5 mm patch with a 0.05-mm gap from the edge of the first unit cell. The vias connecting all top patching with bottom cell-GND are 0.8 mm in diameter and located in the center of the top patches.

Figure 22B:
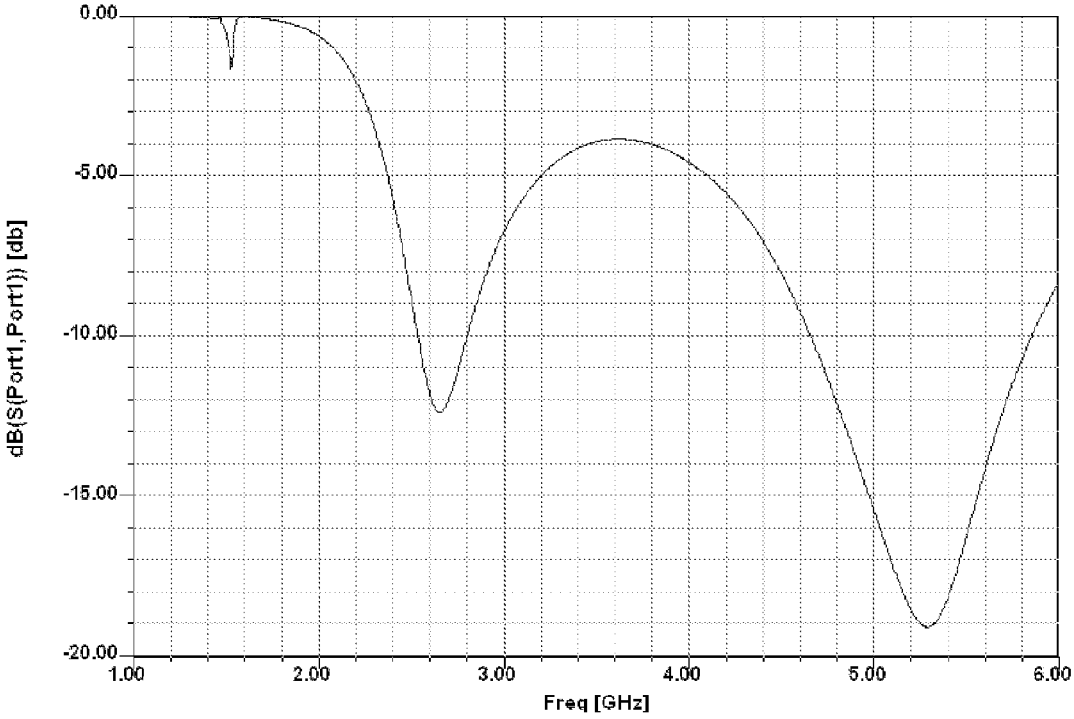
Figure 22C:
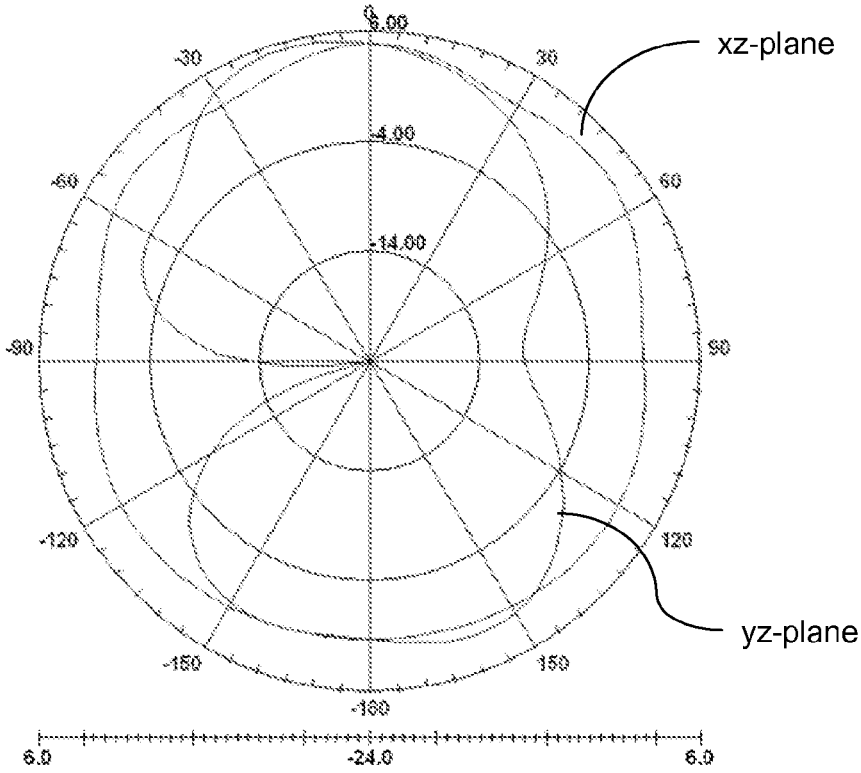
Figure 22D:
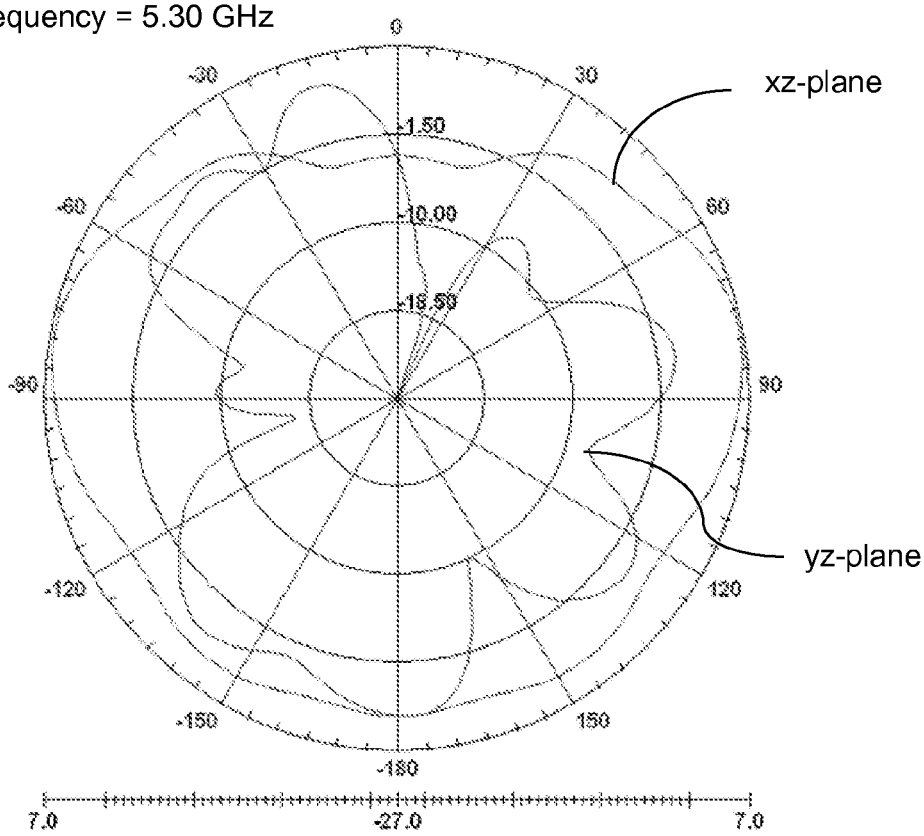
Figure 22E:
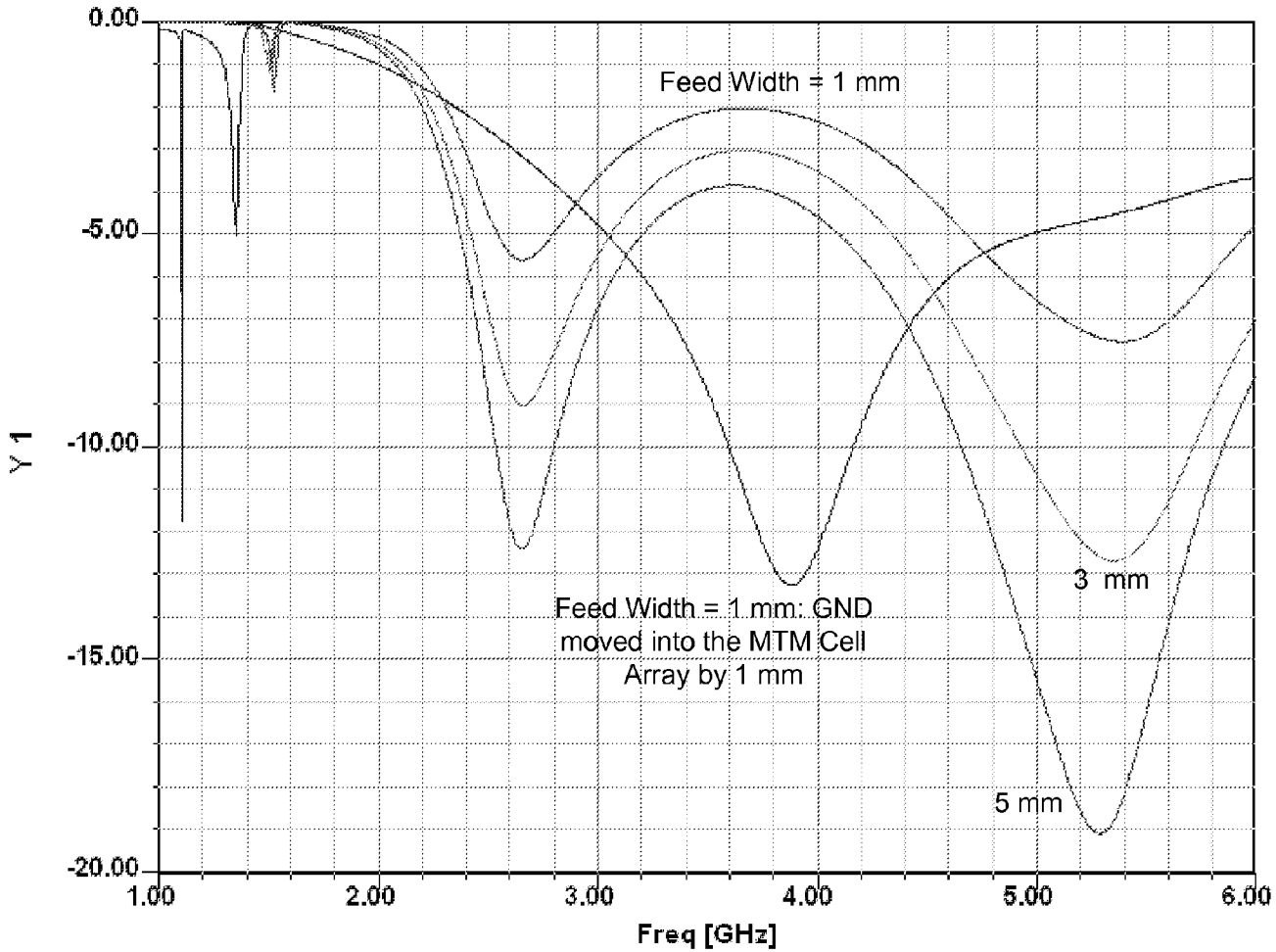

FIG. 22B shows the return loss of this antenna as a function of the signal frequency. The simulation reveals two broad resonances centered at 2.65 GHz and 5.30 GHz with relative BW of ~10% and 23%, respectively. FIGS. 22C and 22D show the radiation patterns of the antenna at the above frequencies, respectively. FIG. 22E shows the return loss variations with antenna feed width and GND overlap with the antenna element. In all variations with exception of the first one (see legend) the structure of resonances is preserved. The best matching is achieved at the feed width of 10 mm.

Figure 22F:
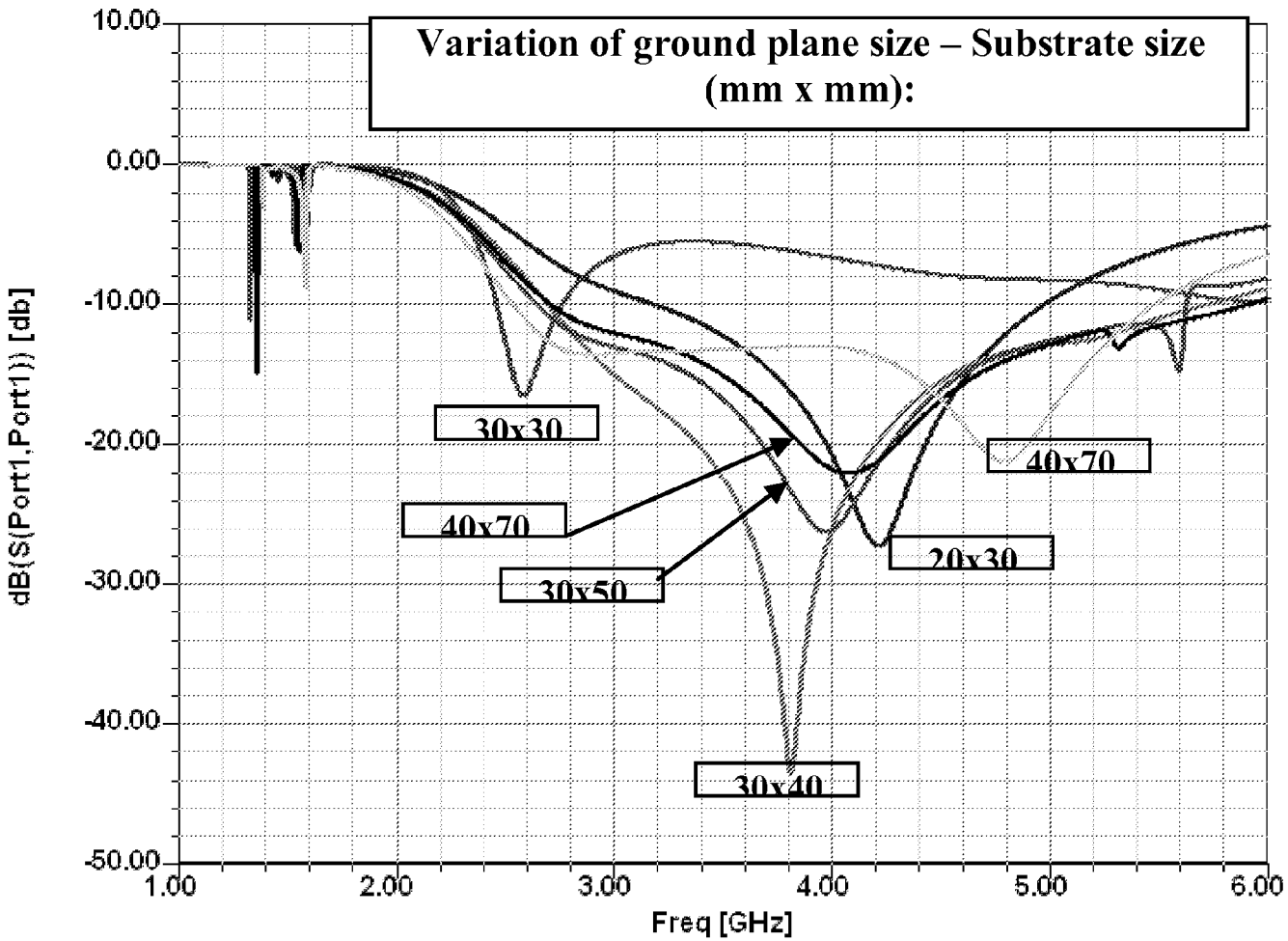

The size of the substrate/GND plane is also adjusted to investigate the effect of strong GND plane reduction on the antenna resonances and respective BW in the three-cell 1-D MTM antenna design in FIG. 20. FIG. 22F shows the return loss obtained from simulations for different substrate/GND size. The S11 parameter varies significantly over the frequency range of interest and all design variations except one show large BW of several GHz between 2 and 6 GHz. The large BW is a result of the stronger coupling to the reduced GND.

Figure 22G:
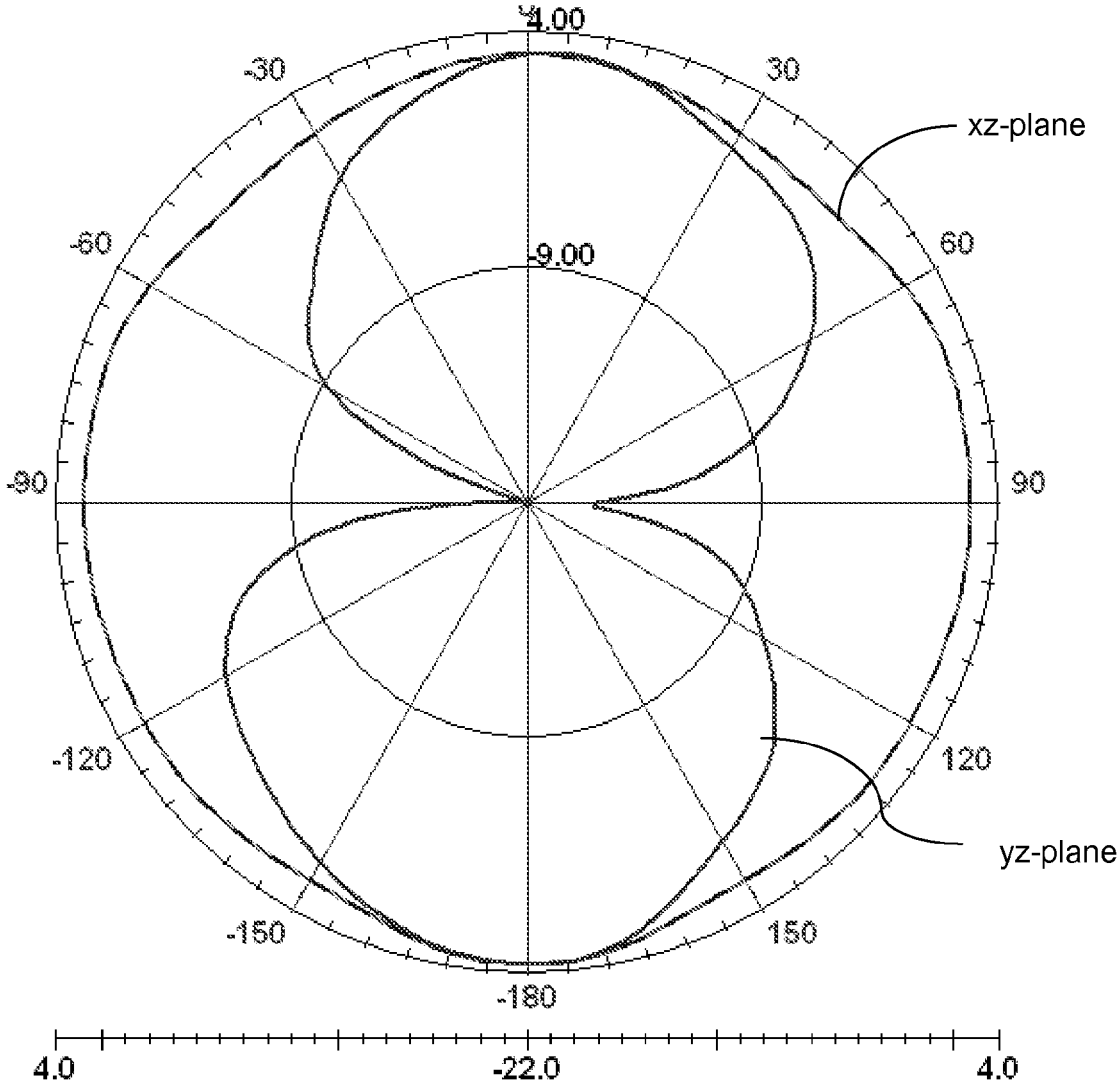

FIG. 22G shows antenna radiation patterns at 2.5 GHz for the antenna model in FIG. 22A. Despite the small GND size, the antenna radiation pattern has the same desirable dipole-like characteristics associated with a radiating element extending well beyond the GND plane.

Figure 23:
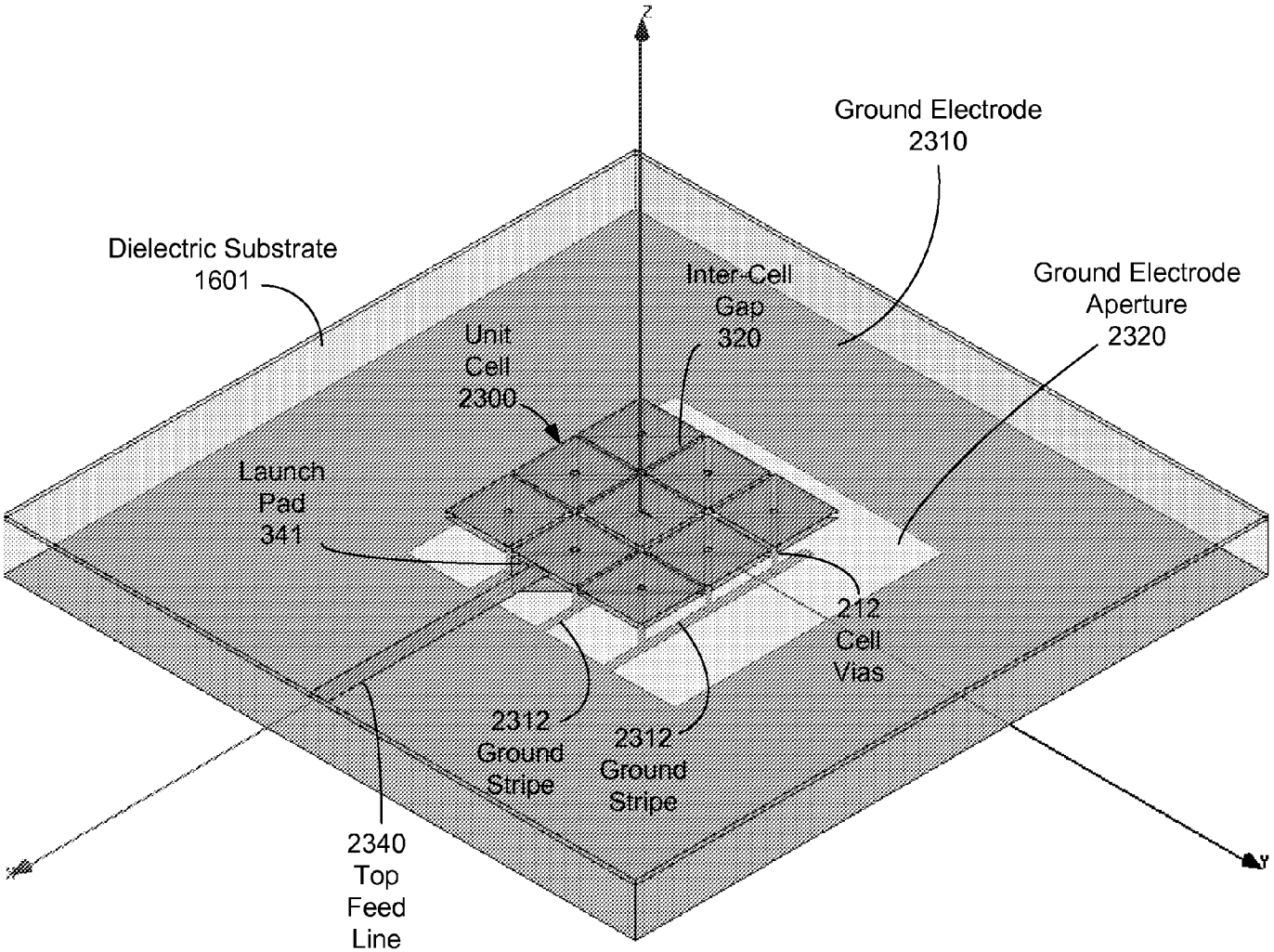

FIG. 23 shows an example of an antenna formed by a 2-D array of 3×3 MTM cells. A dielectric substrate 2301 is used to support the MTM cell array. FIGS. 24A, 24B, 24C and 24D show details of this antenna. Referring back to the 2-D array in FIG. 3, each unit cell 2300 in FIG. 23 is similarly constructed as the cell in FIG. 3 where capacitive coupling metal patches 350 are provided bellow the top cell metal patch 211 on the top of the substrate top surface and positioned to overlap with inter-cell gaps 320 to be capacitively coupled to the patch 211. Different from the contiguous and uniform ground electrode 202 on the bottom of the substrate in FIG. 3, the ground electrode 2310 in FIG. 23 is patterned to have a ground electrode aperture 2320 that is slightly larger than the footprint of the MTM cell array and to include parallel group stripe lines 2312 connected to the peripheral conductive area of the bottom electrode 2310. This design of the bottom ground electrode 2310 provides another example of the truncated ground electrode design for increasing the resonance bandwidths of CRLH MTM antennas.

FIG. 24C shows the detail of the truncated ground electrode 2310 for the 2-D MTM cell array in FIG. 23. The ground stripe lines 2312 are parallel to each other and aligned to the centers of the three rows of MTM cells 2300, respectively, so that each ground stripe line 2312 is in direct contact with the cell vias 212 of MTM cells in three different columns. Under this design, the area of the ground electrode 2310 is reduced around the radiating portions of the MTM cell array and all MTM cells 2300 are connected to the common ground electrode 2310.

This elimination of a portion of the GND plane in the vicinity of the radiating element to increase the antenna bandwidth produces significant advantages. Instead of eliminating completely the part of the GND plane extending beyond the feed point in direction of the radiating element, a square area of the GND electrode larger than the MTM structure by several wavelengths of the signal is cut out. Narrow metal strips 2312 remain below the structure in order to connect the cell vias 212 to the GND electrode 2310 shared by all MTM cells 2300.

In one implementation, the antenna in FIG. 23 can be built using two substrates mounted on top of each other. For example, the top substrate can have a thickness of 0.25 mm and a permittivity of 10.2 and the bottom substrate can have a thickness of 3.048 mm and a permittivity of 3.48. The three metallization layers for the top cell metal patches 211, the middle capacitive coupling metal patches 350 and the bottom ground electrode 2310 are located on the top of the thin top substrate, the interface between the two substrates, and the bottom of the bottom thick substrate, respectively. The role of the middle layer is to increase the capacitive coupling between two adjacent cells and between the first center cell and the feed line by using Metal-Insulator-Metal (MIM) capacitor. The top patch of the unit CRLH cell can be 4 mm wide (x-direction) and 4 mm long (y-direction) with 0.2 mm gap between two adjacent cells. The feed-line is coupled to the antenna with a 0.1 mm gap from the edge of the first unit cell. The vias connecting all top cell patches with bottom cell-GND can be 0.34 mm in diameter and located in the center of the top patches. The MIM patches in the middle are rotated by 45 degrees from top patches and can have a dimension of 3.82 mm×3.82 mm.

Figure 25A:
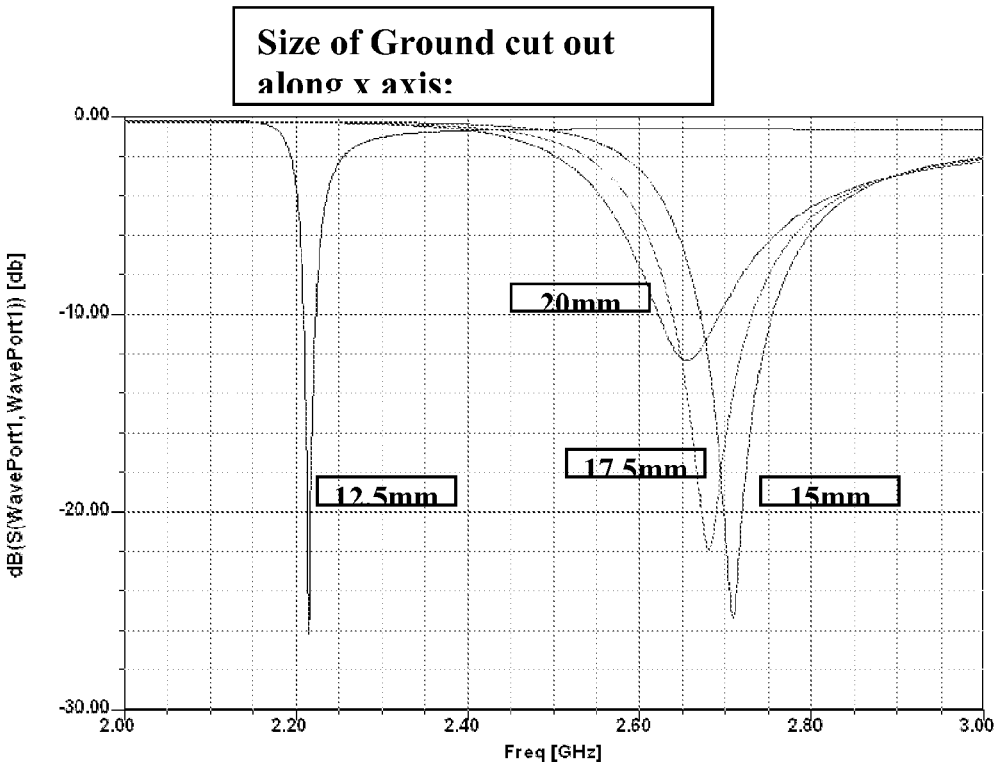

FIG. 25A shows HFSS simulation results of the return loss as a function of the signal frequency for several different designs of the truncated ground electrode shown in FIG. 23. The characteristics of the antenna resonance and bandwidth with respect to the size of the GND cutout were investigated. The results for the return loss of the antenna obtained from these simulations demonstrate that the ground electrode design in FIG. 23 is an effective way to engineer the antenna resonance and bandwidth. Return loss for four different GND cutout amounts equally on four sides of the 3×3 MTM cell array is shown in FIG. 25A. With a GND cutout of only 0.5 mm greater than the MTM cell array structure, the resonance is close to that of the antenna with a full GND and remains narrow (<1% relative BW). For designs with GND cutout extending 3 mm, 5.5 mm and 8 mm, the resonance shifts toward higher frequencies (~2.70 GHz) and the resonance bandwidth increases by approximately 4%.

In comparison, the same MTM cell array antenna with a full contiguous ground electrode approximately exhibits the n=−1 resonance at 2.4 GHz which is a frequency of interest for several wireless communication applications, most notably the WiFi networks under 802.11 b and g standards. However, the resonance BW of the MTM cell array antenna with a full contiguous ground electrode is less than 1% and thus may have limited use in various practical applications which require broader bandwidths.

Figure 25B:
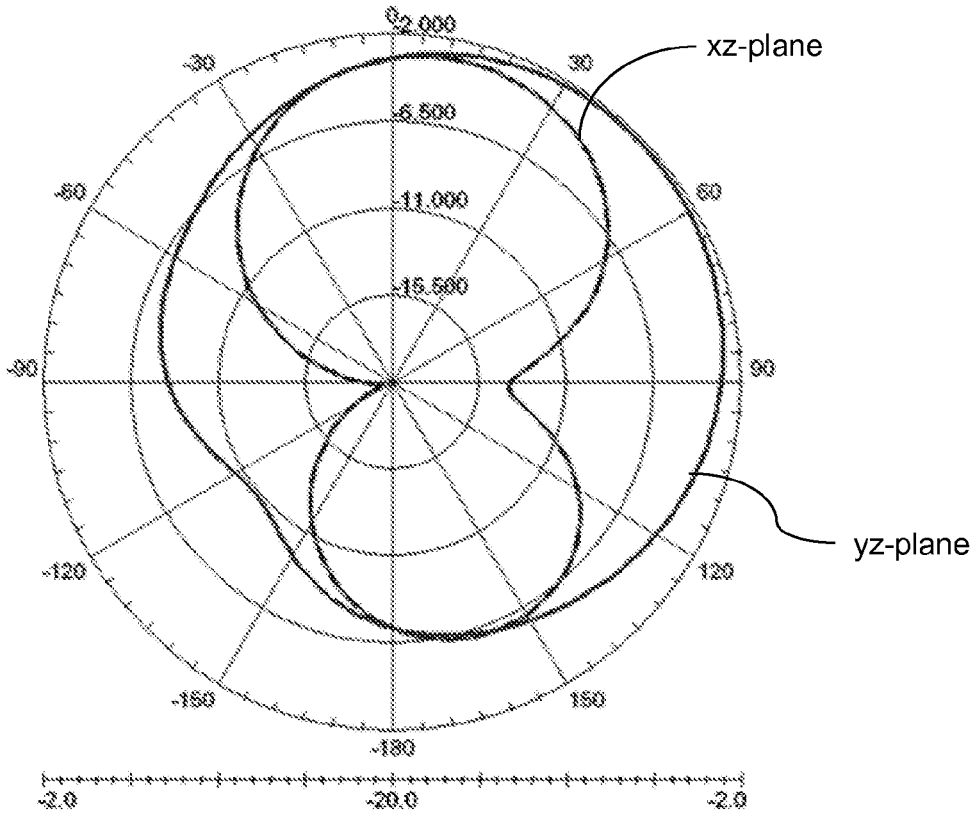

FIG. 25B shows the HFSS simulation results for the antenna radiation patterns at 2.62 GHz. Compared to other antenna designs with reduced GND planes, this design has a relatively small clearing in the GND plane and thus the radiation pattern is more symmetric and has stronger radiation power in a region that is upward and away from the GND layer.

Figure 26:
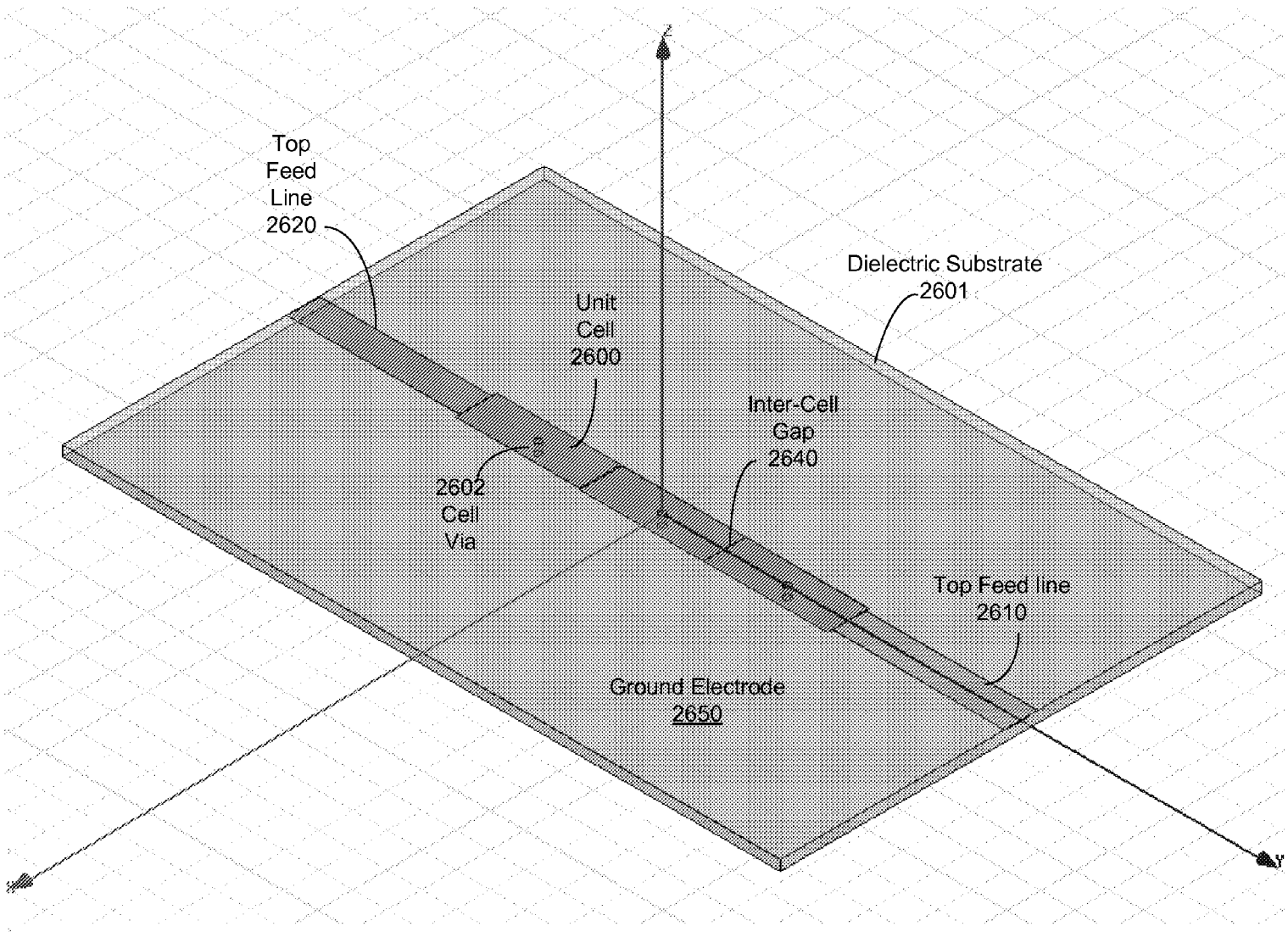
Figure 27A:
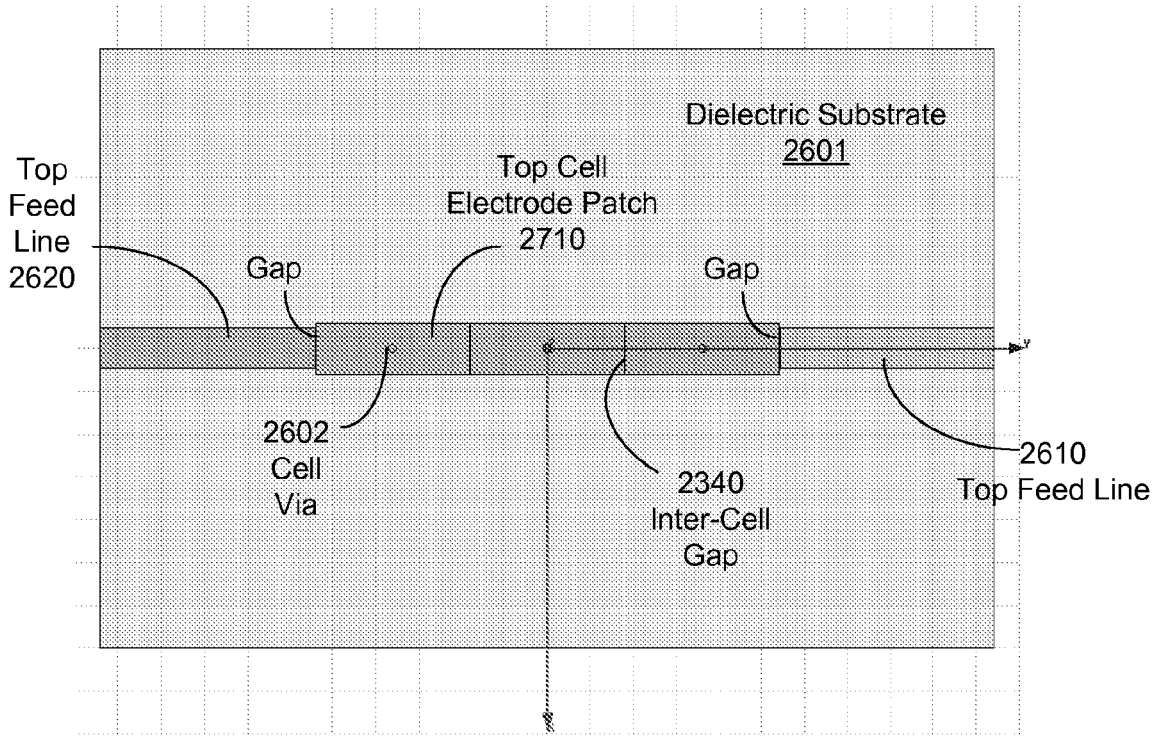
Figure 27B:
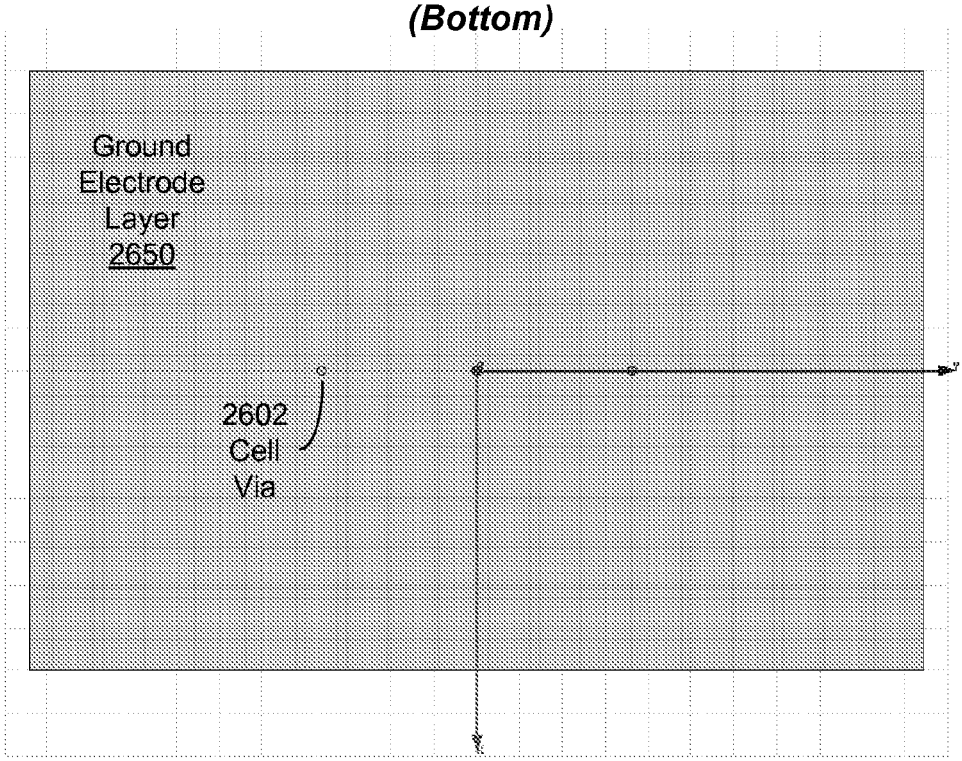

FIG. 26 shows an example of a multi-mode transmission line with a 1-D CRLH MTM cell array to produce LH, mixed, and RH resonant modes. This TL has two metal layers as illustrated in FIGS. 27A and 27B. Two top feed lines 2610 and 2620 are capacitively coupled to two ends of the 1-D array. In distributed CRLH MTM structures, there exist pure LH, pure RH and mixed modes. The LH and RH modes are TEM in nature, while the mixed modes are TE-modes, which appear in the frequency space between the LH and RH modes. FIG. 26 shows a multi-mode CRLH MTM structure to exploit all three types of modes in order to cover a broad range of resonance frequencies of operation.

In FIG. 26, each unit cell 2600 has dimensions of 6 mm×18 mm×1.57 mm. The substrate Rogers RT 5880 material with dielectric constant of 3.2 and loss tangent of 0.0009. The substrate is 100 mm long, 70 mm wide, and 1.57 mm thick. The vias 2602 are centered and connect the top patched to bottom full GND. The feed-line 2620 is connected to the first unit cell with a 0.1 mm gap. HFSS simulations were performed on the above specific structure to obtain S21 and S11 parameters of the line, and to estimate the values of the equivalent circuit components, CL, LL, CR, LR. The S11 results can be obtained from HFSS simulations and from theory. Regarding RH modes, theory and simulations show excellent agreement. On the LH side, the theoretical results show slight shift to lower frequencies, which is natural when taking into account that the LH parameters are difficult to estimate. Mixed modes are shown in HFSS simulations and cannot be derived from analytical expressions. The simulations suggest that different types of modes are equal to the number of cells in the MTM structure.

Figure 28:
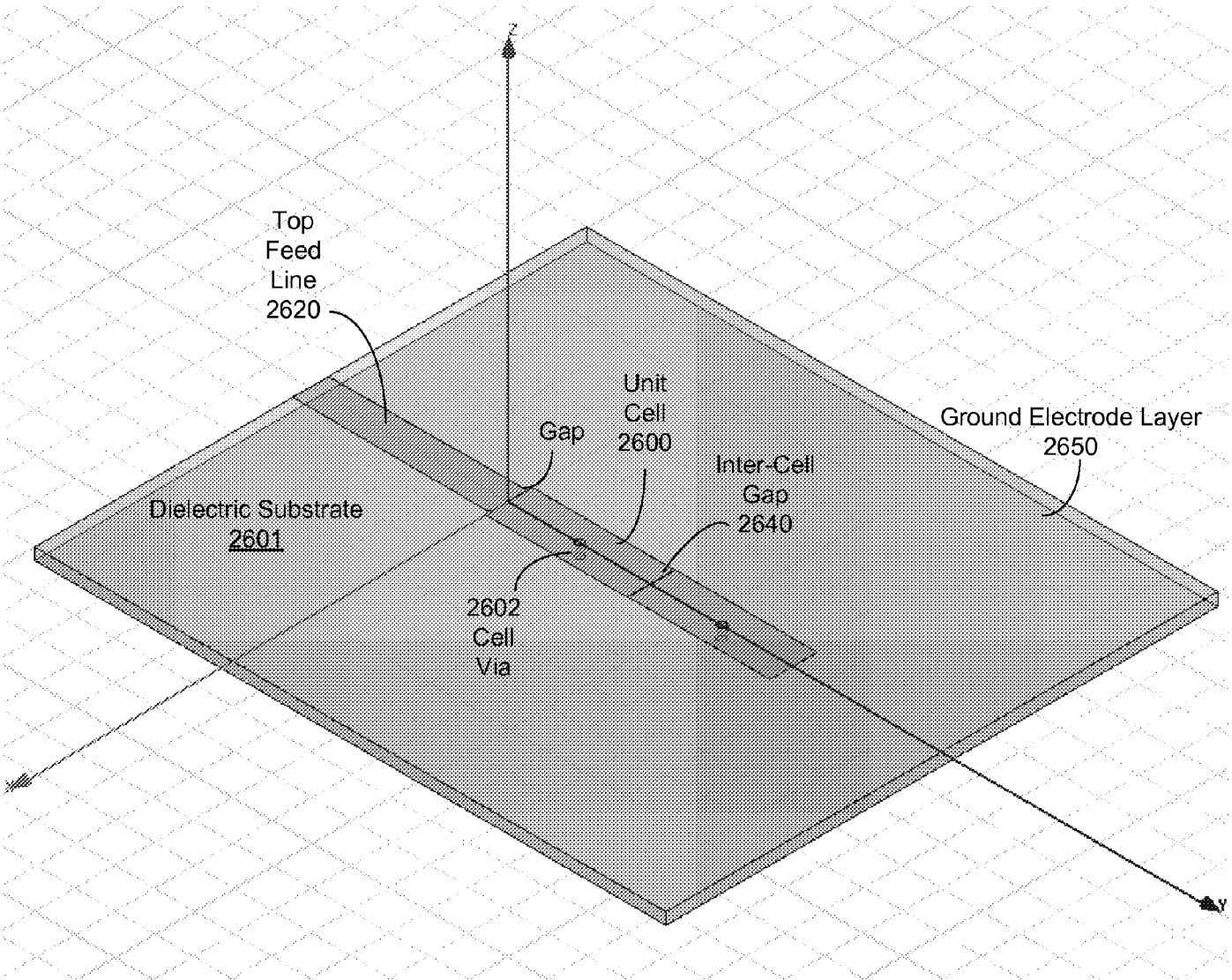
Figure 29A:
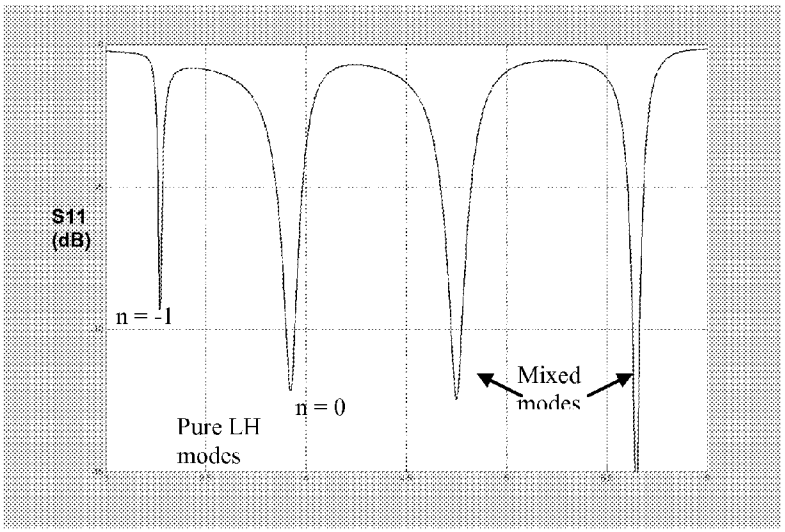
Figure 29B:
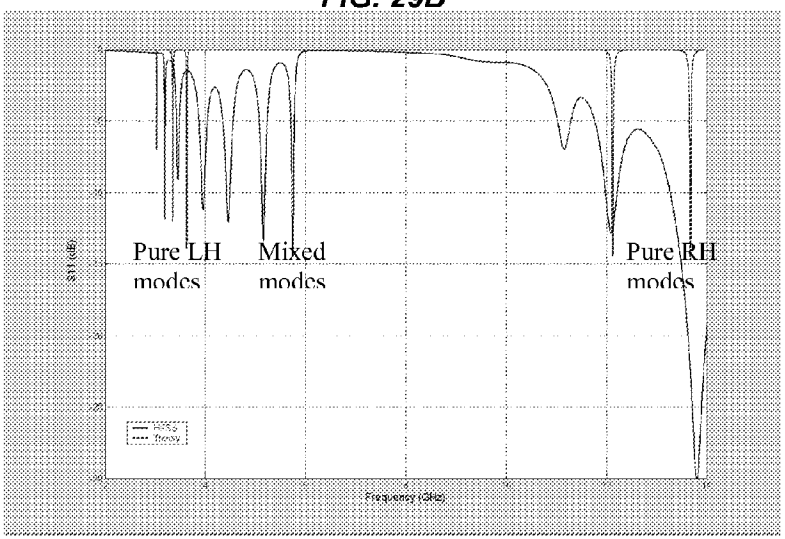
Figure 29C:
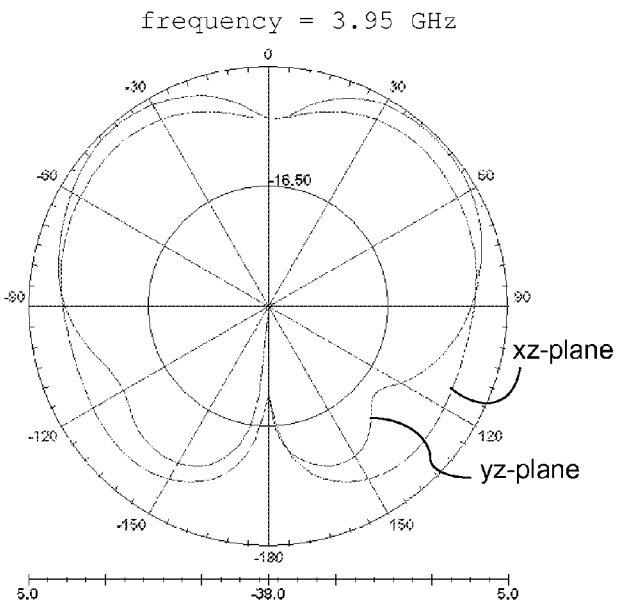

FIG. 28 shows a multi-mode antenna based on a two-cell MTM linear array based on the TL design in FIG. 26. FIGS. 29A and 29C show the HFSS simulations of this antenna. The return loss of the antenna consistently shows the presence of the two LH modes, n=0 and n=−1, and two mixed modes which appear very close to their LH counterparts. As seen from the plot the n=0 LH resonance show BW>1% which can be further increased by better matching to 50 ohm. Simulations with different CRLH parameters suggest that the closer the LH resonances appear to the mixed modes, the broader they become. This behavior is analogous to the broadening of the resonances in balanced CRLH MTM structures. Thus, by manipulating the position of the LH, RH and mixed modes one can create a versatile multi-mode antenna. The position of the mixed modes is determined to zero order by the TE-mod cut-off frequency.

Additional advantage of exploiting the mixed modes for antenna application comes from the fact that for small antennas the RH resonances appear at high frequencies, which are not used in wireless communications. The mixed modes are readily available for such applications. Also, these modes provide additional advantage in terms of antenna gain and efficiency, since they show smallest attenuation due to conductor loss.

In many of the above MTM designs, the ground electrode layer is located on one side of the substrate. The ground electrode, however, can be formed on both sides of the substrate in a MTM structure. In such a configuration, an MTM antenna can be designed to include an electromagnetically parasitic element. Such MTM antennas can be used to achieve certain technical features by presence of one or more parasitic elements.

Figure 30:
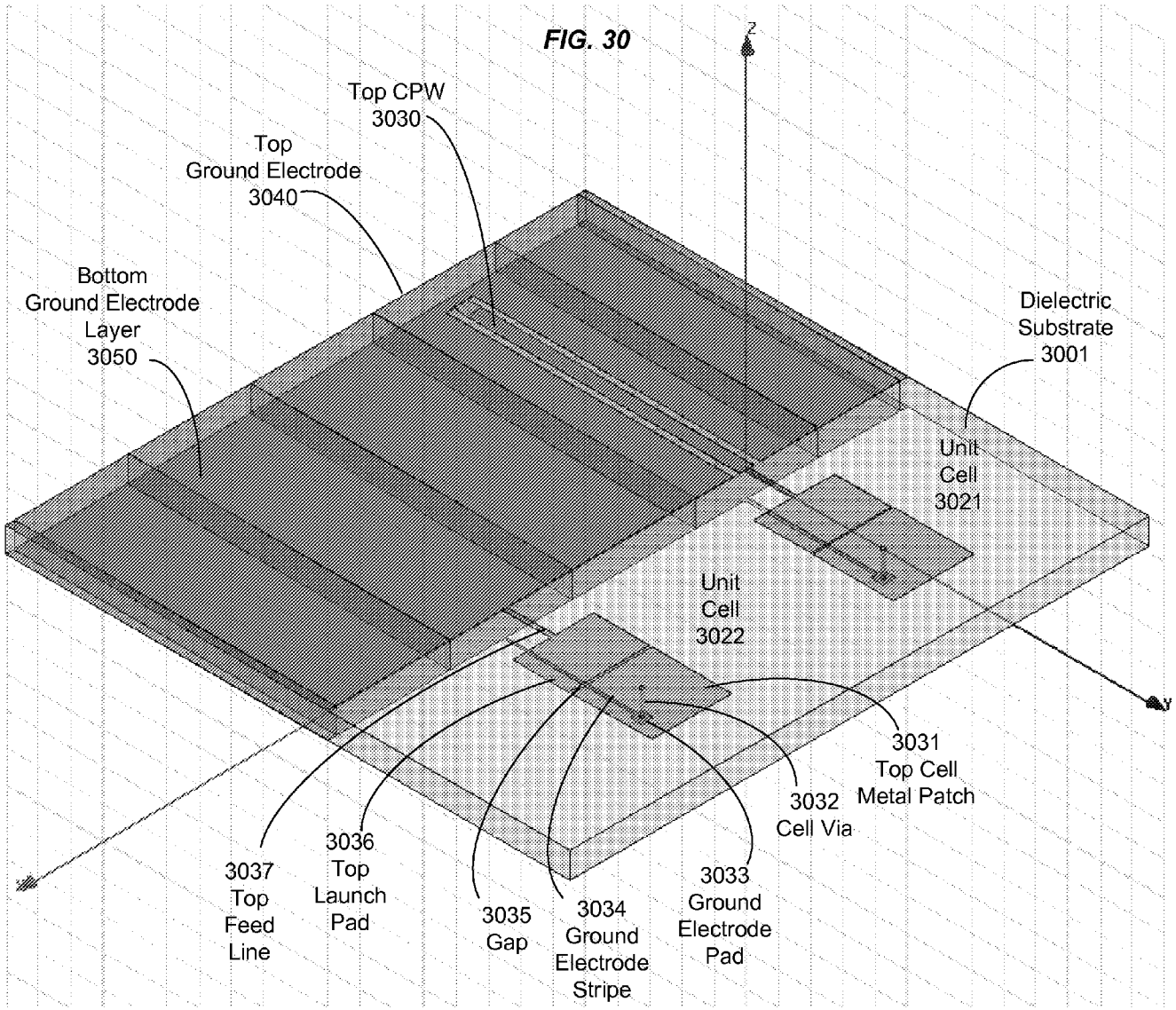

FIG. 30 shows an example of an MTM antenna with a MTM parasitic element. This antenna is formed on a dielectric substrate 3001 with top and bottom ground electrodes 3040 and 3050. Two MTM unit cells 3021 and 3022 are formed with an identical cell structure in this antenna. The unit cell 3021 is the active antenna cell and its top cell metal patch is connected to a feed line 3037 for receiving a transmission signal to be transmitted. The top cell metal patch and the cell via of the unit cell 3022 are connected to the top and bottom ground electrodes 3040 and 3050, respectively. As such, the unit cell 3022 does not radiate and operates as a parasitic MTM cell.

Figure 31A:
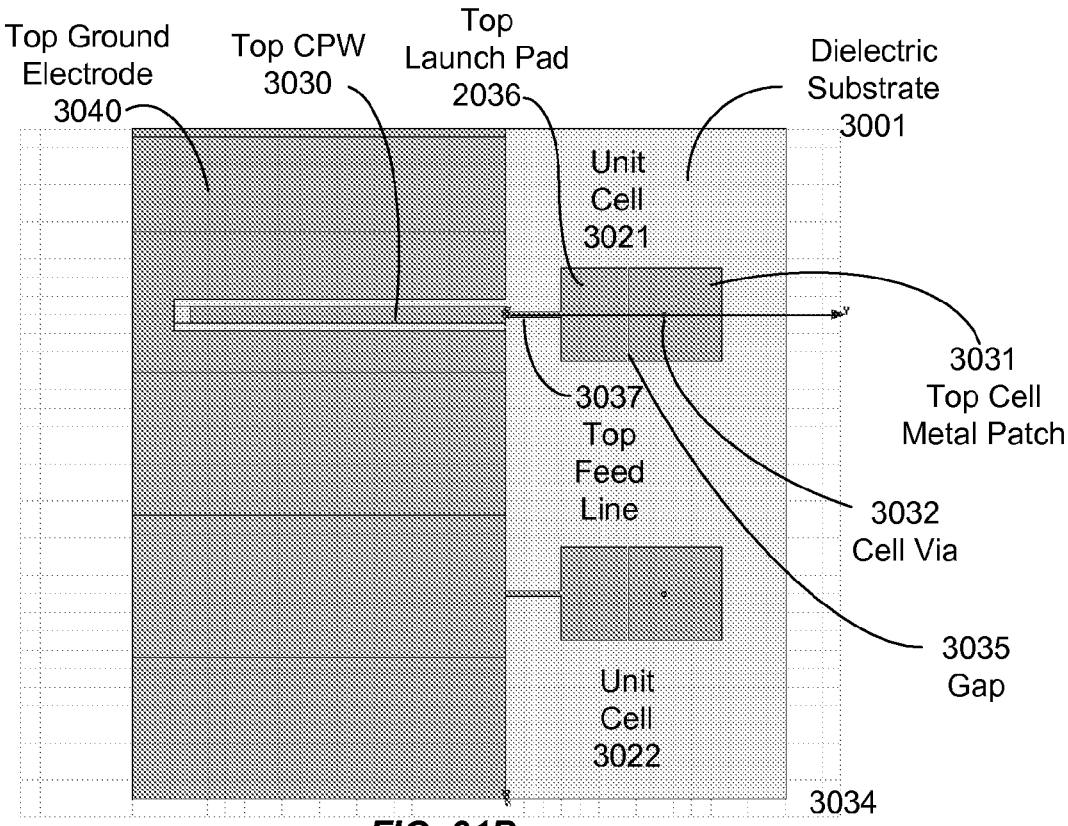
Figure 31B:
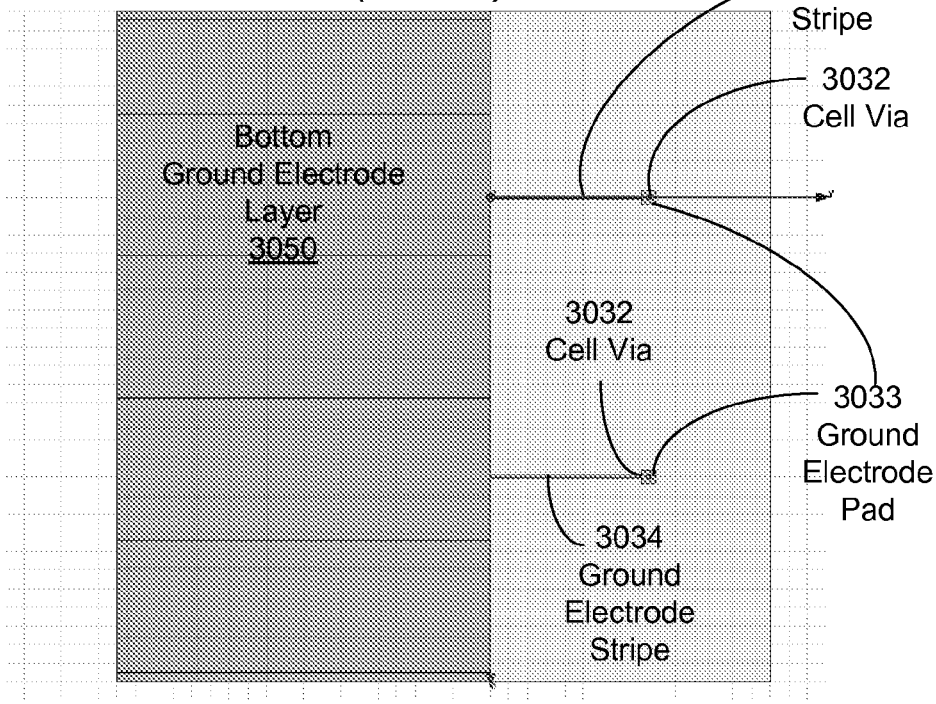

FIGS. 31A and 31B illustrate details of the top and bottom metal layers on the two sides of the substrate 3001. The parasitic element is identical to the antenna design with the exception that it is shorted to top GND. Each unit cell includes a top cell metal patch 3031 on the top surface of the substrate 3001, a ground electrode pad 3033 on the bottom surface of the substrate 3001 and a cell via 3032 penetrating the substrate 3001 to connect the ground pad 3033 to the top cell patch 3031. A ground electrode stripe line 3034 is formed on the bottom surface to connect the pad 3033 to the bottom ground electrode 3050 that is outside the footprint of the cells 3022 and 3021. On the top surface, a top launch pad 3036 is formed to capacitively couple with the top cell metal patch 3031 via a gap 3035. The top feed line 3037 is formed to connect the top launch pad 3036 of the parasitic unit cell 3022 to the top ground electrode 3040. Different from the unit cell 3022, a co-planar waveguide (CPW) 3030 is formed in the top ground electrode 3040 to connect to the top feed line 3037 for the active unit cell 3021. As shown in FIGS. 30 and 31A, the CPW 3030 is formed by a metal stripe line and a gap with surrounding top ground electrode 3040 to provide an RF waveguide to feed a transmission signal to the active MTM cell 3021 as the antenna. In this design, the ground electrode pad 3033 and the ground electrode stripe line 3034 have a dimension less than that of the top cell metal patch 3031. Therefore, the active unit cell 3021 has a truncated ground electrode to achieve a broad bandwidth.

Figure 32A:
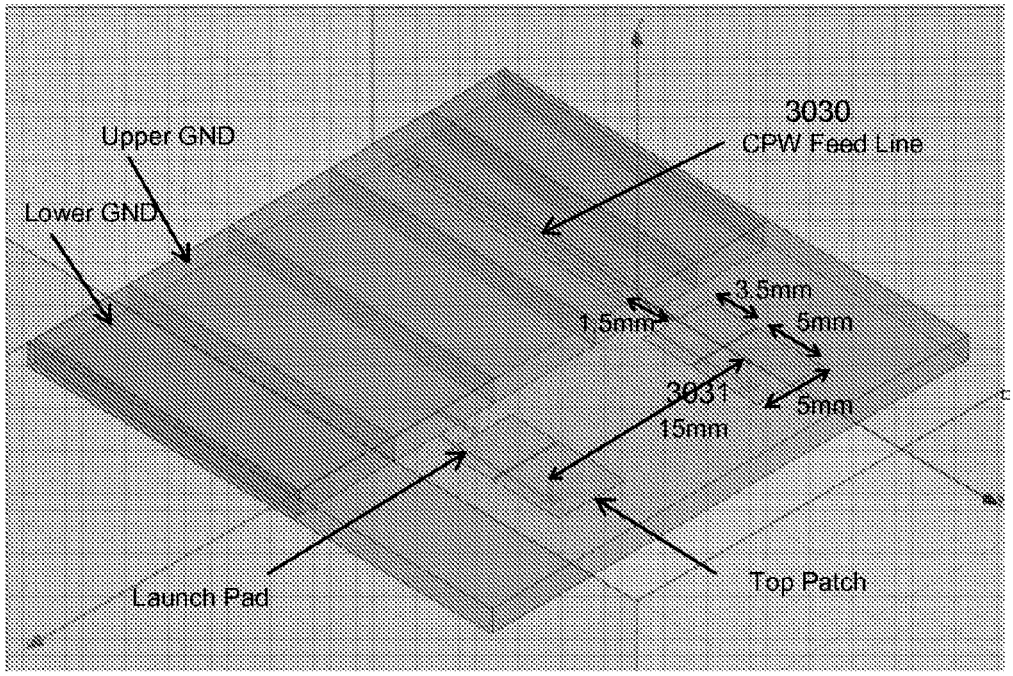

As a specific example of the above design in FIG. 30, FIG. 32A shows an antenna built on a single 1.6-mm thick FR4 substrate with a dielectric constant of 4.4 and loss tangent of 0.02. The top patch of the unit CRLH cell is 5-mm wide (x-direction) and 5-mm long (y-direction). The feed line is a stripe of 3 mm in length and 0.3 mm in width and is coupled to the active antenna cell via a launch pad of 5 mm in length and 3.5 mm in width. The launch pad is coupled to the unit cell with a 0.1-mm gap from the edge of the unit cell. The vias connecting all top patches with the bottom cell GND are 0.25 mm in diameter and are located in the center of the top patches.

Figure 32B:
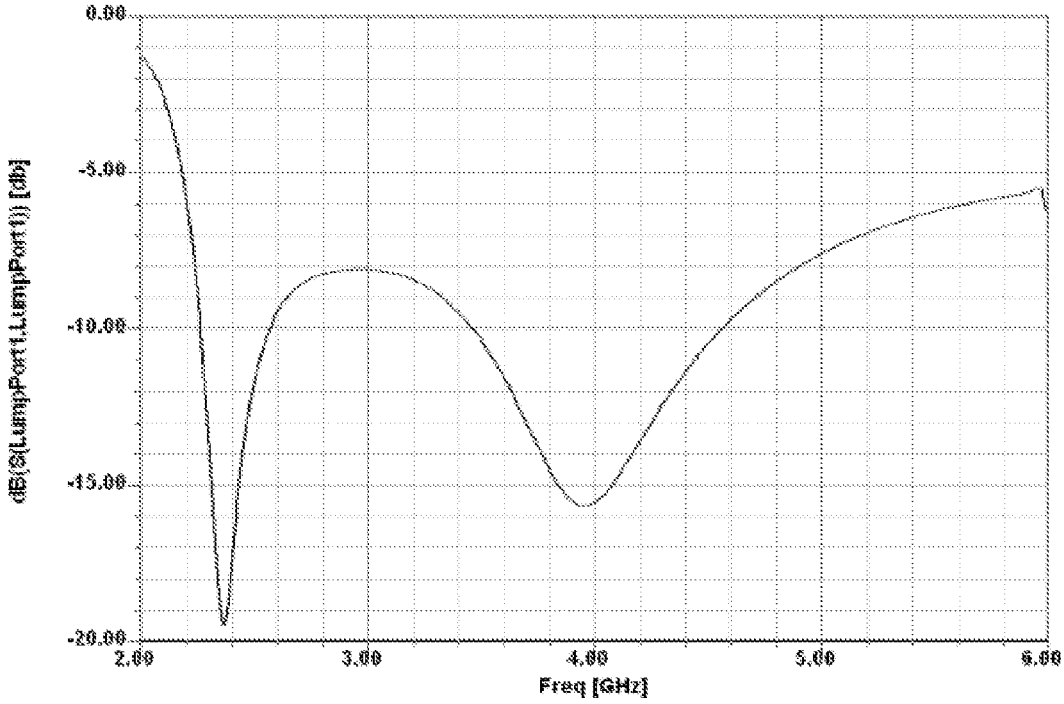
Figure 32C:
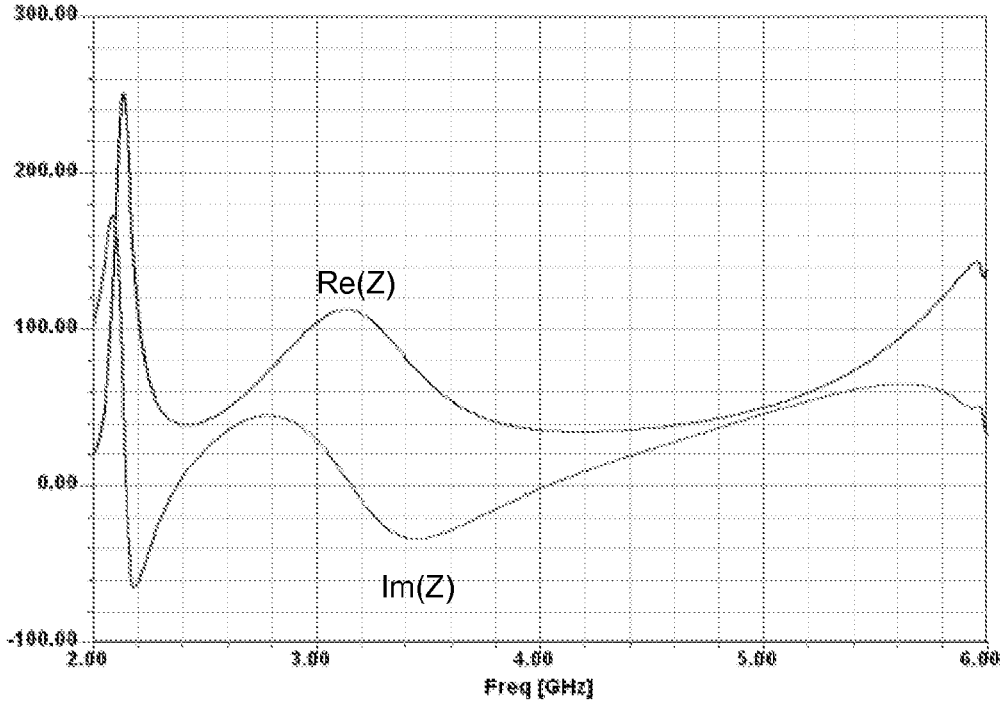
Figure 32D:
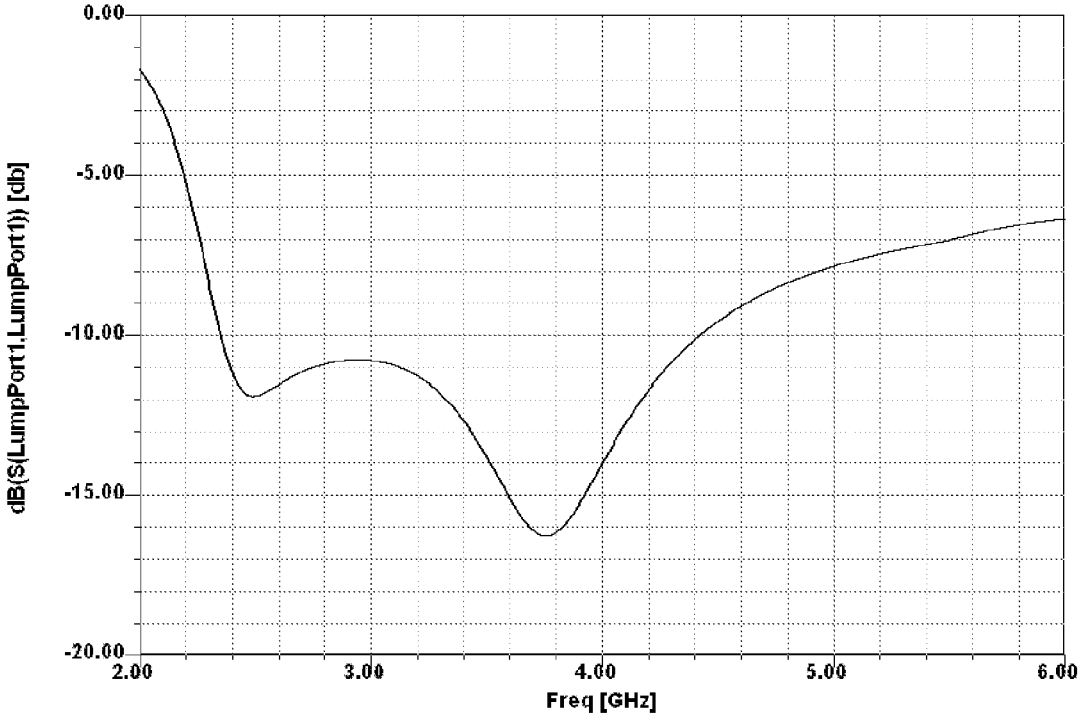

The parasitic element 3022 serves to increase the maximum gain of the active element 3021 along a selected direction. The antenna in FIG. 32A produces a directive overall gain antenna pattern with a maximum gain of 5.6 dBi. In comparison, an identically structured MTM cell antenna element without the parasitic element has an omni-directional pattern with a maximum gain of 2 dBi. The distance between the active and parasitic elements can be designed to control the radiation pattern of the active antenna cell to achieve a maximum gain in different directions. FIGS. 32B and 32C show, respectively, simulated return loss of the active antenna MTM cell and the real and imaginary parts of the input impedance of the antenna in FIG. 32A. The dimensions of the launch pads 2036 and the cell metal patch 3031 can be can be selected to achieve desired antenna performance characteristics. For example, when the length of launch pad of the parasitic element in the example in FIG. 32A is reduced to 2.5 mm from 3.5 mm and the length of the cell metal patch is increased to 6 mm from 5 mm, the return loss of the active element is changed to provide a wider frequency band of operation from 2.35 GHz to 4.42 GHz at S11=−10 dB as shown in FIG. 32D.

The above example in FIG. 30 is an antenna with a single active element and a single parasitic element. This use of a combination of both active and parasitic elements can be used to construct various antenna configurations. For example, a single active element and two or more parasitic elements may be included in an antenna. In such a design, the positions and spacing of the multiple parasitic elements relative to the single active element can be controlled to manipulate the resultant antenna radiation pattern. In another design, an antenna can include two or more active MTM antenna elements and multiple parasitic elements. The active MTM elements can be identical or different in structure from the parasitic MTM elements. In addition to manipulating and controlling the resultant gain pattern, active elements can be used to increase the BW at a given frequency or to provide additional frequency band(s) of operation.

MTM structures may also be used to construct transceiver antennas for various applications in a compact package, such as wireless cards for laptop computers, antennas for mobile communication devices such as PDAs, GPS devices, and cell phones. At least one MTM receiver antenna and one MTM transmitter antenna can be integrated on a common substrate.

Figures 33A, 33B, 33C, 33D:
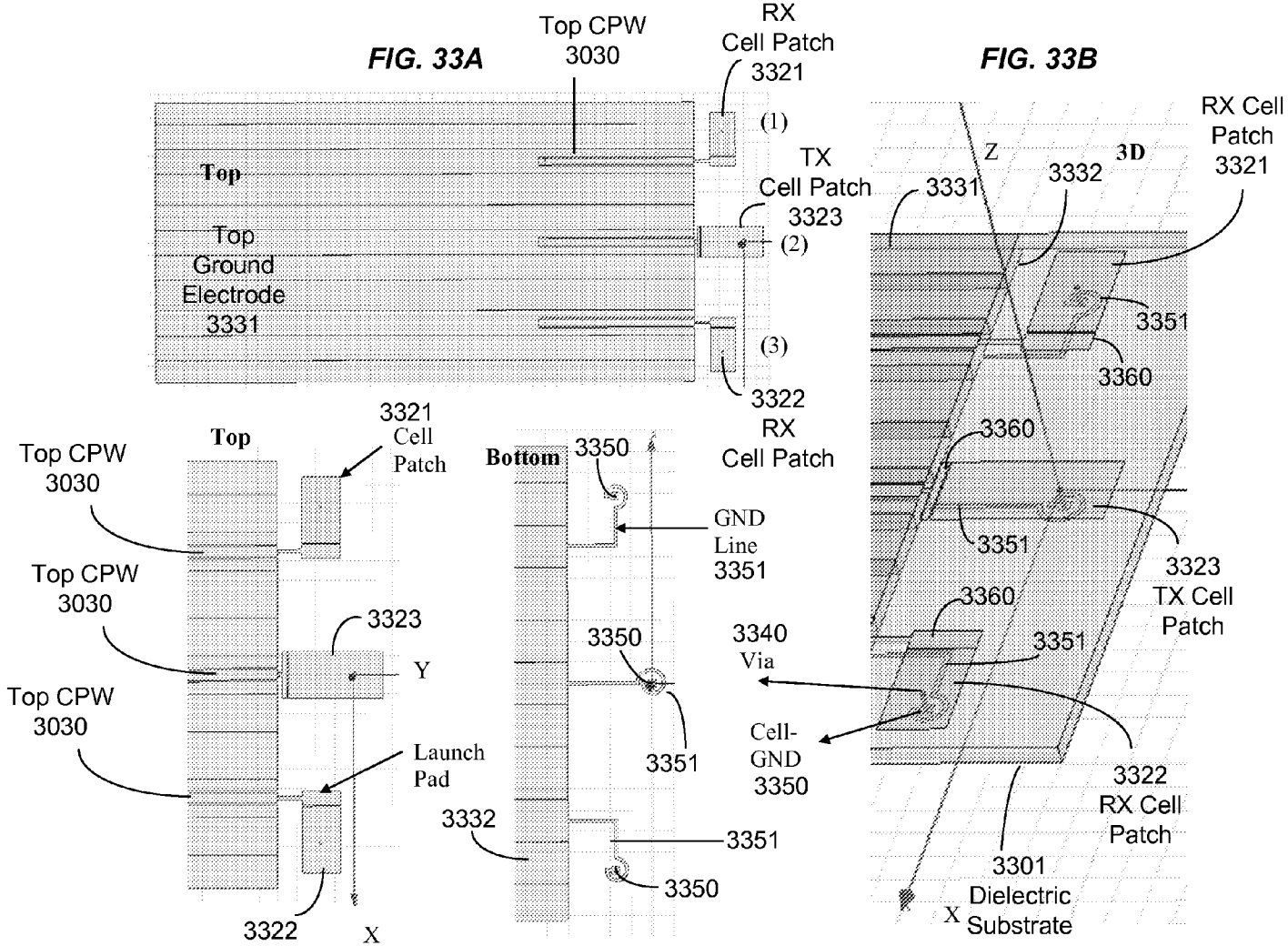

FIGS. 33A, 33B, 33C and 33D illustrate an example of a transceiver antenna device with two MTM receiver antennas and one MTM transmitter antenna based on a truncated ground design. Referring to FIG. 33B, a substrate 3301 is processed to include a top ground electrode 3331 on part of its top substrate surface and a bottom electrode 3332 on part of its bottom substrate surface. Two MTM receiver antenna cells 3321 and 3322 and one MTM transmitter antenna cell 3323 are formed in the region of the substrate 3301 that is outside the footprint of the top and bottom ground electrodes 3331 and 3332. Three separate CPWs 3030 are formed in the top ground electrode 3331 to guide antenna signals for the three antenna cells 3321, 3322 and 3323, respectively. The three antenna cells 3321, 3322 and 3323 are labeled as ports 1, 3 and 2, respectively as shown in FIG. 33A. Measurements S11, S22 and S33 can be obtained at these three ports 1, 2 and 3, respectively, and signal coupling measurements S12 between ports 1 and 2 and S31 between ports 3 and 1 can be obtained. These measurements characterize the performance of the device. Each antenna is coupled to the corresponding CPW 3030 via a launch pad 3360 and a stripe line that connects the CPW 3030 and the launch pad 3360.

Each of the antenna cells 3321, 3322 and 3323 is structured to include a top cell metal patch on the top substrate surface, a conductive via 3340, and a ground pad 3350 with a dimension less than the top cell metal patch. The ground pad 3350 can have an area greater than the cross section of the via 3340. In other implementations, the ground pad 3350 can have an area greater than that of the top cell metal patch. In each antenna cell, a stripe line 3351 is formed on the bottom substrate surface to connect the ground pad 3350 to the bottom ground electrode 3332. In the example shown, the two receiver antenna cells 3321 and 3322 are configured to have a rectangular shape that is elongated along a direction perpendicular to the elongated direction of the CPW 3030 and the transmitter antenna cell 3323, which is located between the two receiver antenna cells 3321 and 3322, is configured to have a rectangular shape that elongated along the elongated direction of the CPW 3030. Referring to FIGS. 33B and 33D, each ground stripe line 3351 includes a spiral stripe pattern that connects to and at least partially surrounds each ground pad 3350 to shift the resonant frequency for each antenna cell to a lower frequency. The dimensions of the antenna cells are selected to produce different resonant frequencies, e.g., the receiver antenna cells 3321 and 3322 can be shorter in length than the transmitter antenna cell 3323 to have higher resonant frequencies for the receiver antenna cells 3321 and 3322 than the resonant frequency for the transmitter antenna cell 3323.

The above transceiver antenna device design can be used to form a 2-layer MTM client card operating at 1.7 GHz for the transmitter antenna cell and 2.1 GHz for the receiver antenna cells. The three MTM antenna cells are arranged along a PCMCIA card with a width of 45 mm where the middle antenna cell resonates a transmitter within a frequency band from 1710 MHz to 1755 MHz and the two receiver side antennas resonate at frequencies in a frequency band from 2110 MHz to 2155 MHz for the Advanced Wireless Services (AWS) systems for mobile communications to provide data services, video services, and messaging services. The 50-Ohm impedance matching can be accomplished by shaping the launch pad (e.g., its width). The antenna cells are configured based on the specification listed below. A FR4 substantiate with a thickness of 1.1 mm is used to support the cells. The distance between the side cells and GND is 1.5 mm. The via line on the bottom layer consists of two straight lines of 0.3 mm in width and ¾ of a circle with a 0.5-mm radius. The middle antenna resonates at lower frequency due to its longer bottom GND line. The gap between the launch pad and top GND is 0.5 mm. The spiral constitutes of a full circle with a radius of 0.6 mm and a spacing of 0.6 mm from the center of the ground pad.

| RX Cell Patch | RX Cell Launch Pad | RX Cell-Pad Gap | Via Diameter | RX Cell-Top and Bottom GND distance | GND Stripe Line Width |
|---|---|---|---|---|---|
| 7 mm × 4 mm | 4 mm × 1 mm | 0.1 mm | 6 mil | 1.5 mm | 0.3 mm |
| **TX Cell Patch** | **TX Cell Launch Pad** | **TX Cell-Pad Gap** | **Via Diameter** | **Cell-Top and Bottom GND distance** | **GND Stripe Line Width** |
| 10 mm × 5 mm | 5 mm × 0.5 mm | 0.5 mm | 6 mil | 1.5 mm | 0.3 mm |

Figure 34A:
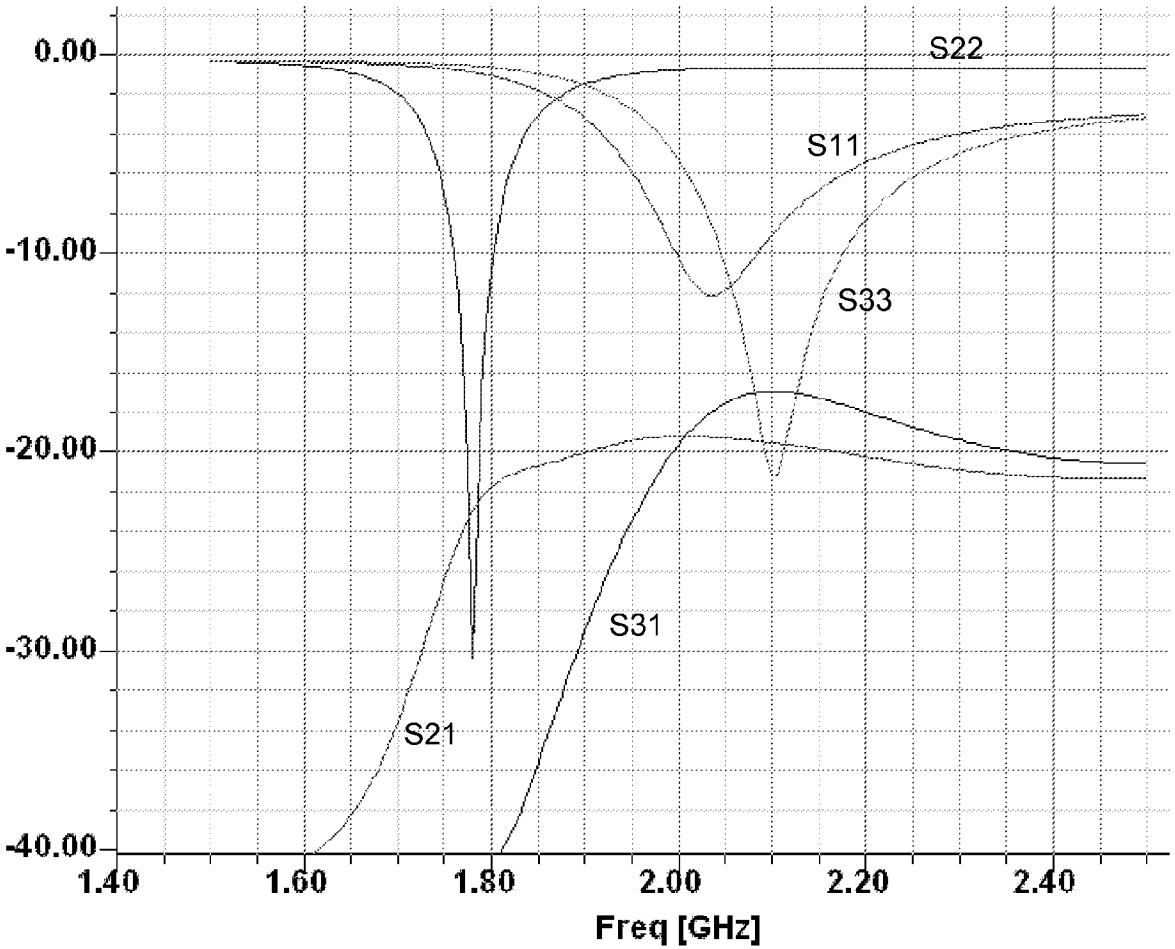
Figure 34B:
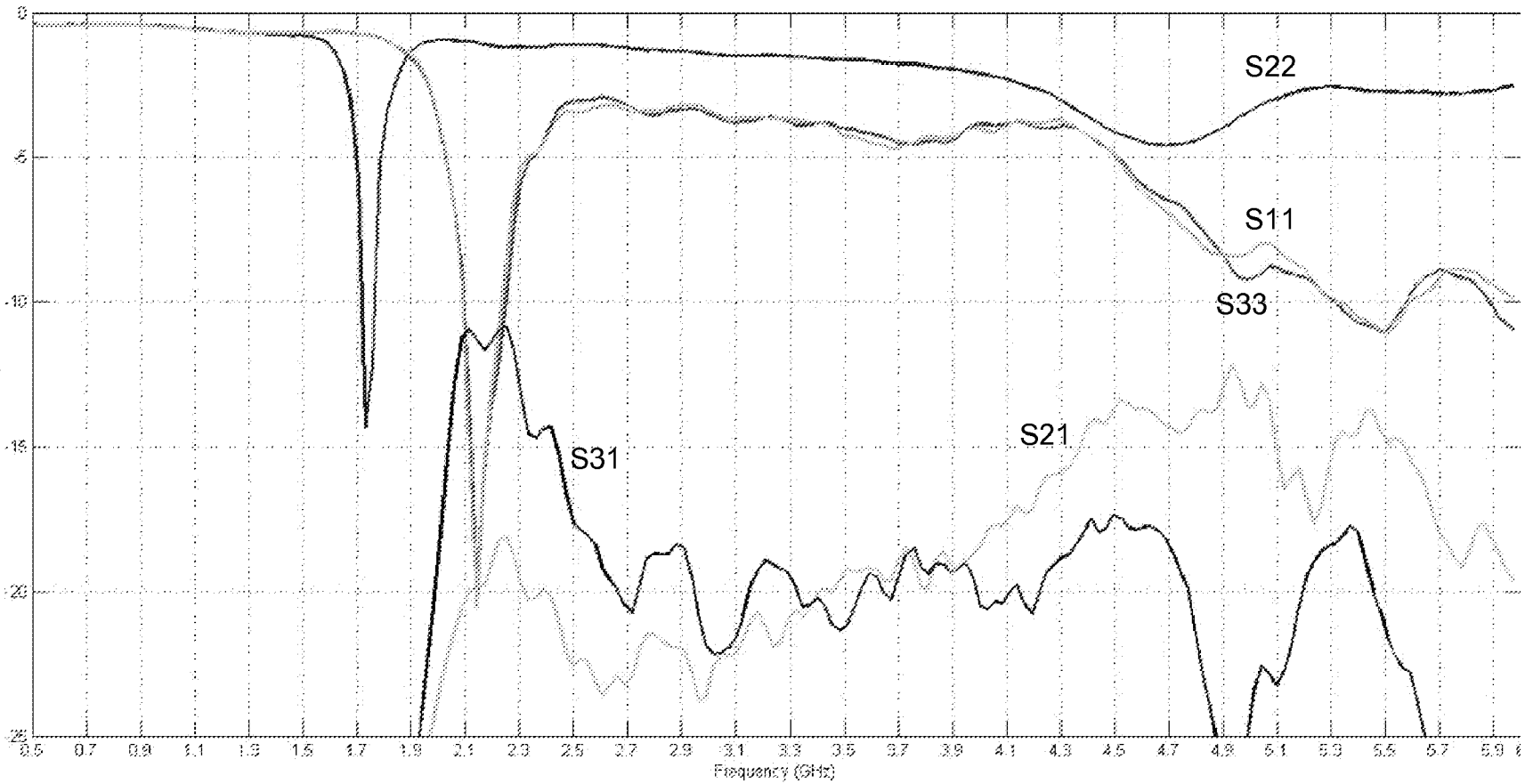
Figure 34C:
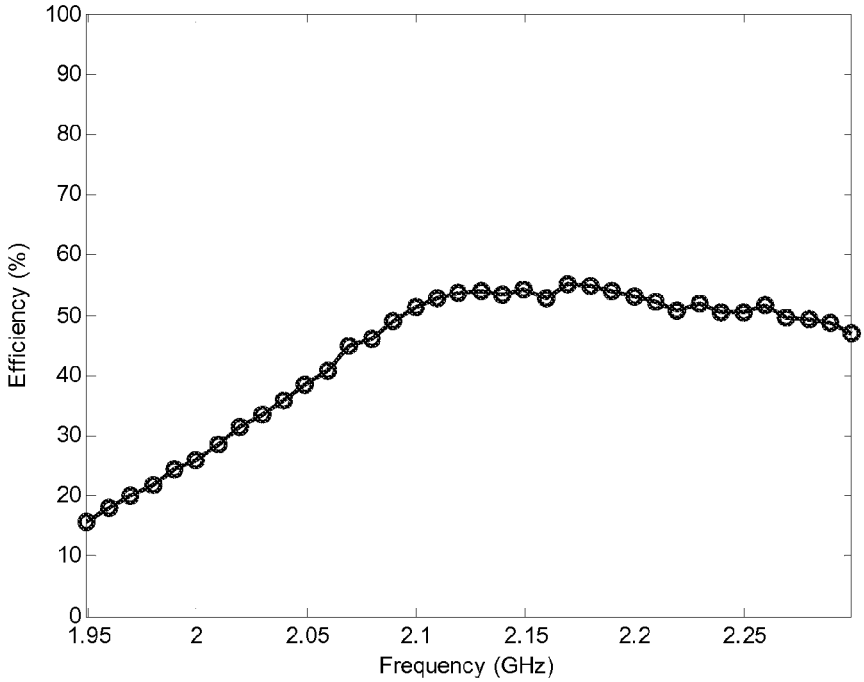
Figure 34D:
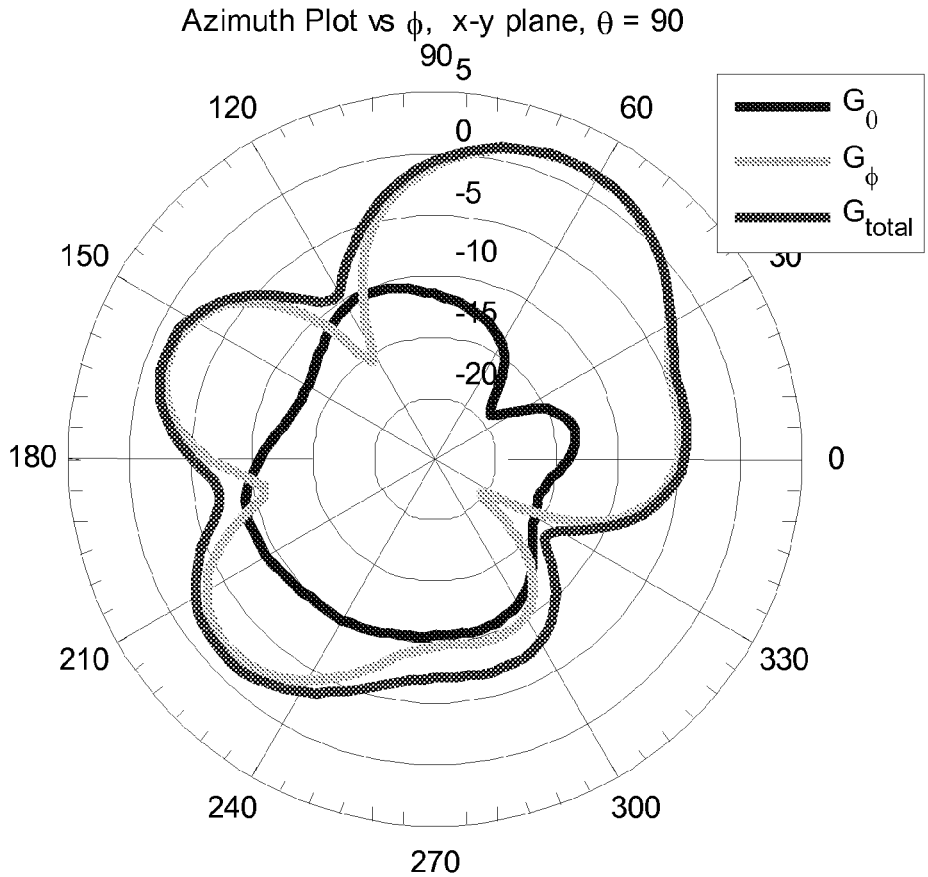
Figure 34E:
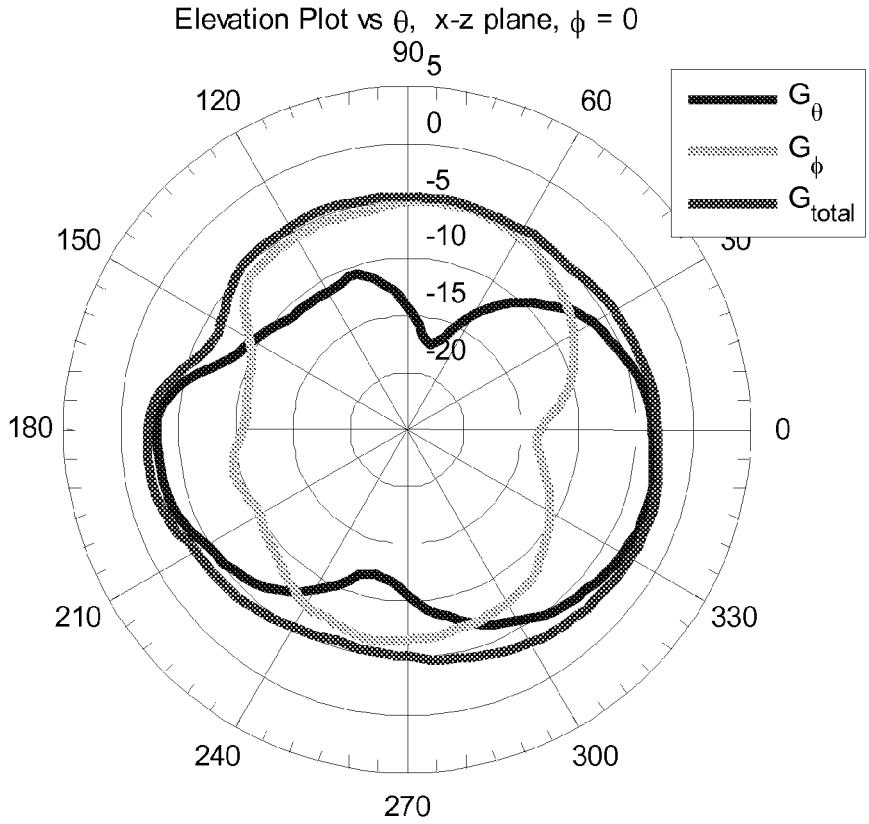
Figure 34F:
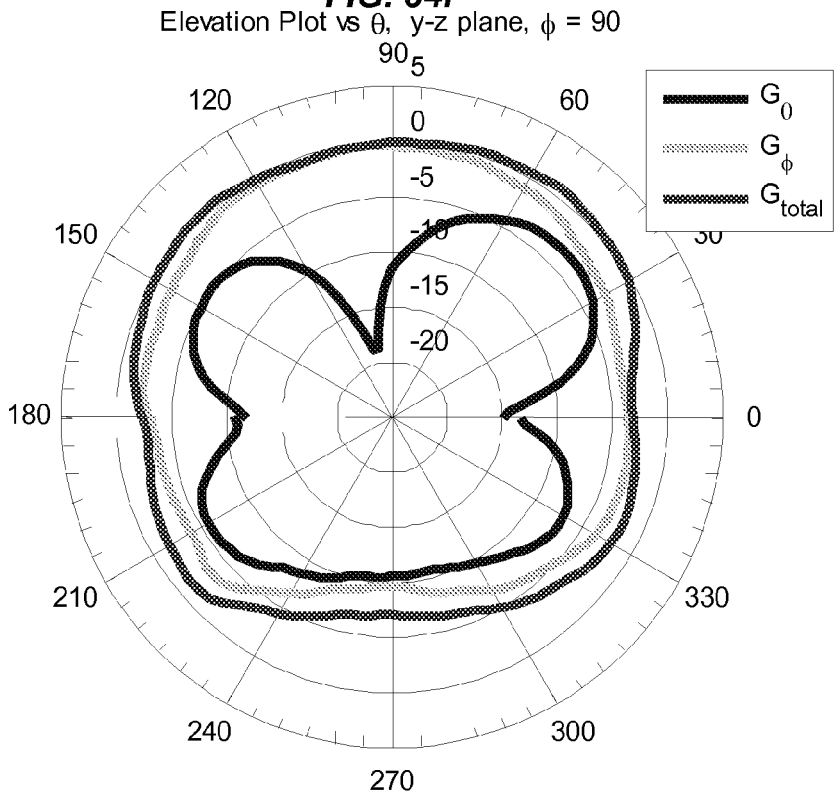
Figure 34G:
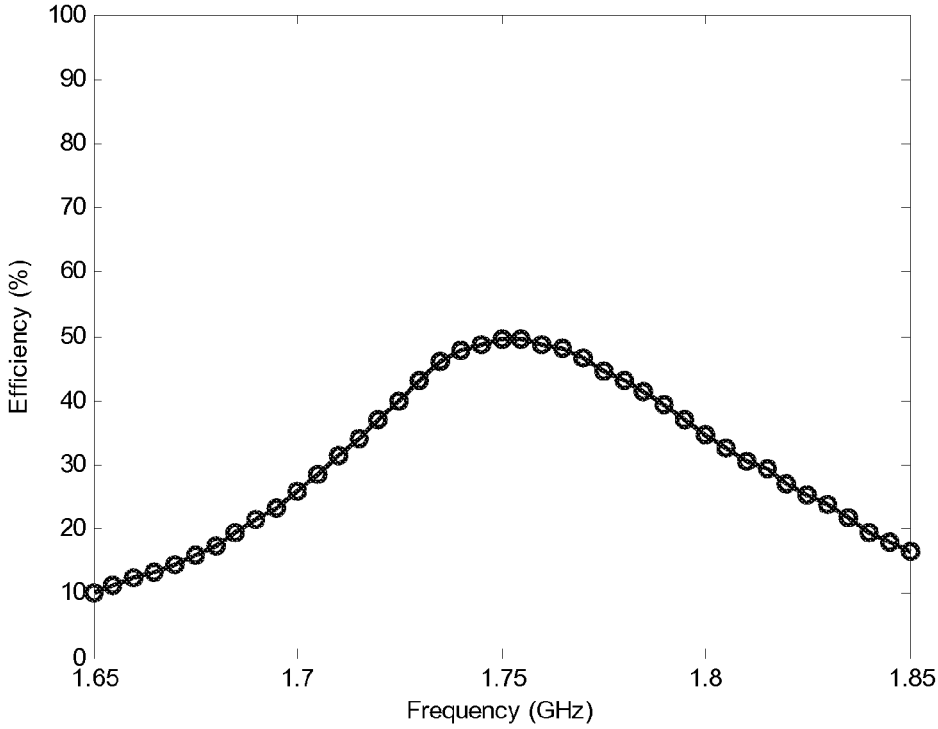
Figure 34H:
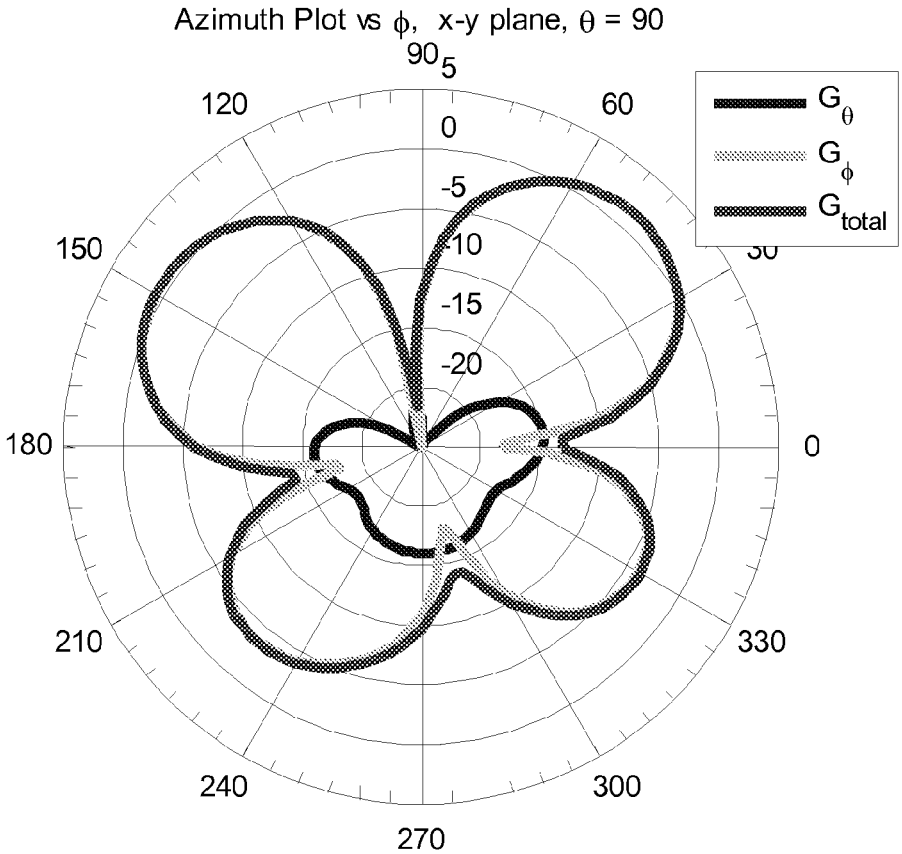
Figure 34I:
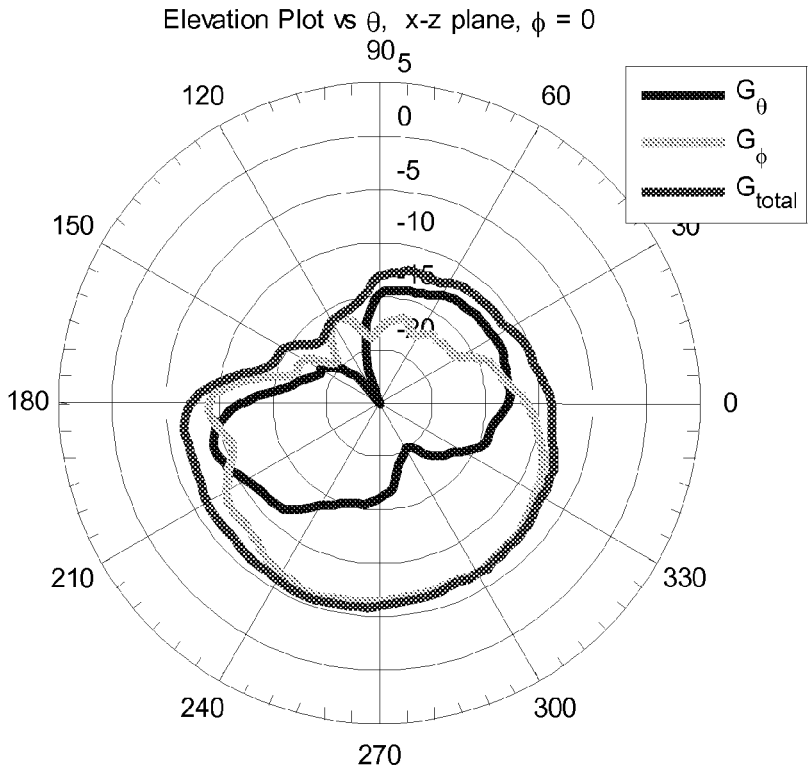
Figure 34J:
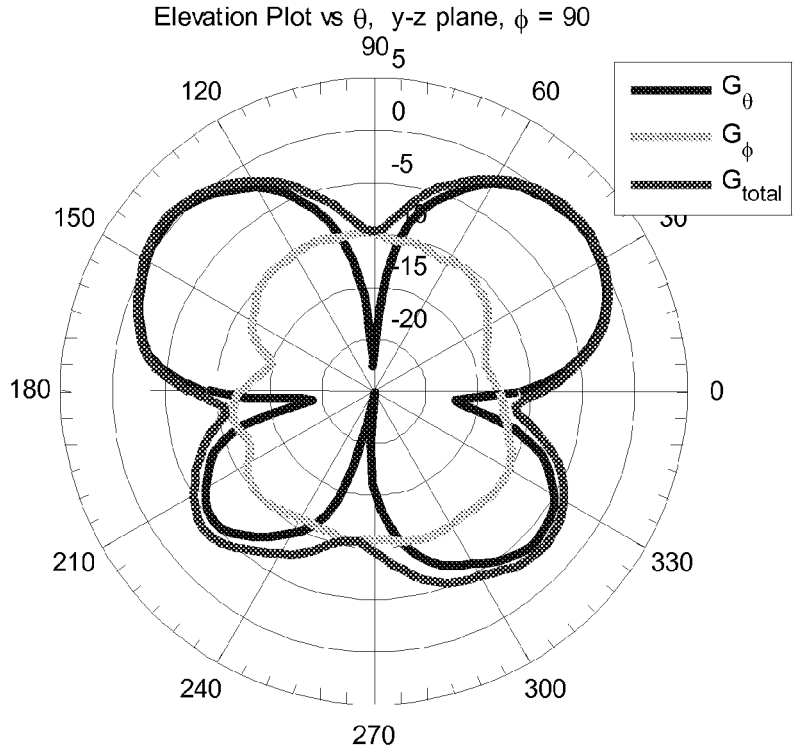

FIGS. 34A and 34B show simulated and measured return losses in the above transceiver device. The return losses and isolation are similar with slight shift in center frequency due to solder mask on top and bottom layers. The isolation between the 2.1 GHz and 1.7 GHz antennas is significantly below −25 dB even though the separation between adjacent TX and RX antennas is less than 1.5 mm which is about λ/95. The isolations between the two Rx antenna cells 2.1 GHz antennas is less than −10 dB with a less than 3 mm separation (i.e. less than λ/45).

FIGS. 34C and 34D-F show the efficiency and radiation patterns in the 2.1-GHz band, respectively. The efficiency is above 50% and the peak gain is achieved at 1.8 GHz. These are excellent numbers considering the antenna cell 3323 has a compact antenna structure with a dimension of λ/20 (length)×λ/35 (width)×λ/120 (depth).

FIGS. 34G and 34H-J show the efficiency and radiation patterns in the 1.71-GHz band, respectively. The efficiency reaches 50% and peak gain is achieved at 1.6 GHz. These are excellent numbers considering the antenna cell 3323 has a compact antenna structure with a dimension of λ/17 (length)× λ/35 (width)×λ/160 (depth).

Some applications such as laptops impose space constraints on the length of antennas in the direction perpendicular to the surface of the GND plane. The antenna cells can be arranged in a parallel direction to the top GND to provide a compact antenna configuration.

Figure 35:
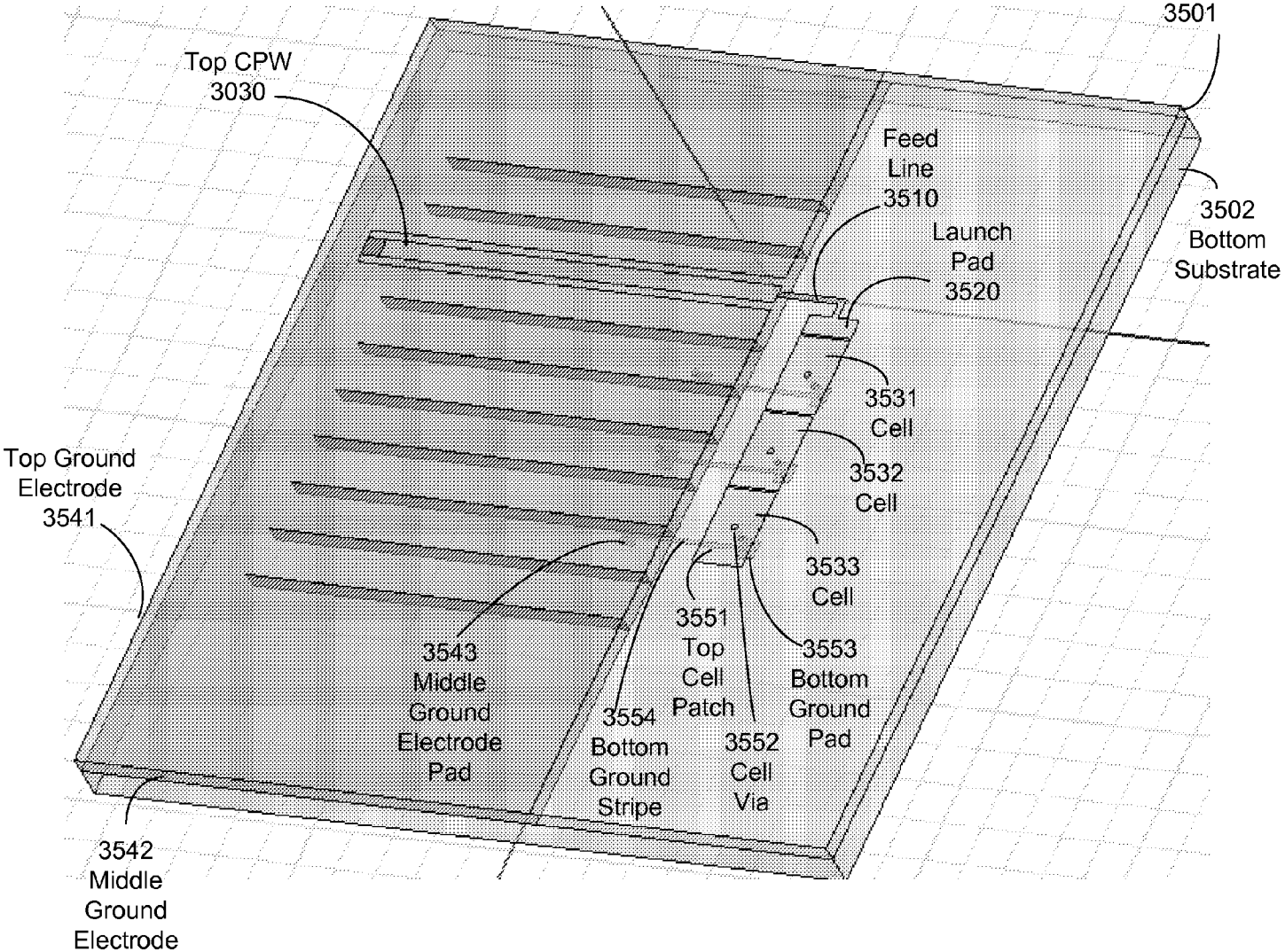
Figure 36:
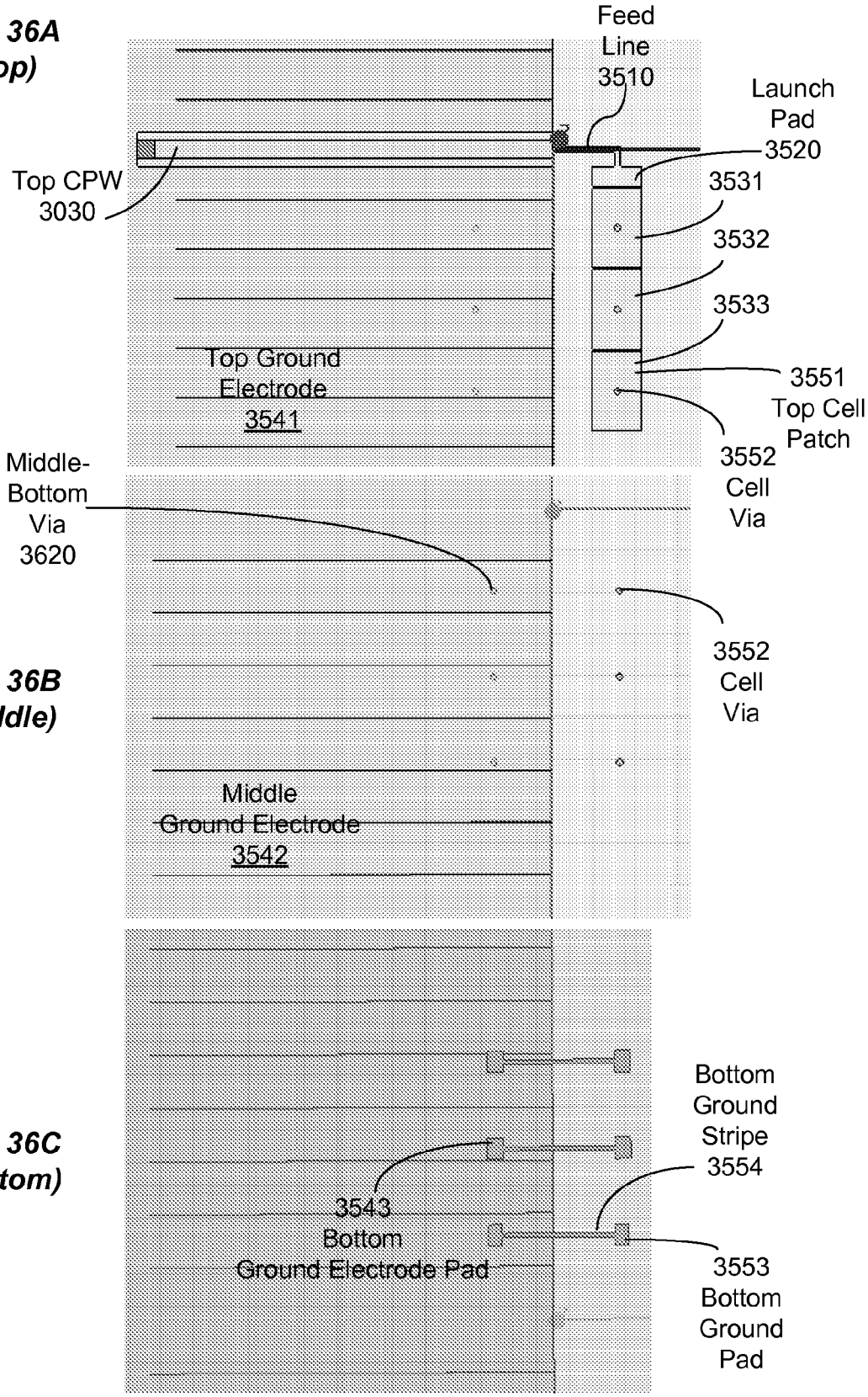

FIG. 35 illustrate one exemplary MTM antenna design in this configuration. FIGS. 36A, 36B and 36C illustrate details of the three-layer design in FIG. 35. A 3-layer ground electrode design is used in this example where two substrates 3501 and 3502 stack over each other to support three ground electrode layers: a top ground electrode 3541 on the top surface of the substrate 3501, a middle ground electrode 3542 between the two substrates 3501 and 3502, and bottom ground electrode pads 3543 on the bottom of the substrate 3502. The ground electrodes 3451 and 3452 are two main GND for the device. Each bottom ground electrode pad 3543 is associated with a MTM cell and is provided to route the electrical current below the middle ground electrode 3542.

MTM antenna cells 3531, 3532 and 3533 are positioned to form an antenna that is elongated along a direction parallel to the border of ground electrodes 3541, 3542 and 3543. Accordingly, three bottom ground electrode pad 3543 are formed on the bottom of the substrate 3502. Each antenna cell includes a top cell patch 3551 on the top surface of the substrate 3501, a cell via 3552 extending between the top surface of the substrate 3501 and the bottom surface of the substrate 3502 and in contact with the top cell metal patch 3551, and a bottom ground pad 3553 on the bottom surface of the substrate 3502 and in connect with the cell via 3552. The cell via 3552 may include a first via in the top substrate 3501 and a separate second via in the bottom substrate 3502 that are connected to each other at the interface between the substrates 3501 and 3502. A bottom ground stripe line 3554 is formed on the bottom surface of the substrate 3502 to connect the ground pad 3553 to the bottom ground electrode pad 3543. The middle ground electrode 3542 and the ground electrode pads 3543 are connected by conductive middle-bottom vias 3620 which are also visible from the bird's eye view of the top layer in FIG. 36A. The metal layer for the top ground electrode 3541 is patterned to form a CPO 3030 for feeding the antenna formed by the MTM cells 3531, 3532 and 3533. A feed line 3510 is formed to connect the CPW 3030 to a launch pad 3520 that is located next to the first MTM cell 3531 is capacitively coupled to the cell 3531 via a gap. In this design, the middle electrode 3542 is to extend the GND lines on the bottom layer beyond the edge of the main GND so that the electric current paths are extended below the main GND to lower the resonant frequencies.

In one implementation, the top substrate 3501 is 0.787 mm thick and the lower substrate 3502 is 1.574 mm thick. Both substrates 3501 and 3502 can be made from a dielectric material with a permittivity of 4.4. In other implementations, the substrates 3501 and 3502 can be made from dielectric materials of different permittivity values. The top patch of the unit CRLH MTM cell is 2.5 mm wide (y-direction) and 4 mm long (x-direction) with a 0.1-mm gap between two adjacent cells. The feed-line is coupled to the antenna with a 0.1 mm gap from the edge of the first unit cell. The vias connecting all top patching with bottom cell-GND are 12 mil in diameter and are located in the center of the top patches. The GND line extends 3.85 mm below the mid-layer main GND to lower frequency resonances and vias of 1.574 mm in length and 12 mil in diameter are used to connect the bottom layer GND lines to mid-layer main GND.

Figure 37:
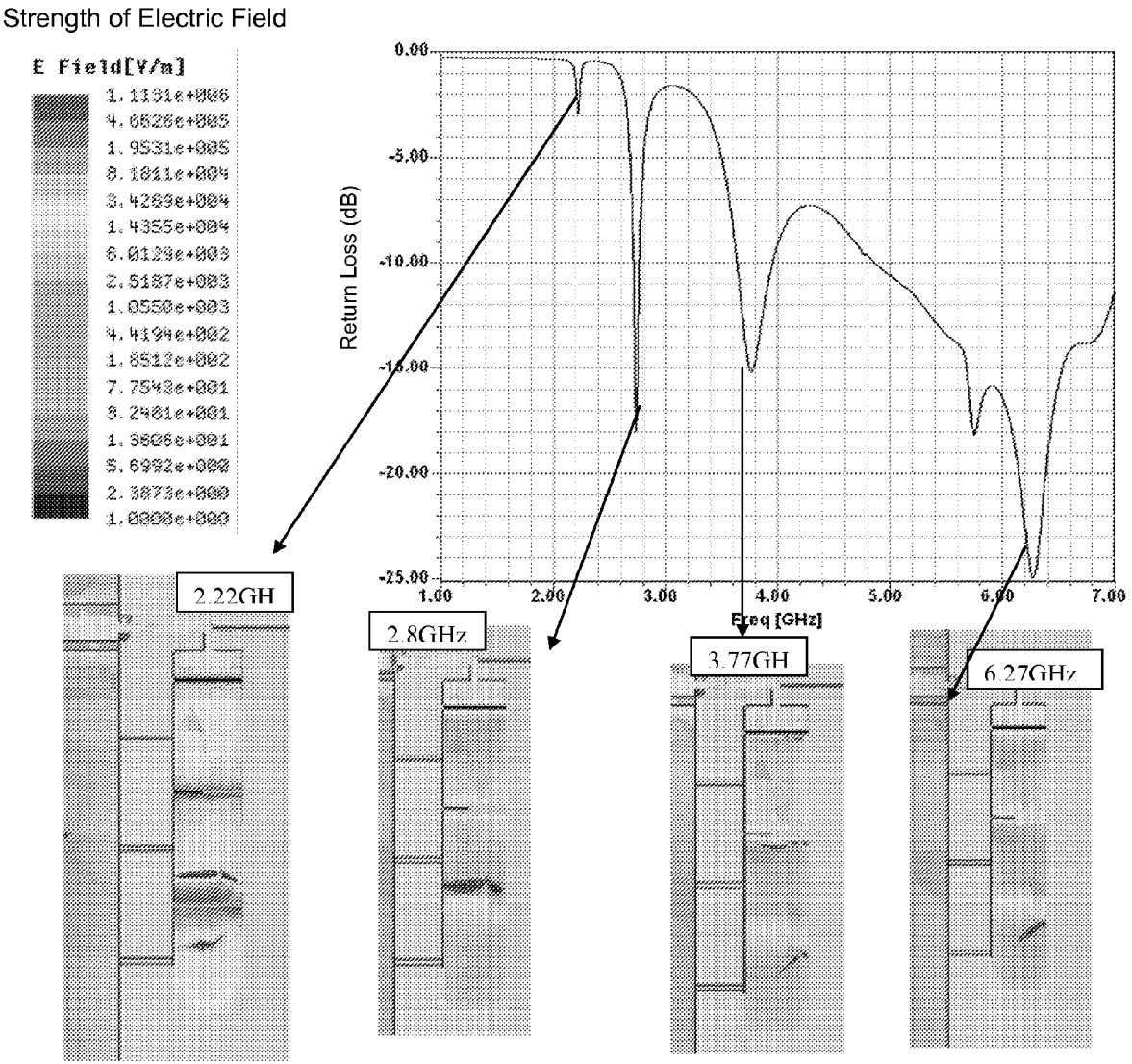

FIG. 37 shows FHSS simulation results of the return loss of the above antenna as a function of the frequency. The electric field distribution of each antenna signal on the device is also illustrated for signal frequencies of 2.22 GHz, 2.8 GHz, 3.77 GHz and 6.27 GHz. The lowest resonances are LH because the frequency decreases with decreasing guided wave along the stricture. The guided waves are seen as the distance between two peaks along the 3-cell structure. At 2.2 GHz, the resonance wave is confined between two consecutive cell boundaries, while at higher frequencies the waves span over two or more cells.

CRLH MTM Antennas with Perfect Magnetic Conductor Structure

The above CRLH MTM structure designs are based on use of a perfect electric conductor (PEC) as the ground electrode on one side of the substrate. A PEC ground can be a metal layer covering the entire substrate surface. As illustrated in above examples, a PEC ground electrode may be truncated to have a dimension less than the substrate surface to increase bandwidths of antenna resonances. In the above examples, a truncated PEC ground electrode can be designed to cover a portion of a substrate surface and does not overlap the footprint of a MTM cell. In such a design, a ground electrode stripe line can be used to connect cell via and the truncated PEC ground electrode. This use of reduction of the GND plane beneath the MTM antenna structure to achieve reduced RH capacitance C_R and increased LH counterpart, C_L. As a result, the bandwidth of a resonance can be increased.

A PEC ground electrode provides a metallic ground plane in MTM structures. A metallic ground plane can be substituted by a Perfect Magnetic Conductor plane or surface of a Perfect Magnetic Conductor (PMC) structure. PMC structures are synthetic structures and do not exist in nature. PMC structures can exhibit PMC properties over a substantially wide frequency range. Examples of PMC structures are described by Sievenpiper in "High-Impedance Electromagnetic Surfaces", Ph.D. Dissertation, University of California, Los Angeles (1999). The following sections describe MTM structures for antenna and other applications based on combinations of CRLH MTM structures and PMC structures. An MTM antenna can be designed to include a PMC plane instead of a PEC plane beneath the MTM structure. Initial investigations based on a HFSS model confirm that such designs can provide greater BW than MTM antennas with metallic GND plane for MTM antennas in both 1-D and 2-D configurations. Hence, an MTM antenna can include, for example, a dielectric substrate having a first surface on a first side and a second surface on a second side opposing the first side, at least one cell conductive patch formed on the first surface, a PMC structure formed on the second surface of the substrate to support a PMC surface in contact with the second surface, and a conductive via connector formed in the substrate to connect the conductive patch to the PMC surface to form a CRLH MTM cell. A second substrate can be used to support the PMC structure and is engaged to the substrate to construct the MTM antenna.

Figure 38:
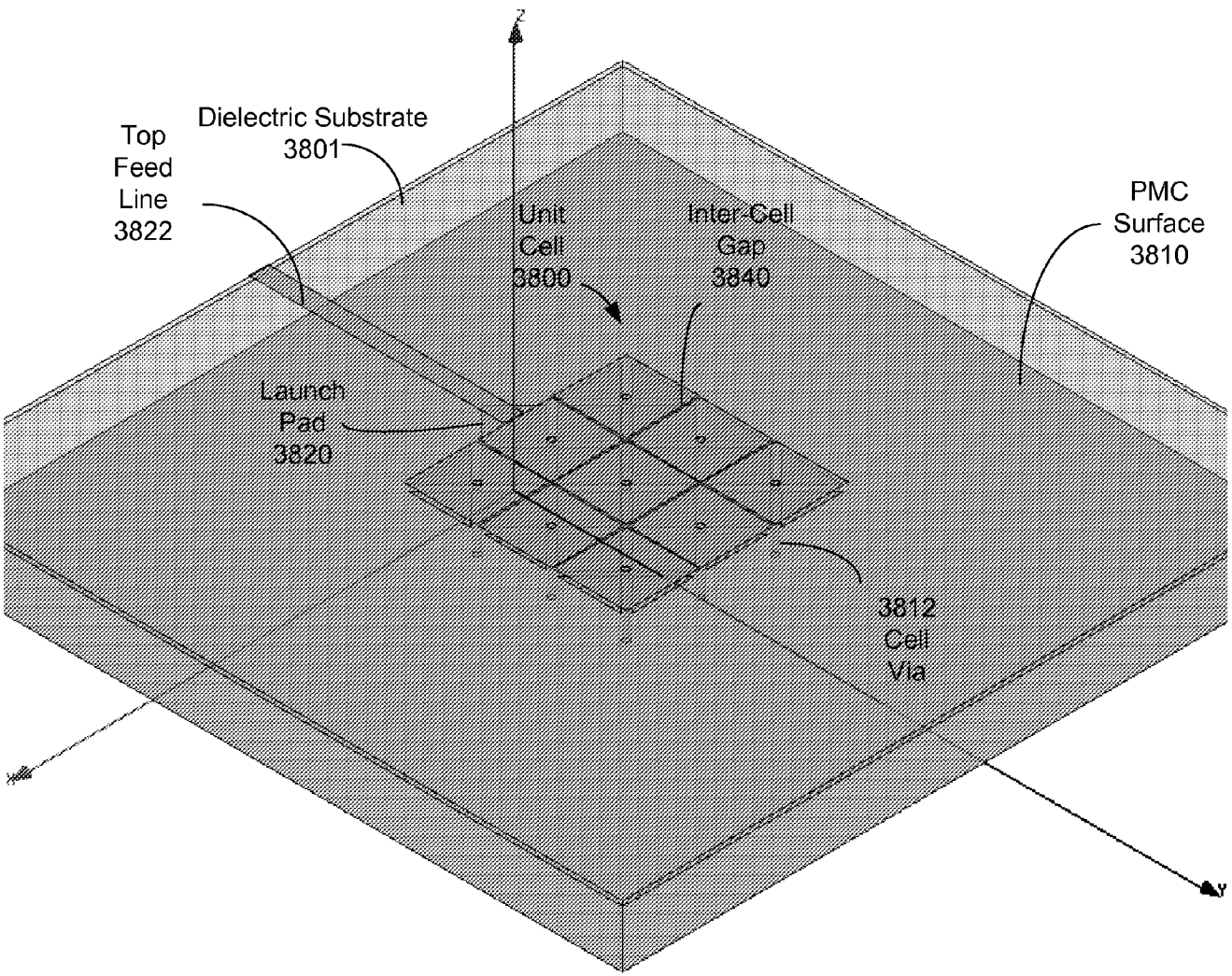

FIG. 38 shows one example of a 2-D MTM cell array formed over a PMC surface. A first substrate 3801 is used to support CRLH MTM unit cells 3800 in an array. Two adjacent cells 3800 are spaced by an inter-cell gap 3840 and are capacitively coupled to each other. Each cell includes a conductive cell via 3812 extending in the first substrate 3801 between the two surfaces. A PMC structure formed on a second substrate is engaged to the bottom surface of the first substrate 3801 to provide a PMC surface 3810 as a substitute for a ground electrode layer. A feed line 3822 is capacitively coupled to a unit cell 3800 in the array. A launch pad 3820 can be formed below the feed line 3822 and positioned to cover a gap between the feed line 3822 and the unit cell to enhance the capacitive coupling between the feed line 3822 and the unit cell. FIGS. 39A, 39B, 39C and 39D show details of the design in FIG. 38. A layer of capacitive coupling metal patches 3920 can be formed below the top cell electrode patches 3910 and positioned underneath the inter-cell gaps 3840 to form MIM capacitors. The launch pad 3820 can be formed in the same layer with the capacitive coupling metal patches 3920.

Figure 40:
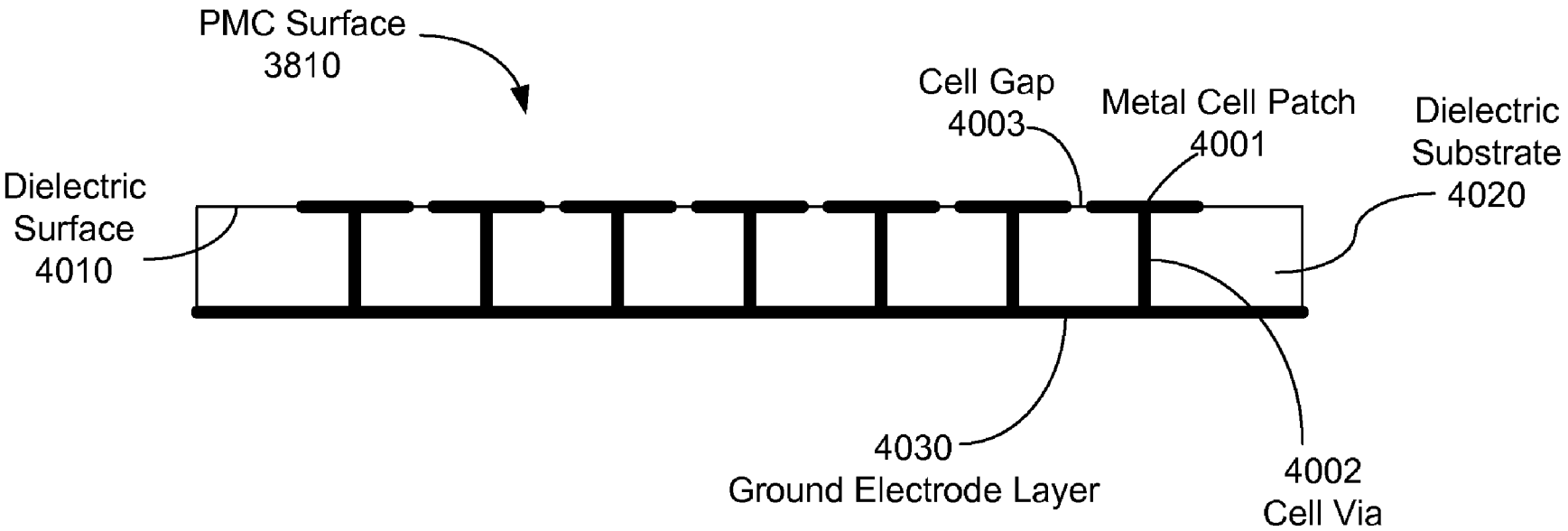
FIG. 40 shows an example of a PMC structure which provides a PMC surface for the device in FIG. 38.

FIG. 40 shows an example of a PMC structure that can be used to implement the PMC surface 3810 in FIG. 38. A second substrate 4020 is provided to support the PMC structure. On the top surface of the substrate 4020, a periodic array of metal cell patches 4001 are formed to have a cell gap 4003 between two adjacent cell patches. A full ground electrode layer 4030 is formed on the other side, the bottom side, of the substrate 4020. Cell vias 4002 are formed in the substrate 4020 to connect each metal cell patch 4001 to the full ground electrode layer 4030. This structure can be configured to form a bandgap material and renders the top surface with the metal cell patch array a PMC surface 3810. The PMC structure in FIG. 40 can be stacked to the substrate 3801 to place the top surface with the metal cell patch array in contact with the bottom surface of the substrate 3801. This combination structure is a MTM structure built on the PMC structure in FIG. 40.

The full HFSS model can be based on the 2-D MTM antenna design in FIGS. 3 and 23 by replacing the GND electrode with a PMC surface. HFSS simulations were performed on a MTM antenna in FIG. 38. The antenna for the HFSS simulations use two substrates mounted on top of each other. The top substrate is 0.25 mm thick and has a high permittivity of 10.2. The bottom substrate is 3.048 mm thick and has a permittivity of 3.48. The three metallization layers are located on the top, bottom and between the two substrates. The role of the middle layer is to increase the capacitive coupling between two adjacent cells and between the first center cell and the feed line by using Metal-Insulator-Metal (MIM) capacitor. The top patch of the unit CRLH cell is 4mm wide (x-direction) and 4 mm long (y-direction) with 0.2 mm gap between two adjacent cells. The feed-line is coupled to the antenna with a 0.1 mm gap from the edge of the first unit cell. The vias connecting all top patching with bottom cell-GND are 0.34 mm in diameter and located in the center of the top patches. The MIM patches are rotated by 45 degrees from top patches and have 2.48 mm×2.48 mm dimension.

Figure 41A:
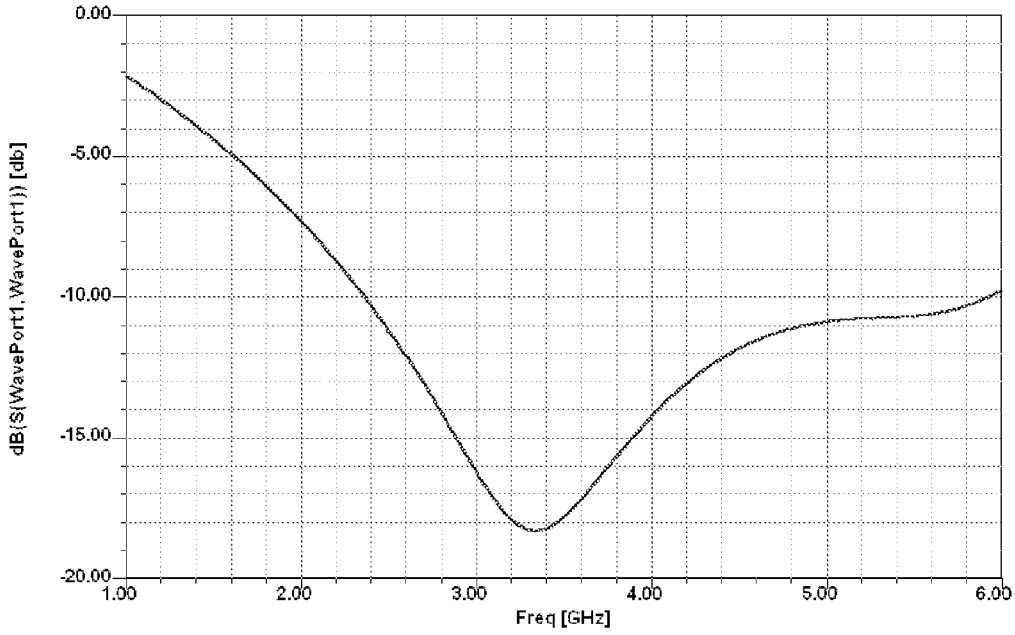
FIGS. 41A and 41B show simulation results of the device in FIG. 38.
Figure 41B:
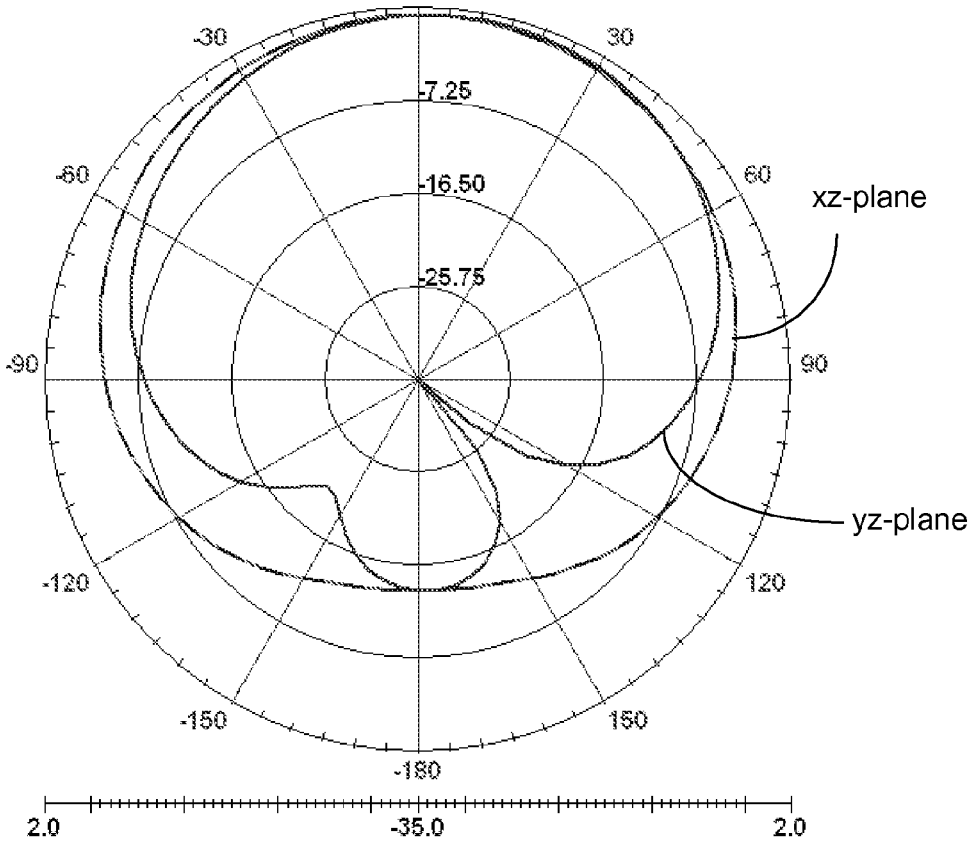

FIGS. 41A and 41B show HFSS simulated return loss of the antenna and the antenna radiation patterns. The BW of the antenna extends from 2.38 GHz to 5.90 GHz, which covers frequency bands of a wide range of wireless communication applications (e.g. WLAN 802.11 a,b,g, n, WiMax, BlueTooth, etc.). In comparison with the previous MTM designs using reduced GND metallic plane, the BW achieved in a MTM structure with a PMC surface can be significantly increased. In addition, the antenna exhibits a patch-like radiation pattern as shown in FIG. 41B. This radiation pattern is desirable in various applications.

Figure 42:
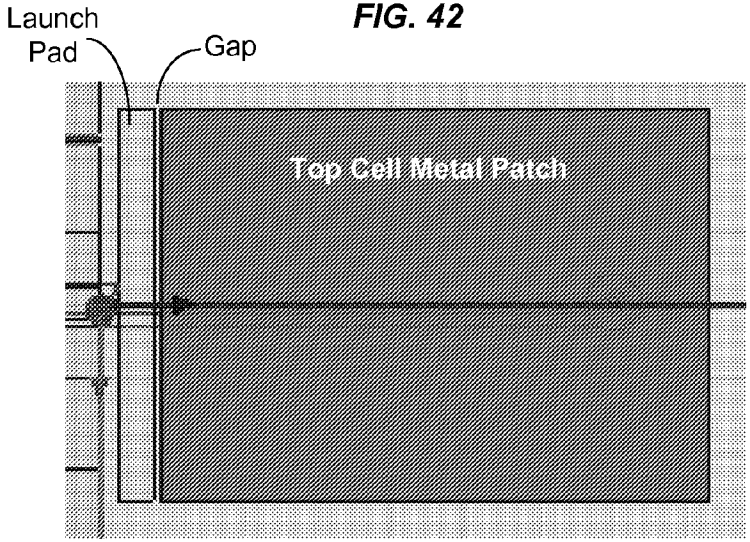
FIGS. 42-48 show examples of non-straight borders for the interfacing borders of a top cell metal patch and a corresponding launch pad in a CRLH MTM device.
Figure 43:
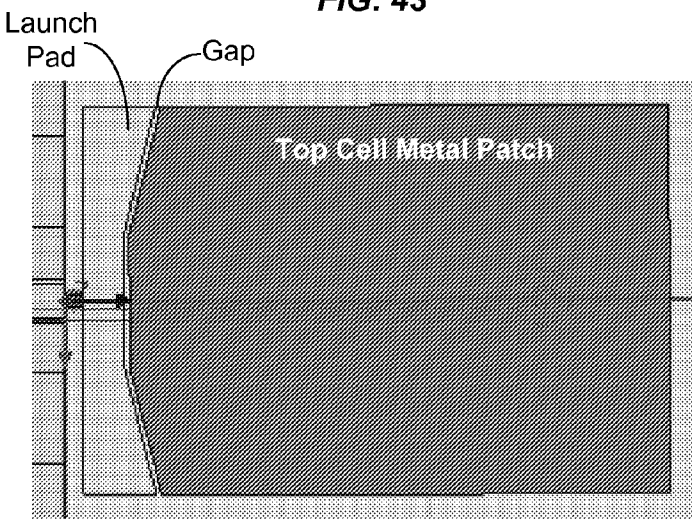
Figure 44:
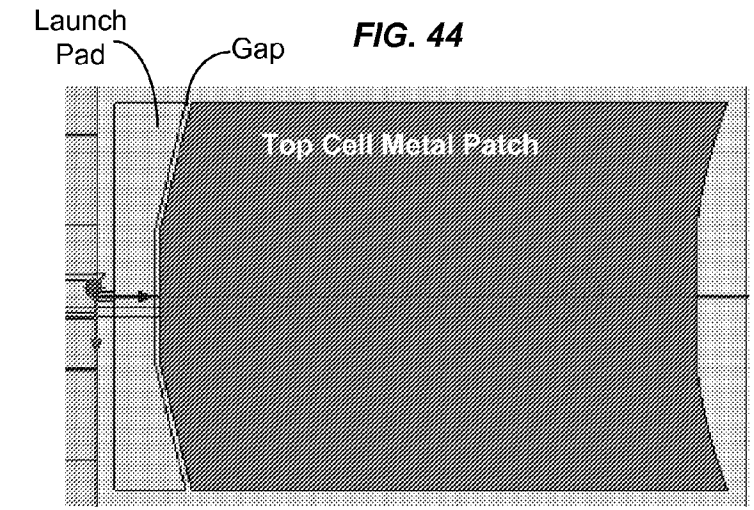
Figure 45:
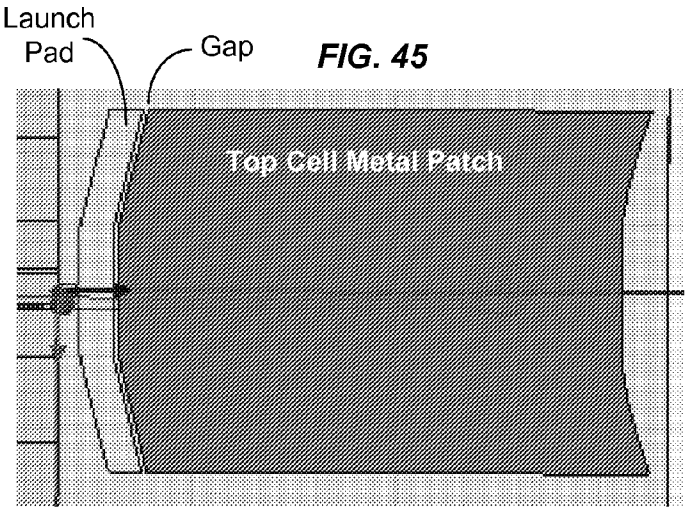
Figure 46:
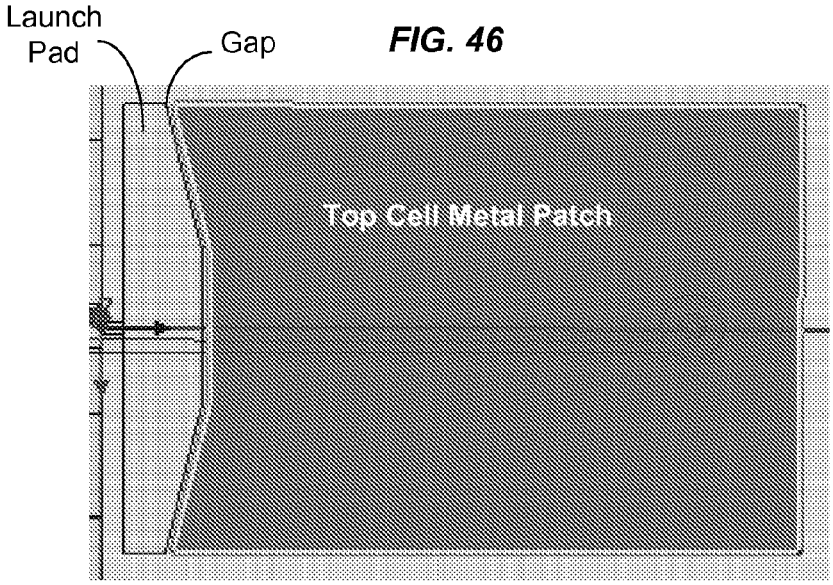
Figure 47:
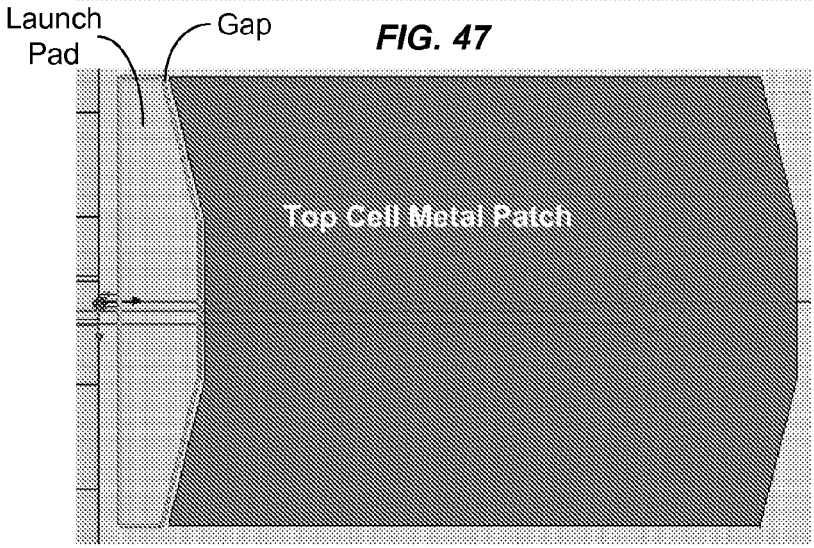
Figure 48:
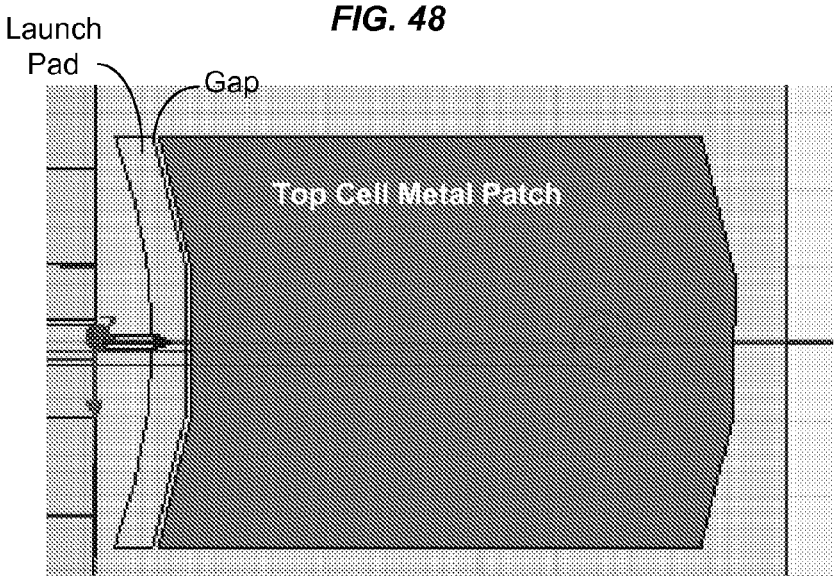

In the above examples, the borders of electrodes for various components in CRLH MTM structures such as the top cell metal patches and launch pads are straight. FIG. 42 illustrates one example of a top cell metal patch of a unit cell and its launch pad with such a straight border. Such a border, however, can be curved or bended to have either a concave or convex border to control the spatial distribution of the electrical field in and the impedance matching condition of the CRLH MTM structures. FIGS. 43-48 provide examples of non-straight borders for the interfacing borders of a top cell metal patch and a corresponding launch pad. FIGS. 44, 45, 47 and 48 further show examples where a free-standing border of the top cell metal patch that does not interface with a border of another electrode can also have a curved or bended border to control the distribution of the electric field or the impedance matching condition of a CRLH MTM structure.

In various CRLH MTM devices in 1D and 2D configurations, single and multiple layers can be designed to comply with RF chip packaging techniques. The first approach is leveraging the System-on-Package (SOP) concept by using Low-Temperature Co-fired Ceramic (LTCC) design and fabrication techniques. The multilayer MTM structure is designer for LTCC fabrication by using a material with a high dielectric constant or permittivity $\in$. One example of such a material is the DuPont 951 with $\in$=7.8 and loss tangent of 0.0004. The higher $\in$ value leads to further size miniaturization. Therefore, all the designs and examples presented in previous section using FR4 substrates with $\in$=4.4, can be ported to LTCC with tuning the series and shunt capacitors and inductors to comply with LTCC higher dialectic constant substrate. Monolithic Microwave IC (MMIC) using GaAs substrates and thin polyamide layers may also be used to reduce the printed MTM design to RF chips. An original MTM design on FR4 or Roger substrates is tuned to comply with the LTCC and MMIC substrates/layers dielectric constants and thicknesses.

| Acronyms | |
|---|---|
| 1D | One dimensional |
| 2D | Two dimensional |
| BB | Broadband |
| $C_L$ | $C_{series}$: series capacitor in the equivalent Metamaterial |
| $C_R$ | circuit |
| $L_R$ | $C_{shunt}$: shunt capacitor in the equivalent Metamaterial |
| $L_L$ | circuit |
| | $L_{series}$: series inductance in the equivalent Metamaterial circuit |
| | $L_{shunt}$: shunt inductance in the equivalent Metamaterial circuit |

-continued

| Acronyms | |
|---|---|
| CRLH | Composite Right/Left-Handed |
| GND | Ground Plane |
| EM | Electromagnetic |
| FEM | Full Electromagnetic |
| LH | Left Hand |
| MB | Multiband |
| MIMO | Multiple Input Multiple Output |
| MTM | Metamaterial |
| PMC | Perfect Magnetic Conductor |
| RH | Right Hand |
| TE | Transverse Electric Field |
| TEM | Transverse Electric and magnetic Fields |
| TM | Transverse Magnetic Field |
| TL | Transmission Line |

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination.

Only a few implementations are disclosed. However, it is understood that variations and enhancements may be made.

What is claimed is:

1. An antenna device, comprising:

a dielectric substrate having a first surface on a first side and a second surface on a second side opposing the first side;

a cell conductive patch formed on the first surface;

a cell ground conductive electrode formed on the second surface and in a footprint projected by the cell conductive patch onto the second surface;

a main ground electrode formed on the second surface and separated from the cell ground conductive electrode to leave part of the second surface exposed without being covered by a conductive electrode;

a cell conductive via connector formed in the substrate to connect the cell conductive patch to the cell ground conductive electrode;

a conductive feed line formed on the first surface and having a distal end located close to and electromagnetically coupled to the cell conductive patch to direct an antenna signal to or from the cell conductive patch; and a conductive stripe line formed on the second surface and connecting cell ground conductive electrode to the main ground electrode, wherein the cell conductive patch, the substrate, the cell conductive via connector and the cell ground conductive electrode, and the electromagnetically coupled conductive feed line are structured to form a composite left and right handed (CRLH) metamaterial structure that transmits or receives the antenna signal using the cell conductive patch.

2. The device as in claim 1, comprising:

a conductive launch pad formed near and separated from the distal end of the conductive feed line and the cell conductive patch to enhance capacitive coupling between the conductive feed line and the cell conductive patch under an impedance matching condition for supporting a resonant frequency in the antenna signal.

3. The device as in claim 1, wherein:

the cell ground electrode has an area greater than a cross section of the cell conductive via connector and less than an area of the cell conductive patch.

4. The device as in claim 1, wherein:

the cell ground electrode has an area greater than an area of the cell conductive patch.

5. The device as in claim 1, wherein:

the conductive stripe line has a width less than a dimension of the cell conductive patch.

6. The device as in claim 1, wherein:

the main ground conductive electrode formed on the second surface is located outside the footprint projected by the cell conductive patch onto the second surface.

7. The device as in claim 6, comprising:

a second main ground electrode formed on the first surface and patterned to form a co-planar waveguide, and wherein:

the co-planar waveguide is connected to the conductive feed line to direct the antenna signal to or from conductive feed line.

8. The device as in claim 7, wherein:

the second main ground electrode formed on the first surface is patterned to form a second co-planar waveguide;

the device comprising a second composite left and right handed (CRLH) metamaterial structure formed on the substrate and electromagnetically coupled to the second co-planar waveguide on the first surface and to the main ground on the second surface, the second CRLH metamaterial structure comprising:

a second cell conductive patch formed on the first surface and electromagnetically coupled to the second co-planar waveguide which directs a second antenna signal to or from the second cell conductive patch;

a second cell ground conductive electrode formed on the second surface and in a footprint projected by the second cell conductive patch onto the second surface;

a second cell conductive via connector formed in the substrate to connect the second cell conductive patch to the second cell ground conductive electrode; and a second conductive stripe line formed on the second surface and connecting the second cell ground conductive electrode to the main ground electrode.

9. The device as in claim 8, wherein:

the cell conductive patch and the second cell conductive patch have different dimensions to render the CRLH metamaterial structure formed by the cell conductive patch and the second CRLH metamaterial structure formed by the second cell conductive patch to have different resonant frequencies.

10. The device as in claim 9, wherein:

the CRLH metamaterial structure formed by the cell conductive patch forms a receiver antenna; and the second CRLH metamaterial structure formed by the second cell conductive patch forms a transmitter antenna.

11. The device as in claim 10, wherein:

the second main ground electrode formed on the first surface is patterned to form a third co-planar waveguide;

the device comprising a third composite left and right handed (CRLH) metamaterial structure formed on the substrate and electromagnetically coupled to the third co-planar waveguide on the first surface and to the main ground on the second surface, the third CRLH metamaterial structure comprising:

a third cell conductive patch formed on the first surface and electromagnetically coupled to the third co-planar waveguide which directs a third antenna signal to or from the third cell conductive patch;

a third cell ground conductive electrode formed on the second surface and in a footprint projected by the third cell conductive patch onto the second surface;

a third cell conductive via connector formed in the substrate to connect the third cell conductive patch to the third cell ground conductive electrode; and a third conductive stripe line formed on the second surface and connecting the third cell ground conductive electrode to the main ground electrode.

12. The device as in claim 11, wherein:

the third CRLH metamaterial structure formed by the third cell conductive patch forms a second receiver antenna.

13. The device as in claim 7, comprising:

a parasitic cell, which is electromagnetically coupled to the main ground electrode on the second surface and the second main ground electrode on the first surface, and which comprises:

a parasitic cell conductive patch formed on the first surface;

a parasitic cell ground conductive electrode formed on the second surface and in a footprint projected by the parasitic cell conductive patch onto the second surface;

a parasitic cell conductive via connector formed in the substrate to connect the parasitic cell conductive patch to the parasitic cell ground conductive electrode;

a first parasitic conductive line formed on the first surface to include a first end connected to electromagnetically couple to the parasitic cell conductive patch and a second end connected to the second main ground electrode; and a second parasitic conductive line formed on the second surface and connecting the parasitic cell ground conductive electrode to the main ground electrode.

14. The device as in claim 13, comprising:

a second parasitic cell which is separate from the parasitic cell, and which is electromagnetically coupled to the main ground electrode on the second surface and the second main ground electrode on the first surface.

15. An antenna device, comprising:

a dielectric substrate having a first surface on a first side and a second surface on a second side opposing the first side;

a plurality of cell conductive patches formed over the first surface to be separated from and adjacent to one another to allow capacitive coupling between two adjacent cell conductive patches;

a main ground electrode formed on the second surface outside a footprint projected collectively by the cell conductive patches onto the second surface to leave part of the second surface exposed without being covered by a conductive electrode;

a plurality of cell ground electrodes formed on the second surface to spatially correspond to the cell conductive patches, one cell ground electrode to one cell conductive patch, respectively, wherein each cell ground electrode is within a footprint projected by a respective cell conductive patch onto the second surface, and wherein the cell ground electrodes are spatially separate from the main ground electrode;

a plurality of conductive via connectors formed in the substrate to connect the cell conductive patches to the cell ground electrodes, respectively, to form a plurality of unit cells that construct a composite left and right handed (CRLH) metamaterial structure;

at least one conductive stripe line formed on the second surface to connect the plurality of cell ground electrodes to the main ground electrode; and a conductive feed line formed on the first surface and having a distal end located close to and electromagnetically coupled to one of the cell conductive patches to direct an antenna signal to or from the coupled cell conductive patch, wherein the CRLH metamaterial structure transmits or receives the antenna signal using the cell conductive patches.

16. The device as in claim 15, wherein:

the main ground electrode formed on the second surface includes an electrode portion outside a footprint projected collectively by the cell conductive patches onto the second surface, wherein the electrode portion is pattered to include an aperture that is larger than the footprint projected collectively by the cell conductive patches onto the second surface and that is located to overlap with the footprint projected collectively by the cell conductive patches.

17. The device as in claim 15, wherein:

each unit cell has a dimension not greater than one tenth of a wavelength of a signal in resonance with the CLRH metamaterial structure.

18. The device as in claim 17, wherein:

each unit cell has a dimension not greater than one fortieth of a wavelength of a signal in resonance with the CRLH metamaterial structure.

19. The device as in claim 15, wherein:

the plurality of cell conductive patches on the first surface are arranged to form a linear array with a first cell conductive patch on a first end of the linear array and a second cell conductive patch on a second end of the linear array, the device comprising:

a feed line formed on the first surface and electromagnetically coupled to the first cell conductive patch to direct an antenna signal to or from the first cell conductive patch; and a termination capacitor comprising a conductive electrode that is capacitively coupled to the second cell conductive patch.

20. The device as in claim 19, wherein:

the conductive electrode of the termination capacitor is located between the second cell conductive patch and the first surface.

21. An antenna device, comprising:

a first dielectric substrate having a first top surface on a first side and a first bottom surface on a second side opposing the first side;

a second dielectric substrate having a second top surface on a first side and a second bottom surface on a second side opposing the first side, the first and second dielectric substrates stacking over each other to engage the second top surface to the first bottom surface;

a plurality of cell conductive patches formed on the first top surface to be separated from and adjacent to one another to allow capacitive coupling between two adjacent cell conductive patches;

a first main ground electrode formed on the first top surface and spatially separate from the cell conductive patches, the first main ground electrode patterned to form a co-planar waveguide that is electromagnetically coupled to a selected cell conductive patch of the cell conductive patches to direct an antenna signal to or from the selected cell conductive patch;

a second main ground electrode formed between the first and second substrates and on the second top surface and the first bottom surface, wherein the second main around electrode is located outside a footprint projected collectively by the cell conductive patches onto the second top surface and the first bottom surface to leave part of the second top surface and the first bottom surface exposed without being covered by a conductive electrode;

a plurality of cell ground electrodes formed on the second bottom surface to spatially correspond to the cell conductive patches, one cell ground electrode to one cell conductive patch, respectively, wherein each cell ground electrode is within a footprint projected by a respective cell conductive patch onto the second bottom surface;

a plurality of bottom ground electrodes formed on the second bottom surface below the second main ground electrode;

a plurality of cell conductive via connectors formed in the first and second substrates to connect the cell around electrodes on the second bottom surface to the cell conductive patches on the first top surface, respectively;

a plurality of ground conductive via connectors formed in the second substrate to connect the bottom ground electrodes to the second main electrode, respectively;

a plurality of bottom surface conductive stripe lines formed on the second bottom surface to connect the plurality of cell ground electrodes to the bottom ground electrodes, respectively, wherein the cell conductive patches, the cell around electrodes, and the cell conductive via connectors are structured and connected to form a composite left and right handed (CRLH) metamaterial structure which transmits and receives the antenna signal using the cell conductive patches.

22. The device as in claim 21, wherein:

the plurality of cell conductive patches on the first top surface are arranged to form a linear array that is parallel to an edge of the first main ground electrode facing the plurality of cell conductive patches.

23. The device as in claim 21, comprising:

a conductive launch pad formed adjacent to the selected cell conductive patch and spaced from the selected cell by a gap, wherein a dimension of the launch pad and the gap are configured to provide a matching network to excite a resonance at a target resonance frequency within the antenna signal; and a conductive feed line connected between the co-planar waveguide and the conductive launch pad.

24. The device as in claim 21, comprising:

a conductive patch formed near a gap between two adjacent cell conductive patches to form a metal-insulator-metal (MIM) structure to enhance capacitive coupling between the two adjacent cell conductive patches.

25. An antenna device, comprising:

a first dielectric substrate having a first surface on a first side and a second surface on a second side opposing the first side;

a cell conductive patch formed over the first surface;

a perfect magnetic conductor (PMC) structure comprising a second dielectric substrate fabricated with a three-dimensional electrode structure to provide a perfect magnetic conductor (PMC) surface and engaged to the second surface of the substrate to press the PMC surface against the second surface;

a cell conductive via connector formed in the first dielectric substrate to connect the cell conductive patch to the PMC surface; and a conductive feed line formed on the first surface and having a distal end located close to and electromagnetically coupled to the cell conductive patch to direct an antenna signal to or from the cell conductive patch, wherein the cell conductive patch, the substrate, the cell conductive via connector, electromagnetically coupled conductive feed line, and the PMC surface are structured to form a composite left and right handed (CRLH) metamaterial structure which transmits and receives the antenna signal using the cell conductive patch.

26. The device as in claim 25, wherein the PMC structure comprises:

a periodic array of metal patches formed on a first surface of the second dielectric substrate;

a ground electrode layer formed on a second surface of the second dielectric substrate; and a plurality of conductive vias formed in the second dielectric substrate to respectively connect the metal patches on the first surface to the ground electrode layer on the second surface wherein the metal patches, the ground electrode layer, the conductive vias and the second dielectric substrate are structured so that the first surface of the second dielectric substrate and the metal patches form the PMC surface which is engaged to the second surface of the first dielectric substrate.

* * * * *

UNITED STATES PATENT AND TRADEMARK OFFICE

CERTIFICATE OF CORRECTION

PATENT NO. : 7,592,957 B2
APPLICATION NO. : 11/844982
DATED : September 22, 2009
INVENTOR(S) : Maha Achour, Ajay Gummalla and Marin Stoytchev It is certified that error appears in the above-identified patent and that said Letters Patent is hereby corrected as shown below:

In claim 21, column 31, line 8, delete "around" and insert --ground--.

In claim 21, column 31, line 8, delete "around" and insert --ground--.

In claim 21, column 31, line 8, delete "around" and insert --ground--.

In claim 25, column 32, line 29, delete "the substrate," and insert --the first dielectric substrate,--.

Signed and Sealed this

Twenty-ninth Day of December, 2009

David J. Kappos

David J. Kappos
*Director of the United States Patent and Trademark Office*